US011452424B2

(12) United States Patent
Sato et al.

(10) Patent No.: US 11,452,424 B2
(45) Date of Patent: Sep. 27, 2022

(54) ELECTRIC VACUUM CLEANER APPARATUS

(71) Applicant: TOSHIBA LIFESTYLE PRODUCTS & SERVICES CORPORATION, Kawasaki (JP)

(72) Inventors: Tsuyoshi Sato, Owariasahi (JP); Masatoshi Tanaka, Seto (JP); Yukio Machida, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 286 days.

(21) Appl. No.: 16/621,370

(22) PCT Filed: Jun. 18, 2018

(86) PCT No.: PCT/JP2018/023083
§ 371 (c)(1),
(2) Date: Dec. 11, 2019

(87) PCT Pub. No.: WO2018/235767
PCT Pub. Date: Dec. 27, 2018

(65) Prior Publication Data

US 2020/0154967 A1 May 21, 2020

(30) Foreign Application Priority Data

Jun. 22, 2017 (JP) ..... JP2017-122529

(51) Int. Cl.
*A47L 9/28* (2006.01)
*A47L 9/16* (2006.01)
*A47L 9/32* (2006.01)

(52) U.S. Cl.
CPC ..... *A47L 9/2873* (2013.01); *A47L 9/1683* (2013.01); *A47L 9/32* (2013.01)

(58) Field of Classification Search
CPC ..... A47L 5/362; A47L 9/009; A47L 9/106; A47L 9/1683; A47L 9/2873; A47L 9/2884; A47L 9/32; A47L 9/327
See application file for complete search history.

(56) References Cited

U.S. PATENT DOCUMENTS

2007/0157416 A1* 7/2007 Lee ..... A47L 5/362 15/319
2007/0226949 A1* 10/2007 Hahm ..... A47L 9/106 15/340.1

(Continued)

FOREIGN PATENT DOCUMENTS

CA 2954157 A1 * 1/2016 ..... A47L 9/28
DE 102010000607 A1 * 9/2011 ..... A47L 5/225

(Continued)

OTHER PUBLICATIONS

JP-2017104335-A—English Machine Translation (Year: 2017).*
International Search Report dated Sep. 18, 2018 in PCT/JP2018/023083 filed on Jun. 18, 2018, 2 pages.

*Primary Examiner* — Marc Carlson
(74) *Attorney, Agent, or Firm* — Oblon, McClelland, Maier & Neustadt, L.L.P.

(57) ABSTRACT

An electric vacuum cleaner apparatus includes: a station, an electric vacuum cleaner attachable to the station, and plural attaching detectors which can detect the electric vacuum cleaner is attached in the station. The electric vacuum cleaner includes a cleaner body; a tubular part connected to the cleaner body and sucks in dust; and a primary dust container that stores dust sucked in with the tubular part. The station includes a secondary dust container that stores dust discharged from the primary dust container. The electric vacuum cleaner apparatus permits transfer of dust from the primary dust container to the secondary dust container when at least two of the plural attaching detectors have detected (Continued)

the attaching of the electric vacuum cleaner to the station. The electric vacuum cleaner apparatus can reliably confirm the vacuum cleaner is placed at a correct position on the charging station so that dust to be discarded from the primary dust container to the secondary dust container does not leak around the electric vacuum cleaner apparatus.

12 Claims, 26 Drawing Sheets

(56) References Cited

U.S. PATENT DOCUMENTS

2008/0201895 A1* 8/2008 Kim ..... A47L 9/106 15/319
2009/0049640 A1* 2/2009 Lee ..... A47L 9/20 15/319
2009/0133212 A1* 5/2009 Morishita ..... A47L 9/20 15/347
2009/0249577 A1* 10/2009 Ni ..... A47L 9/1658 15/326
2012/0095597 A1 4/2012 Kim et al.
2013/0305481 A1* 11/2013 Jung ..... A47L 11/33 15/301
2013/0305483 A1* 11/2013 Dyson ..... A47L 9/1616 15/353
2016/0278596 A1* 9/2016 Janzen ..... A47L 11/4041
2017/0196430 A1* 7/2017 Machida ..... A47L 9/106
2018/0199776 A1* 7/2018 Sato ..... A47L 9/1633
2020/0100640 A1* 4/2020 Marutani ..... A47L 9/2852

FOREIGN PATENT DOCUMENTS

EP 1961358 A2 * 8/2008 ..... A47L 9/106
EP 2407074 A2 * 1/2012 ..... A47L 9/28
EP 3 372 138 A1 9/2018
JP 2002-102129 A 4/2002
JP 2004-283327 A 10/2004
JP 2008-79920 A 4/2008
JP 2008-79922 A 4/2008
JP 2010-75490 A 4/2010
JP 2014-121355 A 7/2014
JP 2016182190 A * 10/2016
JP 2017104335 A * 6/2017
KR 10-2012-0055612 A 5/2012
WO WO-2013100131 A1 * 7/2013 ..... A47L 9/327
WO WO-2017047291 A * 3/2017 ..... A47L 9/2884
WO WO 2017/077577 A1 5/2017
WO WO-2018100773 A1 * 6/2018 ..... A47L 9/2873

* cited by examiner

ELECTRIC VACUUM CLEANER APPARATUS

CROSS-REFERENCE TO RELATED APPLICATIONS

This application claims the benefit of priority of No. PCT/JP2018/023083, filed on Jun. 18, 2018, and the PCT application is based upon and claims the benefit of priority from Japanese Patent Application No. 2017-122529 filed on Jun. 22, 2017, the entire contents of each of which are incorporated herein by reference.

FIELD

Embodiments according to the present invention relate to an electric vacuum cleaner apparatus.

BACKGROUND

A known electric vacuum cleaner apparatus includes an electric vacuum cleaner and a charging station. The cleaner body of the electric vacuum cleaner includes a primary dust container for collecting dust. The charging station includes a secondary dust container for collecting dust. The electric vacuum cleaner apparatus empties the primary dust container by discharging the dust collected in the primary dust container of the electric vacuum cleaner to the secondary dust container of the charging station.

The electric vacuum cleaner includes: a push button provided on the cleaner body; and a switching valve, when the push button is pushed down, the switching valve closes an air passage connecting the primary dust container to an electric blower and opens an air passage connecting the secondary dust container to the electric blower. Additionally, the electric vacuum cleaner includes: a first waste valve provided on the bottom of the primary dust container, and a second waste valve provided on the top of the secondary dust container. The first waste valve opens when the push button is pushed down. The second waste valve is opened when being pushed by the first waste valve that is opened with the push button.

When discharging of the dust from the cleaner body to the charging station, a user places the cleaner body on the charging station and pushes down the push button of the cleaner body. Consequently, the air passage connecting the primary dust container to the electric blower is closed and the air passage connecting the secondary dust container to the electric blower is opened. At the same time, the first waste valve and the second waste valve are opened and thereby the primary dust container is spatially connected to the secondary dust container. Afterward, when the user operates the cleaner body so as to start up the electric blower, the air flow to be sucked in from the suction port of the cleaner body transfers the dust collected in the primary dust container to the secondary dust container.

PRIOR ART DOCUMENT

Patent Document

[Patent Document 1] JP 2004-283327 A

SUMMARY

Problems to be Solved by Invention

In order to discharge dust from the primary dust container of the electric vacuum cleaner to the secondary dust container of the charging station, it is important to reliably connect both. If the connection between both is uncertain and insufficient, the dust leaks around the electric vacuum cleaner apparatus at the time of discharging the dust from the primary dust container to the secondary dust container.

In order to reliably connect the primary dust container to the secondary dust container, it is important that the electric vacuum cleaner is placed at the correct position on the charging station.

Accordingly, the present invention provides an electric vacuum cleaner apparatus that can reliably confirm that the vacuum cleaner is placed at a correct position on the charging station so that dust to be discarded from the primary dust container to the secondary dust container does not leak around the electric vacuum cleaner apparatus.

Means for Solving Problem

To achieve the above object, an electric vacuum cleaner apparatus includes: a station; an electric vacuum cleaner attachable to the station; and a plurality of attaching detectors configured to detect whether the electric vacuum cleaner is attached to the station. The electric vacuum cleaner includes: a cleaner body; an air passage connected to the cleaner body and configured to suck in dust; and a primary dust container that accumulates the dust sucked into the air passage. The station includes: a secondary dust container that accumulates the dust to be discharged from the primary dust container. The electric vacuum cleaner apparatus permits transfer of the dust from the primary dust container to the secondary dust container when at least two of the plurality of attaching detectors have detected an attaching of the electric vacuum cleaner to the station.

It may be desired that the plurality of attaching detectors include a first attaching detector configured to detect that the cleaner body is connected to the station.

It may be desired that the air passage is detachable from the cleaner body or the station, and the plurality of attaching detectors include a second attaching detector configured to detect that the air passage is attached to the cleaner body or the station.

It may be desired that the cleaner body or the station includes an attachment to which the air passage can be attached, and the second attaching detector is configured to detect that the air passage is attached to the attachment.

It may be further desired that a handle that is provided on the cleaner body and can move between a use position and a storage position, the plurality of attaching detectors include a third attaching detector configured to detect that the handle is in the storage position.

It may be further desired that a notification device configured to perform notification when at least one of the attaching detectors does not detect the attaching of the electric vacuum cleaner to the station within a predetermined time after at least one of other attaching detectors detects the attaching of the electric vacuum cleaner to the station.

It may be desired that the electric vacuum cleaner apparatus starts transfer of the dust after a predetermined delay time elapses from permission to transfer the dust.

DETAILED DESCRIPTION

Embodiments of an electric vacuum cleaner apparatus according to the present invention will be described by referring to FIG. 1 to FIG. 28. In each figure, the same reference signs are given to identical or equivalent components.

Figure 1:
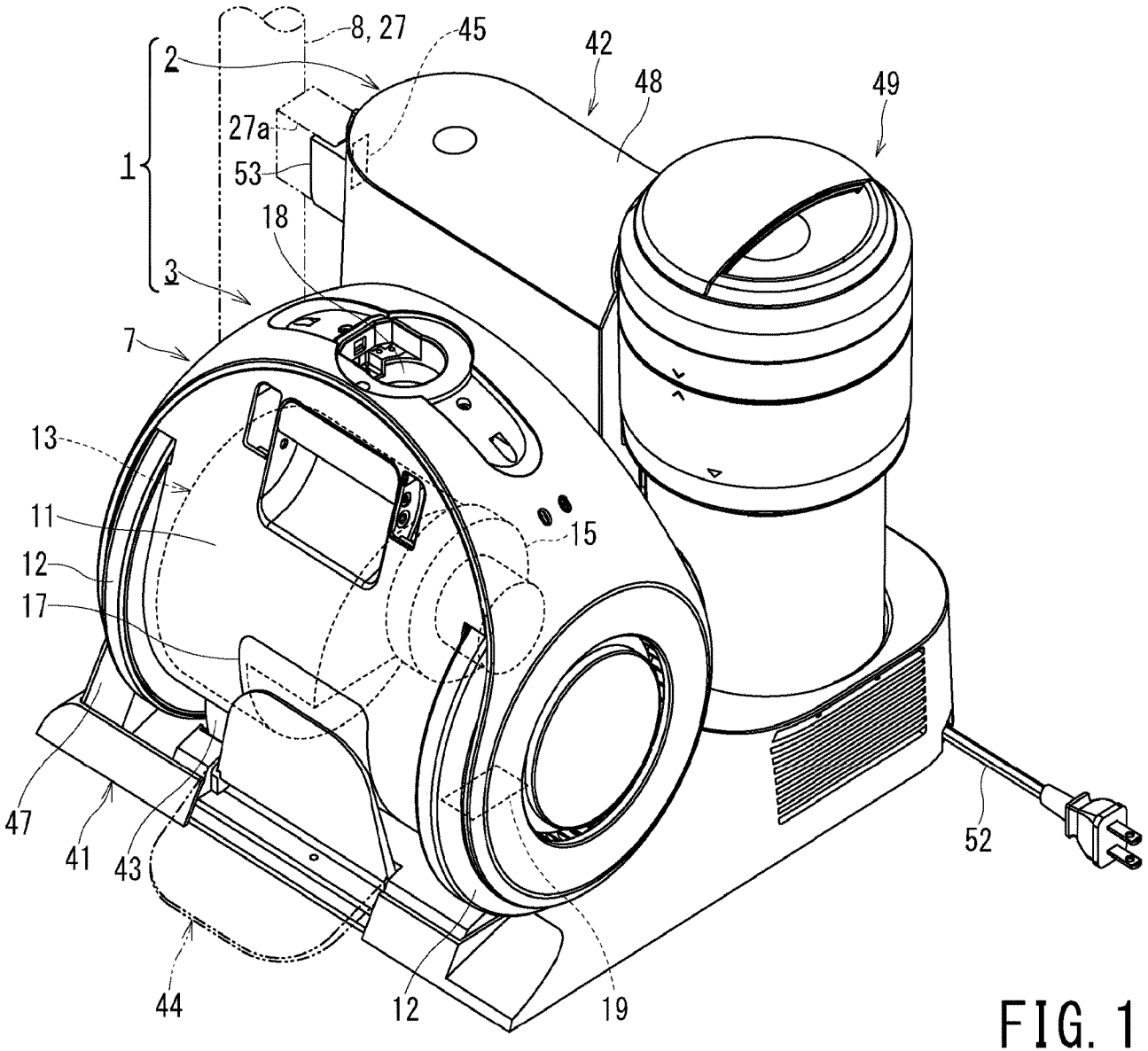
FIG. 1 is a perspective view illustrating an electric vacuum cleaner apparatus according to one embodiment of the present invention.
Figure 2:
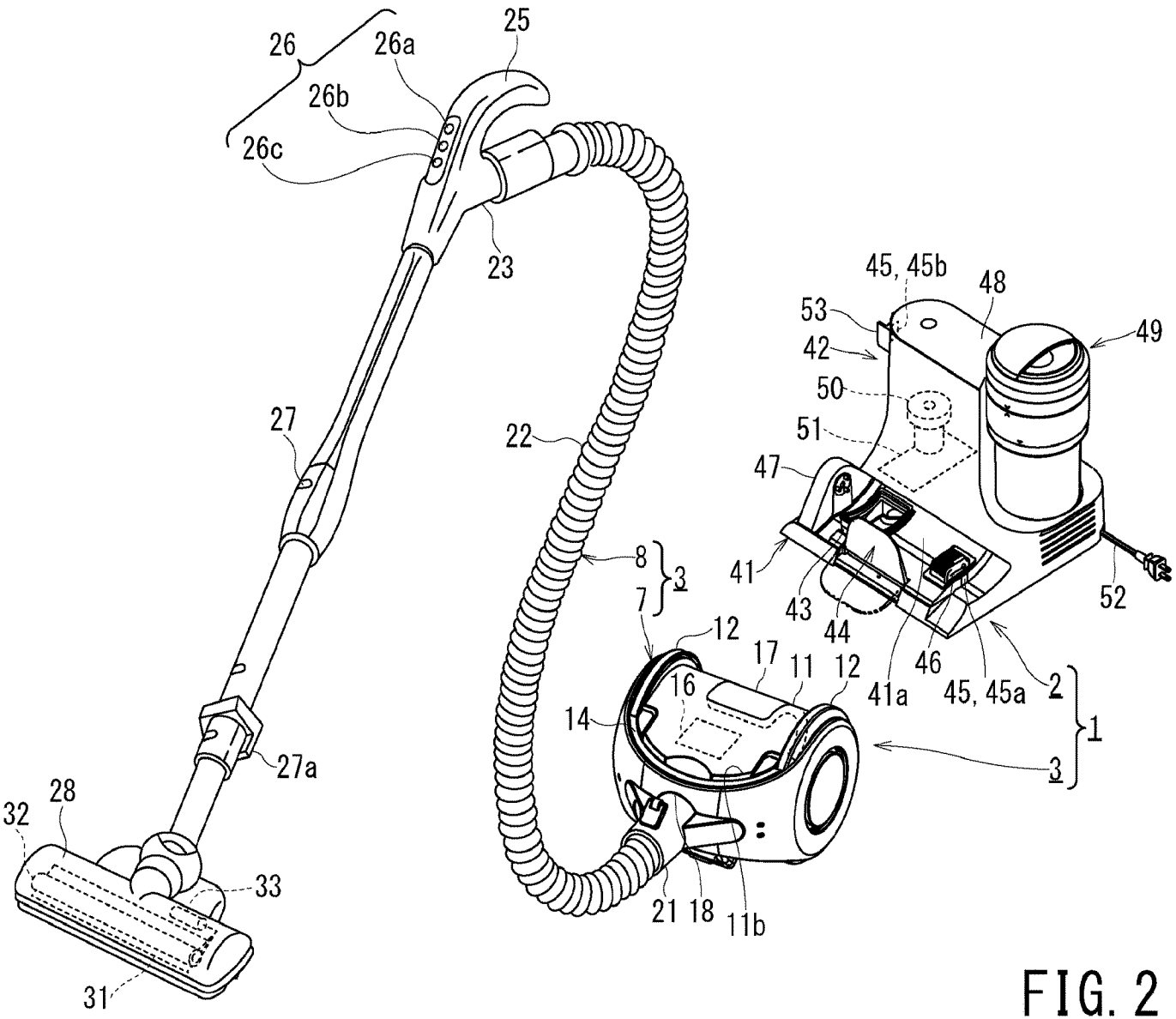
FIG. 2 is another perspective view illustrating the electric vacuum cleaner apparatus according to the embodiment of the present invention.

FIG. 1 and FIG. 2 are perspective views illustrating an electric vacuum cleaner apparatus according to one embodiment of the present invention.

As shown in FIG. 1 and FIG. 2, the electric vacuum cleaner apparatus 1 according to the present embodiment includes a stationary station 2 and an electric vacuum cleaner 3 that can be connected (coupled) to and disconnected (decoupled) from the station 2.

FIG. 1 shows a configuration in which the electric vacuum cleaner 3 is connected to the station 2. This configuration is called a storage configuration of the electric vacuum cleaner apparatus 1. FIG. 2 shows a configuration in which the electric vacuum cleaner 3 is disconnected from the station 2. FIG. 2 shows the configuration in which the electric vacuum cleaner 3 is used for cleaning.

The electric vacuum cleaner 3 is a so-called cordless type. Although the electric vacuum cleaner 3 is a so-called canister type, the electric vacuum cleaner 3 is not limited to this type but may be configured as an upright type, a stick type, or a handy type. The electric vacuum cleaner 3 being connectable to and disconnectable from the station 2 is attachable to the station 2 and can also be placed on the station 2. In terms of expression, storing the electric vacuum cleaner 3 in the station 2 includes: connecting the electric vacuum cleaner 3 to the station 2; attaching the electric vacuum cleaner 3 to the station 2; and placing the electric vacuum cleaner 3 on the station 2.

The station 2 has a function of charging the electric vacuum cleaner 3, a function of collecting the dust collected with the electric vacuum cleaner 3, and a function of accumulating the collected dust. The station 2 is placed at an arbitrary place in a room.

A user separates the cleaner body 7 (FIG. 1) of the electric vacuum cleaner 3 connected to station 2 from the station 2 (FIG. 2), and cleans the surface to be cleaned by running the electric vacuum cleaner 3 on the surface to be cleaned in the room or by moving with the electric vacuum cleaner 3 held in hand. Afterward, the user returns (connects) the cleaner body 7 to the station 2 and stores it (FIG. 1). When the cleaner body 7 is connected to the station 2, the station 2 charges the cleaner body 7 while collecting the dust accumulated by the electric vacuum cleaner 3 in a timely manner. That is, every time the cleaner body 7 is connected to the station 2 after using the electric vacuum cleaner 3 for cleaning, the electric vacuum cleaner apparatus 1 collects the dust collected with the electric vacuum cleaner 3 into the station 2 so as to empty the electric vacuum cleaner 3.

The frequency of collecting the dust from the electric vacuum cleaner 3 to the station 2 may not be each time the electric vacuum cleaner 3 connecting to the station 2. The dust-collection frequency may be every plural number of times the electric vacuum cleaner 3 connecting to the station 2. For example, the dust-collection frequency may be once a week on the premise that electric vacuum cleaner 3 is used once a day, i.e., the dust collection frequency may be every seven times of the use of the electric vacuum cleaner 3.

The electric vacuum cleaner 3 includes: the cleaner body 7 that can travel on the surface to be cleaned; and a tubular part 8 that is attachable to and detachable from the cleaner body 7. The tubular part 8 is fluidly connected to the cleaner body 7. The tubular part 8 is an air passage that is connected to the cleaner body 7 for sucking in dust.

The cleaner body 7 includes: a body housing 11; a pair of wheels 12 provided on the respective right and left sides of the body housing 11; a primary dust container 13 detachably attached to the body housing 11; a body handle 14; a primary electric blower 15 accommodated in the body housing 11; a cleaner controller 16 mainly for controlling the primary electric blower 15, and a rechargeable battery 17 for storing power to be supplied to the primary electric blower 15.

The cleaner body 7 drives the primary electric blower 15 by the power stored in the rechargeable battery 17. The cleaner body 7 applies negative pressure to be generated with the primary electric blower 15 to the tubular part 8. The electric vacuum cleaner 3 sucks in dust-containing air from the surface to be cleaned through the tubular part 8. The electric vacuum cleaner 3 separates dust from the inhaled dust-containing air. The electric vacuum cleaner 3 collects and accumulates the dust after separation, and exhausts the clean air from which the dust has been removed.

In the front of the body housing 11, a connection port 18 as a suction port of the cleaner body 7 is provided. The connection port 18 is a coupling joint to which the tubular part 8 can be attached, and from which the tubular part 8 can be detached. The connection port 18 fluidly connects the tubular part 8 to the primary dust container 13. The connection port 18 opens toward the front of the body housing 11.

The cleaner body 7 according to the present embodiment is used in a position in which the front of the body housing 11 is directed in the traveling direction, i.e., in a position in which the connection port 18 is directed in the traveling direction. This position is called a use position of the cleaner body 7. The vacuum cleaner main body 7 in the use position may be lifted around the wheel 12 by being pulled with the tubular part 8 held by the user's hand.

The cleaner body 7 according to the present embodiment is placed on (connected to) the station 2 in a position in which the front of the body housing 11 is directed upward, i.e., in a position in which the connection port 18 is directed upward. The position in which the connection port 18 is directed upward is referred to as a storage position of the cleaner body 7. The cleaner body 7 in the storage position is putted down to be placed on the station 2. The state of the cleaner body 7 placed on the station 2 is called a storage state of the cleaner body 7.

The wheels 12 support the cleaner body 7 such that the cleaner body 7 can travel.

The primary dust container 13 accumulates the dust to be sucked into the electric vacuum cleaner 3. The primary dust container 13 separates, collects, and accumulates the dust from the dust-containing air flowing into the cleaner body 7 while sending the clean air having been subjected to dust-removal to the primary electric blower 15.

The body handle 14 is used when a user carries the cleaner body 7. The body handle 14 is arched in the width direction of the body housing 11.

The primary electric blower 15 sucks in air from the primary dust container 13 so as to generate negative pressure (i.e., suction vacuum pressure).

The cleaner controller 16 includes a microprocessor (not shown) and a storage device (not shown) for storing, for example, parameters and various operation programs executed with the microprocessor. The storage device stores various settings (arguments) related to a plurality of preset operation modes. The operation modes are related to the output of the primary electric blower 15. Different input values (i.e., input values of the primary electric blower 15 and current values flowing to the primary electric blower 15) are set for each operation mode. Each operation mode is associated with an input received by the tubular part 8. The cleaner controller 16 alternatively selects an arbitrary operation mode corresponding to the input received by the tubular part 8 from the preset operation modes, and reads out the selected operation mode from the storage device so as to drive the primary electric blower 15 on the basis of the settings of the operation mode having been read out.

The rechargeable battery 17 supplies power to the primary electric blower 15 and the cleaner controller 16. The rechargeable battery 17 is electrically connected to a pair of charging electrodes 19 provided on the cleaner body 17.

The tubular part 8 sucks in dust-containing air from the surface to be cleaned by the negative pressure that acts from the cleaner body 7, and leads the dust-containing air to the cleaner body 7. The tubular part 8 is provided with: a connecting tube 21 detachably connected as a joint to the cleaner body 7; a dust collecting hose 22 fluidly connected to the connecting tube 21; a hand operation tube 23 fluidly connected to the dust collecting hose 22; a grip 25 protruding from the hand operation tube 23; an input unit 26 provided on the grip 25; an extension tube 27 detachably connected to the hand operation tube 23; and a cleaning head 28 detachably connected to the extension tube 27.

The connecting tube 21 is fluidly connected to the primary dust container 13 through the connection port 18.

The dust collecting hose 22 is a long, flexible, and substantially cylindrical hose. One end (i.e., the rear end in this case) of the dust collecting hose 22 is fluidly connected to the connecting tube 21. The dust collecting hose 22 is fluidly connected to the primary dust container 13 through the connecting tube 21.

The hand operation tube 23 relays the dust collecting hose 22 and the extension tube 27. One end (i.e., the rear end in this case) of the hand operation tube 23 is fluidly connected to the other end (i.e., the front end in this case) of the dust collecting hose 22. The hand operation tube 23 is fluidly connected to the primary dust container 13 through the dust collecting hose 22 and the connecting tube 21. In other words, the connecting tube 21 is a joint that connects the dust collection hose 22 to the cleaner body 7.

The grip 25 is a portion to be gripped by a user's hand for operating the electric vacuum cleaner 3. The grip 25 protrudes from the hand operation tube 23 in an appropriate shape that can be readily grasped by the user's hand.

The input unit 26 includes switches corresponding to the respective operation modes. For example, the input unit 26 includes: a stop switch **26*a* corresponding to the operation of stopping the primary electric blower 15; a start switch 26*b*** corresponding to the operation of starting the primary electric blower 15; and a brush switch 26*c* corresponding to power supply to the cleaning head 28. The stop switch 26*a* and the start switch 26*b* are electrically connected to the cleaner controller 16. A user of the electric vacuum cleaner 3 can operate the input unit 26 to alternatively select one of the operation modes of the primary electric blower 15. The start switch 26*b* also functions as a selecting switch of the operation modes during operation of the primary electric blower 15. Each time the cleaner controller 16 receives an operation signal from the start switch 26*b*, the cleaner controller 16 switches the operation mode in order of strong→medium→weak→strong→medium→weak→ . . . . Instead of the start switch 26*b*, the input unit 26 may be individually provided with a strong-mode operation switch (not shown), a medium-mode operation switch (not shown), and a weak-mode operation switch (not shown).

The extension tube 27 has a telescopic structure in which a plurality of tubular bodies are overlaid, and can be expanded and contracted. A joint structure is provided at one end (i.e., the rear end in this case) of the extension tube 27, and this joint structure is attachable to and detachable from the other end (i.e., the front end in this case) of the hand operation tube 23. The extension tube 27 is fluidly connected to the primary dust container 13 through the hand operation tube 23, the dust collecting hose 22, and the connecting tube 21.

The extension tube 27 is provided with a holding projection 27*a*. The holding projection 27*a* is used for storing the tubular part 8. The holding projection 27*a* may be provided on the cleaning head 28.

The cleaning head 28 can run or slide on the surface to be cleaned such as a wooden floor and a carpet, and includes a suction port 31 on its bottom face opposed to the surface to be cleaned in a running state or a sliding state. In addition, the cleaning head 28 includes a rotatable brush 32 disposed at the suction port 31 and an electric motor 33 for driving the rotatable brush 32. A joint structure is provided on one end (i.e., the rear end in this case) of the cleaning head 28, and this joint structure is attachable to and detachable from the other end (i.e., the front end in this case) of the extension tube 27. The cleaning head 28 is fluidly connected to the primary dust container 13 through the extension tube 27, the hand operation tube 23, the dust collecting hose 22, and the connecting tube 21. That is, the cleaning head 28, the extension tube 27, the hand operation tube 23, the dust collecting hose 22, the connecting tube 21, and the primary dust container 13 is a suction-air passage from the suction port 31 to the primary electric blower 15. Each time the electric motor 33 receives the operation signal from the brush switch 26*c*, the electric motor 33 alternately repeats the operation start and the operation stop.

When the start switch 26*b* is operated, the electric vacuum cleaner 3 starts up the primary electric blower 15. For example, when the start switch 26*b* is operated when the primary electric blower 15 is stopped, first, the electric vacuum cleaner 3 starts the primary electric blower 15 in the strong operation mode. When the start switch 26*b* is operated again in the strong operation mode, the electric vacuum cleaner 3 switches the operation mode of the primary electric blower 15 to the medium operation mode. When the start switch 26*b* is operated three times, the electric vacuum cleaner 3 switches the operation mode of the primary electric blower 15 to the weak operation mode. In this manner, every time the start switch 26*b* is operated, the above-described mode switching is repeated. The strong operation mode, the medium operation mode, and the weak operation mode are predetermined operation modes. The input value to the primary electric blower 15 is the largest in the strong operation mode, and is the smallest in the weak operation mode. The primary electric blower 15 having started up sucks in air from the primary dust container 13 so as to bring the inside of the primary dust container 13 into a negative pressure state.

The negative pressure inside the primary dust container 13 sequentially acts through the connection port 18, the connecting tube 21, the dust collecting hose 22, the hand operation tube 23, the extension tube 27, and the cleaning head 28 so as to act on the suction port 31. The electric vacuum cleaner 3 sucks in the dust on the surface to be cleaned together with the air by the negative pressure acting on the suction port 31. The primary dust container 13 separates, collects, and accumulates dust from the dust-containing air having been sucked in, and sends the air having been separated from the dust-containing air to the primary electric blower 15. The primary electric blower 15 discharges the air sucked from the primary dust container 13 to the outside of the cleaner body 7.

The station 2 is installed at an arbitrary place on the surface to be cleaned. The station 2 includes a platform 41 connectable to the cleaner body 7, and a dust collection part 42 integrally provided with the platform 41. In addition, the station 2 includes: a dust transfer tube 43 to be connected to the primary dust container 13 of the electric vacuum cleaner 3 in the storage configuration of the electric vacuum cleaner apparatus 1; and a speed reducer 44. This speed reducer 44 moves so that the cleaner body 7 can move forward when the cleaner body 7 in the storage position is laid down to the use position. The station 2 further includes a plurality of attaching detectors 45 configured to detect that the electric vacuum cleaner 3 is attached to the station 2.

The platform 41 is a place where the cleaner body 7 of the electric vacuum cleaner 3 is connected and disconnected, a place where the cleaner body 7 is attached, and also a place where the cleaner body 7 is placed on. The platform 41 has substantially the same width dimension as that of the dust collection part 42, and protrudes to the front of the dust collection part 42 so as to spread in a rectangular shape. The platform 41 has a shape and size that can accommodate the cleaner body 7 of the electric vacuum cleaner 3 in a plan view. The platform 41 has a placing face 41*a* that is brought into contact with the back face of the body housing 11 (i.e., the back face of the cleaner body 7 in the storage position with its front directed upward) so as to support the cleaner body 7. It is preferred that the shape of the placing face 41*a* conforms to the shape of the back face of the body housing 11.

The platform 41 has charging terminals 46 connectable to the cleaner body 7. When the electric vacuum cleaner 3 is connected to the station 2, the charging terminals 46 contact the corresponding charging electrodes 19 of the cleaner body 17 and is electrically connected to the charging electrodes 19.

The platform 41 has a bulge 47 that is disposed to be close to and along the side face of the cleaner body 7 in the storage configuration of the electric vacuum cleaner apparatus 1.

The dust collection part 42 is disposed behind the platform 41. The dust collection part 42 is a box formed in an appropriate shape such that the dust collection part 42 can be placed on the surface to be cleaned integrally with the platform 41. The dust collection part 42 extends upward above the platform 41. In other words, the dust collection part 42 is a protrusion that is provided side-by-side with the platform 41 as a storage place for the electric vacuum cleaner 3, and extends upward from the storage place. The dust collection part 42 has an appropriate shape that does not interfere with the cleaner body 7 connected to the platform 41.

The dust collection part 42 includes: a housing 48; a secondary dust container 49 for collecting the dust to be discharged from the primary dust container 13 through the dust transfer tube 43, and accumulates the collected dust; a secondary electric blower 50 accommodated in the dust collection part 42, and fluidly connected to the secondary dust container 49; a station controller 51 mainly for controlling the secondary electric blower 50; and a power cord 52 for leading power from a commercial AC power supply to the dust collection part 42.

In addition, the dust collection part 42 is provided with a hose attachment 53 to which the tubular part 8 of the electric vacuum cleaner 3 can be attached.

The top plate of the housing 48 and the platform 41 is an integral molding of resin.

The secondary dust container 49 accumulates the dust to be discharged from the electric vacuum cleaner 3. The secondary dust container 49 is fluidly connected to the dust transfer tube 43. The secondary dust container 49 separates, collects, and accumulates the dust from the dust-containing air flowing from dust transfer tube 43, and sends the clean air from which the dust has been removed to the secondary electric blower 50. The secondary dust container 49 is detachably mounted on the left side (i.e., right side as viewed from the front) of the dust collection part 42 and exposed to the appearance of the station 2.

The secondary electric blower 49 sucks in air from the secondary dust container 49 so as to generate negative pressure (i.e., suction vacuum pressure), and transfers the dust from the primary dust container 13 to the secondary dust container 49. In other words, the secondary electric blower 50 applies negative pressure to the primary dust container 13 through the secondary dust container 49, and transfers the dust from the primary dust container 13 to the secondary dust container 49. The secondary electric blower 50 is accommodated in the right side (i.e., left part as viewed from the front) of the dust collection part 42.

The station controller 51 includes a microprocessor (not shown), and a storage device (not shown) for storing, for example, parameters and various operation programs to be executed with the microprocessor. The station controller 51 executes drivability control of the secondary electric blower 50, and charge control of the rechargeable battery 17 of the electric vacuum cleaner 3.

The dust transfer tube 43 is connected to the primary dust container 13 in the storage configuration of the electric vacuum cleaner apparatus 1. The dust transfer tube 43 is an air passage for transferring the dust collected with the electric vacuum cleaner 3 to the secondary dust container 49. When the electric vacuum cleaner 3 is connected to the station 2, the dust transfer tube 43 is connected to the primary dust container 13, and fluidly connects the primary dust container 13 to the secondary dust container 49.

The dust transfer tube 43 is connected to the suction side of the secondary dust container 49. The negative pressure to be generated with the secondary electric blower 50 acts on the dust transfer tube 43 through the secondary dust container 49.

The dust transfer tube 43 includes an inlet connected to the primary dust container 13 of the electric vacuum cleaner 3 and an outlet connected to the secondary dust container 49. The dust transfer tube 43 extends rearward from the inlet disposed at the platform 41 so as to reach the inside of the dust collection part 42, and bends and extends upward inside the dust collection part 42 so as to reach the outlet disposed at the side of the secondary dust container 49.

The charging terminals 46 and the inlet of the dust transfer tube 43 are provided on the platform 41 side by side.

The hose attachment 53 is provided on the right lateral face (the left lateral face as viewed from the front) of the dust collection part 42. The hose attachment 53 has a shape that conforms to the holding projection 27*a* of the extension tube 27 and can be hooked or fitted so as to be connected to the holding projection 27*a*. The hose attachment 53 holds the extension tube 27 in an upright state via the holding projection 27*a*. The tubular part 8 is stored when the holding projection 27*a* is connected to the hose attachment 53.

The hose attachment 53 may be provided in the cleaner body 7 of the electric vacuum cleaner 3. In this case, the cleaner body 7 holds the extension tube 27 upright via the holding projection 27*a*. The tubular part 8 is stored when the holding projection 27*a* is connected to the hose attachment 53.

The plurality of attaching detectors 45 include, for example, a first attaching detector 45*a* provided on the platform 41, and a second attaching detector 45*b* provided on the hose attachment 53. The first attaching detector 45*a* detects that the cleaner body 7 is connected to (i.e., attached to) the station 2 or the cleaner body 7 is placed on the platform 41. The second attaching detector 45*b* detects that the tubular part 8 of the electric vacuum cleaner 3 is attached to the station 2. When the hose attachment 53 is provided on the cleaner body 7, the second attaching detector 45*b* detects that the tubular part 8 of the electric vacuum cleaner 3 is attached to the cleaner body 7. Each of the attaching detectors 45 is a so-called micro switch. That is, when the cleaner body 7 is connected to the station 2, the first attaching detector 45*a* is pushed into the cleaner body 7 to detect this. When the tubular part 8 of the electric vacuum cleaner 3 is attached to the station 2 or the cleaner body 7, the second attaching detector 45*b* is pushed into the tubular part 8 so as to detect this.

When the electric vacuum cleaner 3 is connected to (i.e., attached to or placed on) the station 2, the charging electrodes 19 of the electric vacuum cleaner 3 are electrically connected to the charging terminals 46 of the station 2, and the dust transfer tube 43 of the station 2 is connected to the primary dust container 13. And then, the station 2 starts charging the rechargeable battery 17 of the electric vacuum cleaner 3. Additionally, the station 2 starts the secondary electric blower 50 in a timely manner. The secondary electric blower 50 having been started up sucks in air from the secondary dust container 49, and brings the inside of the secondary dust container 49 into a negative pressure state.

The negative pressure in the secondary dust container 49 acts on the primary dust container 13 through the dust transfer tube 43. The station 2 sucks in the dust accumulated in the primary dust container 13 together with air by using the negative pressure acting on the primary dust container 13. The secondary dust container 49 separates, collects, and accumulates the dust from the sucked air, and sends the dust-separated air to the secondary electric blower 50. The secondary electric blower 50 discharges the clean air sucked from the secondary dust container 49 to the outside of the station 2.

The electric vacuum cleaner apparatus 1 may be configured such that it connects the primary electric blower 15 of the electric vacuum cleaner 3 to the secondary dust container 49 of the station 2 by mechanically switching the air passage connecting the primary electric blower 15 to the primary dust container 13 of the electric vacuum cleaner 3, and transfers the dust from the primary dust container 13 of the electric vacuum cleaner 3 to the secondary dust container 49 of the station 2 by operating the primary electric blower 15. In this case, the timing of switching the air passage connecting the primary electric blower 15 and the primary dust container 13 of the electric vacuum cleaner 3 to the air passage connecting the secondary dust container 49 of the station 2 to the primary electric blower 15 of the electric vacuum cleaner 3 is preferred to be immediately prior to operation of the primary electric blower 15 for transferring dust. Preferably, the timing of switching the air passage connecting the secondary dust container 49 of the station 2 to the primary electric blower 15 of the electric vacuum cleaner 3 to the air passage connecting the primary electric blower 15 and the primary dust container 13 of the electric vacuum cleaner 3 is immediately after the operation of the primary electric blower 15 for transferring dust.

Next, the cleaner body 7 of the electric vacuum cleaner 3 according to the present embodiment will be described in detail.

Figure 3:
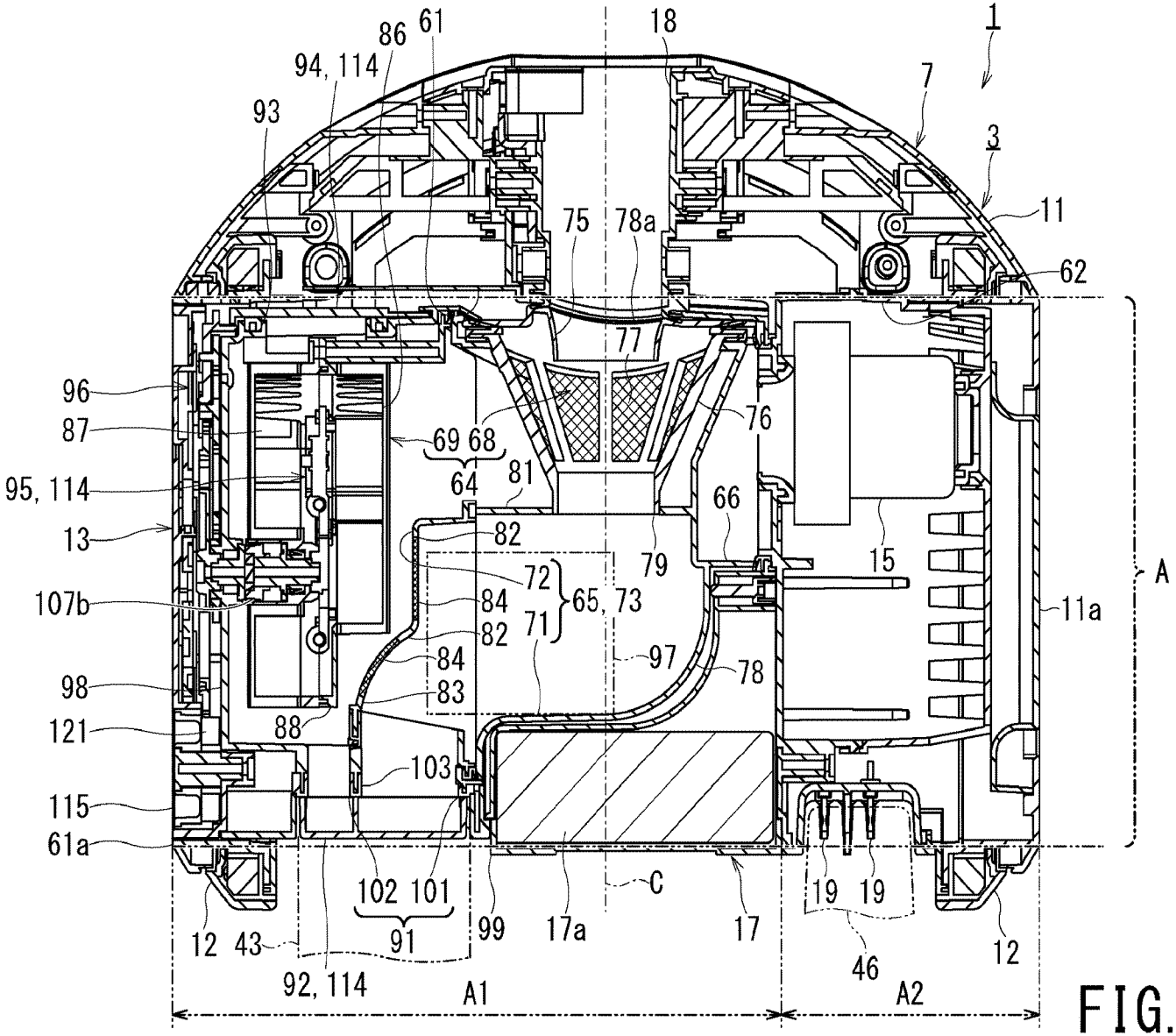
FIG. 3 is a cross-sectional plan view of a cleaner body of the electric vacuum cleaner apparatus according to the embodiment of the present invention.

FIG. 3 is a cross-sectional plan view of the cleaner body of the electric vacuum cleaner apparatus according to the embodiment of the present invention.

Figure 4:
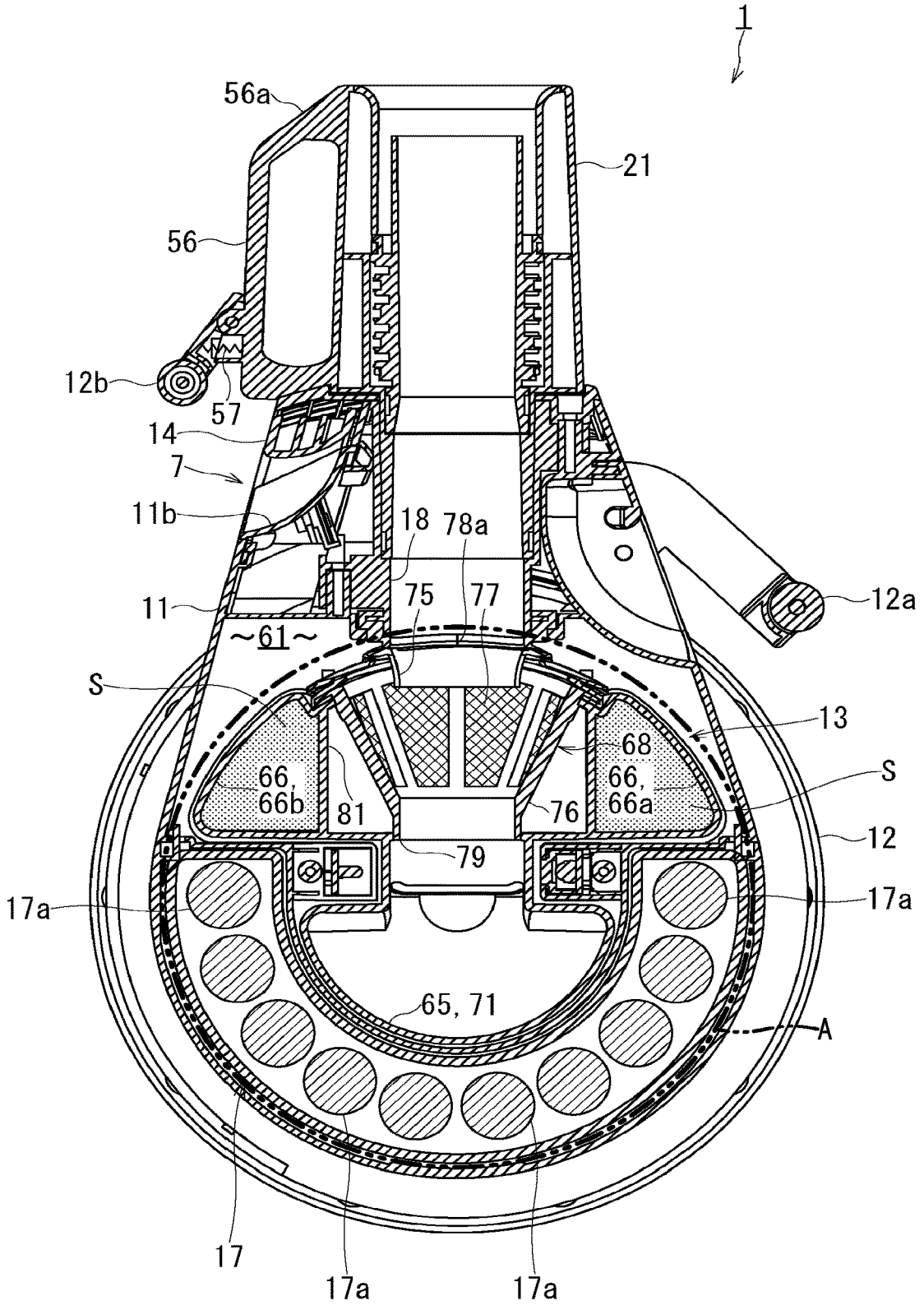
FIG. 4 is a longitudinal cross-sectional view of the cleaner body of the electric vacuum cleaner apparatus according to the embodiment of the present invention.

FIG. 4 is a longitudinal cross-sectional view of the cleaner body of the electric vacuum cleaner apparatus according to the embodiment of the present invention.

The plane cross-section of the cleaner body 7 shown in FIG. 3 corresponds to a cross-section of a plane that is substantially parallel to the front of the electric vacuum cleaner apparatus 1 in the storage configuration. FIG. 3 shows the state in which the connecting tube 21 of the tubular part 8 is detached from the cleaner body 7. FIG. 4 shows the state in which the connecting tube 21 is attached to the cleaner body 7.

As shown in FIG. 3 and FIG. 4, the cleaner body 7 of the electric vacuum cleaner apparatus 1 according to the embodiment of the present invention includes the body housing 11 composed of a cylindrical rear half laid in the width direction of the body housing 11, and a front half that bulges forward in an arc from the cylindrical rear half in a plan view of the cleaner body 7. The back face of the body housing 11 has an arc shape in a side view of the cleaner body V.

The connection port 18 extends along a line (hereinafter referred to as the centerline C) that passes through the substantial center in the width direction of the body housing 11 and the substantial center in the height direction of the body housing 11, and the connection port 18 reaches the primary dust container 13. FIG. 3 and FIG. 4 are cross-sectional views passing through the centerline C.

The connecting tube 21 to be connected to the connection port 18 is provided with a handle 56. The handle 56 is disposed above the center of gravity of the cleaner body 7 in the storage position of the electric vacuum cleaner (FIG. 1). The handle 56 has an inclined portion 56*a* on the front side in the traveling direction of the electric vacuum cleaner 3. The forward in the traveling direction of the electric vacuum cleaner 3 corresponds to the upper side of the cleaner body 7 in the storage position, and also corresponds to the front side of the cleaner body 7 in the use position. The handle 56 is disposed on the opposite side (back side) of the cleaner body 7 as viewed from the side of the body handle 14. In other words, the body handle 14 is disposed on the opposite side (obverse side) of the cleaner body 7 as viewed from the side of the handle 56.

The respective wheels 12 are disposed at the right and left ends of the cylindrical rear half of the body housing 11. In addition, the respective wheels 12 are concentrically arranged in the cylindrical rear half of the body housing 11. The diameter of each wheel 12 is larger than the vertical dimension of the body housing 11, i.e., larger than the height (corresponding to the diameter of the cylindrical rear half) of the body housing 11. In a side view of the cleaner body 7, i.e., when viewed in the rotation centerline direction of the wheels 12, the wheels 12 hide the back face of the body housing 11. Thus, even when the upper and lower sides (obverse and reverse) of the body housing 11 are inverted, the cleaner body 7 can cause the wheels 12 to be grounded onto the surface to be cleaned and can maintain this state. Similarly, even in the process of inverting the upper and lower sides of the body housing 11, the cleaner body 7 can cause the wheels 12 to be grounded onto the surface to be cleaned and can maintain this state. The body housing 11 can invert the upper and lower sides (i.e., obverse and reverse) of the body housing 11 around the rotation centerline of the wheels 12 without causing the back face to interfere with the surface to be cleaned. The cleaner body 7 is provided with an auxiliary wheel 12*a* for supporting the cleaner body 7 when the obverse of which faces upward, together with the wheels 12. The connecting tube 21 is provided with an auxiliary wheel 12*b* for supporting the cleaner body 7 when the reverse of which faces upward, together with the wheels 12.

The auxiliary wheel 12*b* is provided on the handle 56. Between the auxiliary wheel 12*b* and the handle 56, a suspension mechanism 57 for absorbing shock is provided.

The distinction between the upper and lower sides (i.e., obverse and reverse) of the cleaner body 7 is for the convenience of description. The electric vacuum cleaner 3 can be used for cleaning in the same manner regardless of whether the obverse is directed upward or the reverse is directed upward. Since the cleaner body 7 can invert the upper and lower sides (i.e., obverse and reverse) of the body housing 11 around the rotation centerline of the wheels 12, it is difficult for the cleaner body 7 to be substantially self-supporting in the storage position with its front directed upward.

Hereinafter, the use position that the side provided with the handle 56 is directed toward the surface to be cleaned is defined as a first use position. The use position that the other side, as viewed from the handle 56, is directed toward the surface to be cleaned (i.e., the use position that the body handle 14 is directed toward the surface to be cleaned) is defined as a second use position. The pair of wheels 12 support the cleaner body 7 on the surface to be cleaned regardless of whether the cleaner body 7 is in the first use position or in the second use position. In other words, in whichever direction around the rotation centerline of the wheels 12 the cleaner body 7 is laid down, the pair of wheels 12 support the cleaner body 7 such that the cleaner body 7 can travel.

The rechargeable battery 17 is disposed on the opposite of the connection port 18 with the rotation centerline of the wheels 12 interposed between the rechargeable battery 17 and the connection port 18, i.e., the rechargeable battery 17 is disposed at the central portion of the rear end of the body housing 11. The rechargeable battery 17 is accommodated in the cylindrical rear half of the body housing 11. The rechargeable battery 17 includes cylindrical unit cells 17*a* that are arranged along the inner face of the cylindrical rear half.

The rechargeable battery 17 has an arc shape substantially centered on the rotation centerline of the pair of wheels 12. The center of the arc shape of the rechargeable battery 17 is located at the central portion in the direction orthogonal to the centerline C of the body housing 11 in a plane orthogonal to the rotation centerline of the pair of wheels 12 (i.e., located at the central portion of the dimension in the height direction of body housing 11), specifically, the center of the arc shape of the rechargeable battery 17 is located at the substantially half position of it.

The centerline of the cylindrical rear half of the body housing 11 and the rotation centerline of the wheels 12 are substantially on the same line. The inside of the cylindrical rear half of the body housing 11 centered on this line is defined as a region A. The wheels 12 are disposed so as to avoid the region A. That is, each wheel 12 has an annular shape that has an inner diameter larger than that of the region A. Further, the pair of wheels 12 are disposed such that the region A is interposed between both wheels 12.

The primary dust container 13 and the primary electric blower 15 are disposed in the region A and arranged in the width direction of the body housing 11. The primary dust container 13 is disposed in a region A1 that reaches one of the wheels 12 (for example, the right wheel 12 when the cleaner body 7 is connected to the station 2) from the central portion of the region A. The primary electric blower 15 is disposed in a region A2 that is biased to the other wheel 12 (for example, the left wheel 12 when the cleaner body 7 is connected to the station 2) in the region A.

The rechargeable battery 17 is also disposed in the region A.

The body housing 11 includes: a dust container chamber 61 for detachably accommodating the primary dust container 13; and an electric blower chamber 62 for accommodating the primary electric blower 15. The dust container chamber 61 occupies the region A1. The electric blower chamber 62 occupies the region A2.

The primary electric blower 15 is accommodated in the electric blower chamber 62. The suction port of the primary electric blower 15 is directed to the dust container chamber 61.

The dust container chamber 61 partitions a cylindrical dust-container disposition space that conforms to the shape of the primary dust container 13. That is, the wall surface of the body housing 11 partitioning the dust container chamber 61 is a wall surface surrounding the dust-container disposition space. The dust container chamber 61 is open toward the side of the body housing 11. In other words, the dust container chamber 61 is provided with a dust-container insertion and extraction port 61*a* disposed on the lateral face of the body housing 11. The opening diameter of the dust-container insertion and extraction port 61*a* is smaller than the inner diameter of each annular wheel 12. The dust-container insertion and extraction port 61*a* is disposed inside the annular wheels 12 in a side view of the cleaner body 7.

The dust container chamber 61 may have an appropriate opening for exposing the primary dust container 13. The dust container chamber 61 is not limited to the one that accommodates the entire primary dust container 13 but may be configured to accommodate part of the primary dust container 13. That is, the dust-container disposition space may communicate with the outside of the body housing 11 through an opening other than the dust-container insertion and extraction port 61*a*. It is not necessarily required that the dust-container insertion and extraction port 61*a* is connected to the end face of the primary dust container 13.

The primary dust container 13 has a cylindrical appearance with an outer diameter smaller than the inner diameter of each wheel 12. The primary dust container 13 can be accommodated in the dust container chamber 61 and can be inserted into and extracted from the dust container chamber 61. The primary dust container 13 is inserted into and extracted from the dust container chamber 61 through the dust-container insertion and extraction port 61*a*. That is, the primary dust container 13 is inserted and extracted in the width direction of the cleaner body V. As a result, the primary dust container 13 is attached to and detached from the cleaner body 7.

The handle 56 extends in the front-rear direction of the cleaner body 7 and has a thickness and length whereby a user can grip the handle 56. The handle 56 extends substantially parallel to the centerline of the connection port 18 or the centerline C of the cleaner body 7.

Next, the primary dust container 13 will be described.

Figure 5:
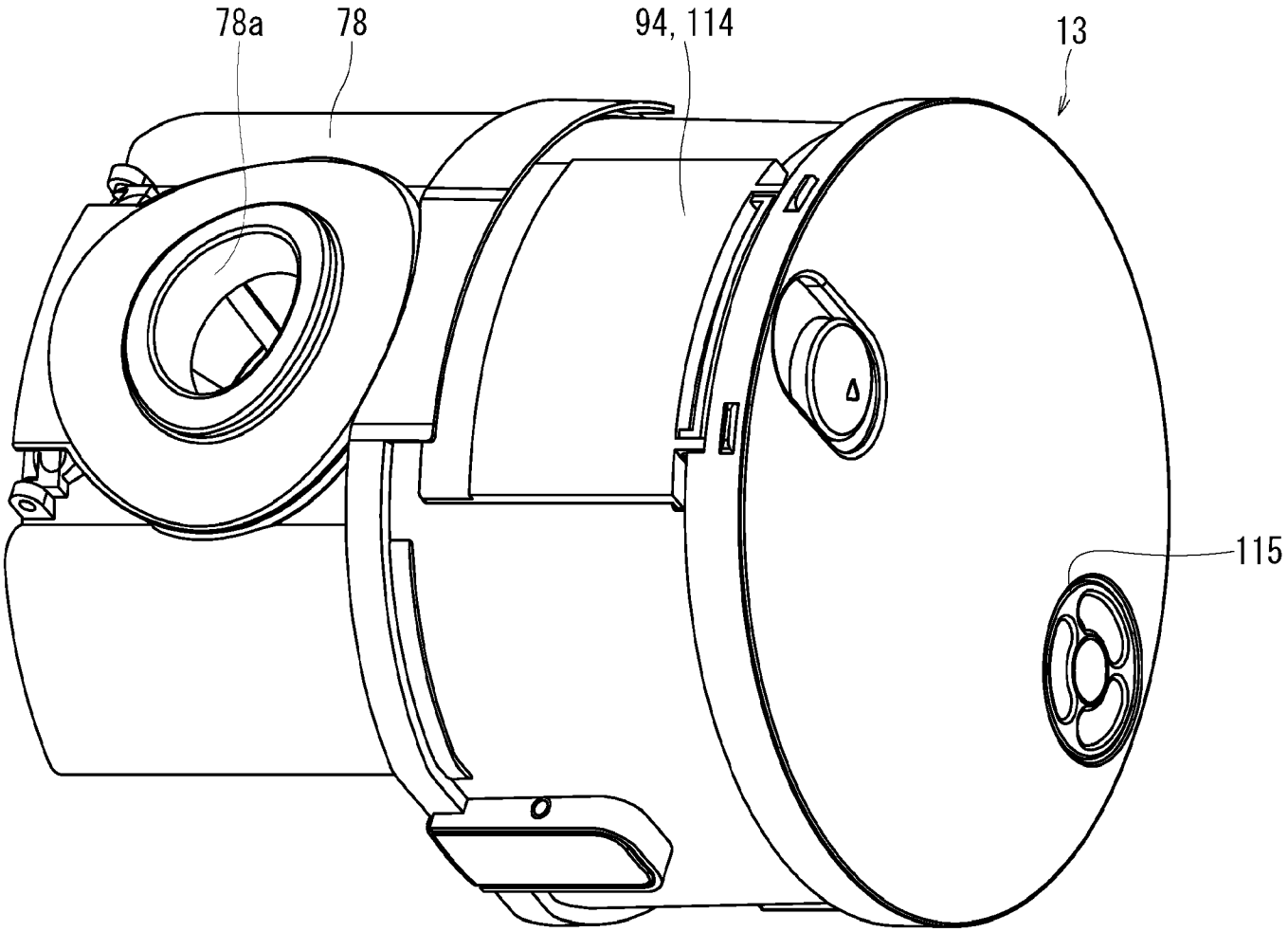
FIG. 5 is a perspective view of a primary dust container of the electric vacuum cleaner according to the embodiment of the present invention.

FIG. 5 is a perspective view of the primary dust container of the electric vacuum cleaner according to the embodiment of the present invention.

Figure 6:
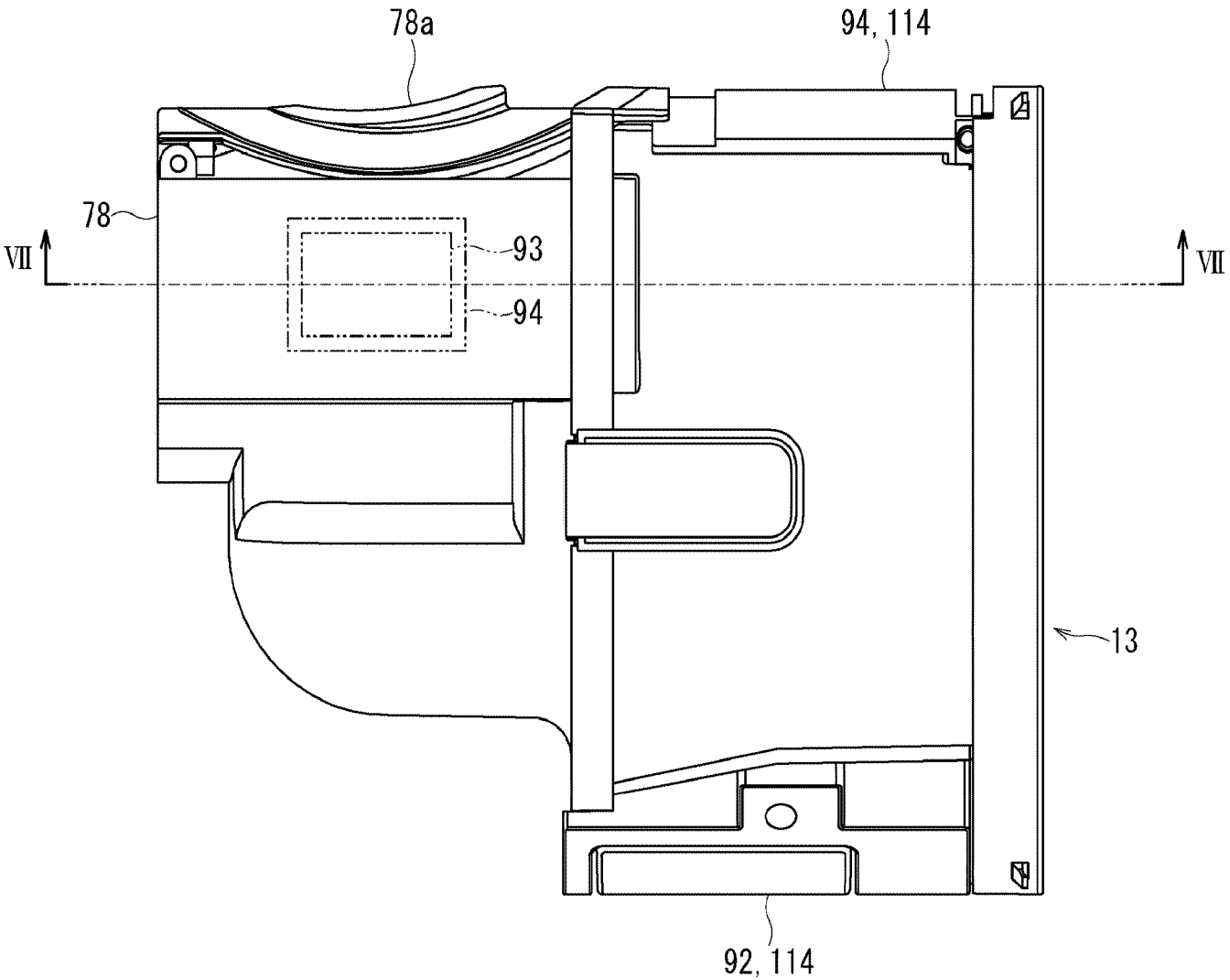
FIG. 6 is a side view of the primary dust container of the electric vacuum cleaner according to the embodiment of the present invention.

FIG. 6 is a side view of the primary dust container of the electric vacuum cleaner according to the embodiment of the present invention.

Figure 7:
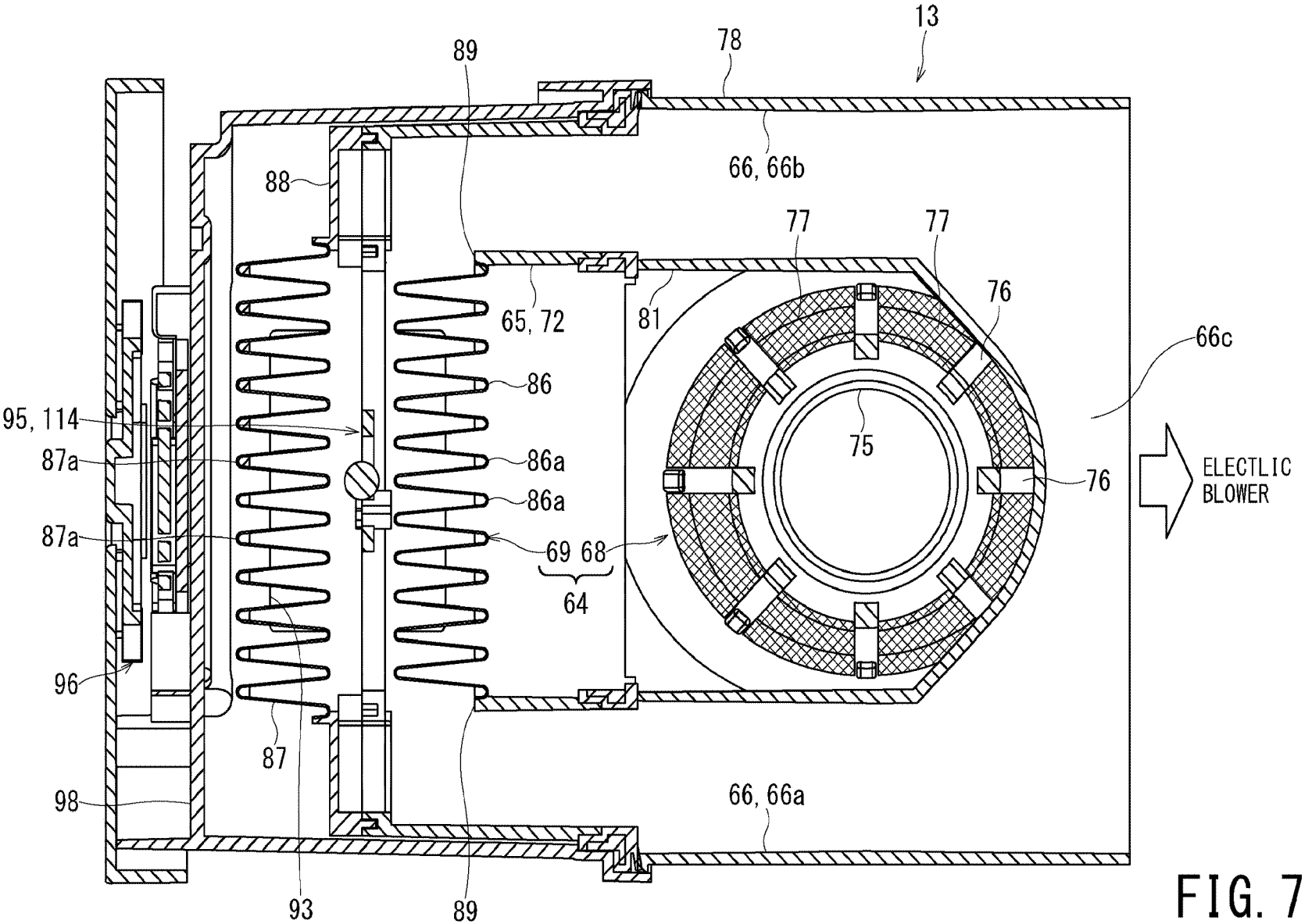
FIG. 7 is a cross-sectional view of the primary dust container of the electric vacuum cleaner according to the embodiment of the present invention.

FIG. 7 is a cross-sectional view of the primary dust container of the electric vacuum cleaner according to the embodiment of the present invention, taken along the line VII-VII of FIG. 6.

As shown in FIG. 5 to FIG. 7 in addition to FIG. 3 and FIG. 4, the primary dust container 13 of the electric vacuum cleaner 3 according to the present embodiment accumulates the dust to be sucked into the electric vacuum cleaner 3. The primary dust container 13 includes: a separation part 64 that separates the dust from dust-containing air to be sucked in by the negative pressure generated with the primary electric blower 15; a dust collection part 65 that accumulates the dust separated with the separation part 64; and at least one communication passage 66 that leads the air flowing out of the dust collection part 65 to the primary electric blower 15.

The separation part 64 is connected to the connection port 18. The separation part 64 includes: a first separator 68 that separates relatively heavy dust from the dust-containing air by making the dust-containing air flow straight and using the difference between inertial force acting on the dust and inertial force acting on the air; and at least one filter 69 as a second separator that separates dust from the air, which contains relatively light dust after passing through the first separator 68.

The dust collection part 65 is provided side by side with the separation part 64 and the at least one communication passage 66. The dust collection part 65 includes a coarse-dust collecting chamber 71 for accumulating relatively heavy dust from the dust separated with the separation part 64, and a filter chamber 72 for accommodating the at least one filter 69.

The relatively heavy dust to be separated with the first separator 68 is called coarse dust. That is, the first separator 68 separates coarse dust from dust-containing air to be sucked into the electric vacuum cleaner 3. The coarse-dust collecting chamber 71 is the first dust collection chamber for accumulating coarse dust separated with the first separator 68. The relatively light dust to be separated with the at least one filter 69 is called fine dust. That is, the at least one filter 69 separates fine dust from the air that passes through the first separator 68. The filter chamber 72 is the second dust collection chamber that accumulates fine dust separated with the at least one filter 69. The coarse-dust collecting chamber 71 and the filter chamber 72 are collectively referred to as a dust collecting chamber 73.

The dust-containing air flowing from the connection port 18 to the primary dust container 13 is separated with the first separator 68 into coarse dust and the rest (i.e., air containing fine dust). The separated coarse dust is accumulated in the coarse-dust collecting chamber 71. The air containing fine dust separated with the first separator 68 flows into the filter chamber 72. The air flowing into the coarse-dust collecting chamber 71 also flows into the filter chamber 72. The air containing fine dust and having flowed into the filter chamber 72 is separated with the at least one filter 69 into fine dust and air. The separated fine dust is captured with the at least one filter 69 and accumulated in the filter chamber 72. The clean air having passed through the at least one filter 69 is sucked into the primary electric blower 15 through the at least one communication passage 66.

The first separator 68 includes: a nozzle 75 connected to the connection port 18; a primary filter frame 76 that accommodates the nozzle 75 and is in the shape of a truncated cone; and a first mesh filter 77.

The nozzle 75 extends from a suction port 78*a* of the container body 78, which corresponds to the outer shell of the primary dust container 13, into the inside of the container body 78.

The primary filter frame 76 is provided on the inner face of the container body 78. The primary filter frame 76 tapers and extends along the centerline of the connection port 18, i.e., substantially along the centerline C of the cleaner body 7, when the primary dust container 13 is attached to the body housing 11. The large-diameter bottom is in contact with the inner face of the container body 78, and the small-diameter bottom has a coarse-dust discharge port 79 connected to the coarse-dust collecting chamber 71 of the dust collection part 65. The diameter of the large-diameter bottom is larger than the opening diameter of the suction port 78*a*. The centerline of the coarse-dust discharge port 79 is substantially along the centerline of the suction port 78*a* and substantially along the centerline of the connection port 18. The coarse-dust discharge port 79 corresponds to the entrance of the dust collecting chamber 73.

The first mesh filter 77 is provided on the lateral face of the primary filter frame 76. The outside of the first mesh filter 77 is partitioned by a relay air-passage 81 connected to the filter chamber 72.

The pressure in the first separator 68 is decreased to negative pressure due to the flow of air to be sucked into the primary electric blower 15 through the first mesh filter 77 and the flow of air to be sucked into the primary electric blower 15 through the coarse-dust discharge port 79.

The coarse-dust collecting chamber 71 accumulates relatively heavy dust to be separated with the first separator 68. The coarse-dust collecting chamber 71 is part of the passage of the air to be sucked into the primary electric blower 15. The coarse-dust collecting chamber 71 is spatially connected to the coarse-dust discharge port 79 of the first separator 68. The coarse-dust collecting chamber 71 is also spatially connected to the filter chamber 72. The coarse-dust collecting chamber 71 is disposed on the centerline of the connection port 18, i.e., substantially on the centerline C of the cleaner body 7.

The coarse-dust collecting chamber 71 is expanded in the direction away from the primary electric blower 15, i.e., in the direction approaching the at least one filter 69. A partition wall 83 having a plurality of coarse-dust collecting chamber outlets 82 is provided between such expanded portion and the filter chamber 72 in which the at least one filter 69 is accommodated. The partition wall 83 is part of the wall of the dust collecting chamber 73. That is, the partition wall 83 partitions the coarse-dust collecting chamber 71 and the filter chamber 72. A second mesh filter 84 is provided on the coarse-dust collecting chamber outlets 82 of the partition wall 83.

The second mesh filter 84 filters and separates the dust from the air that is to be sucked into the coarse-dust collecting chamber 71 by negative pressure and contains coarse dust. The second mesh filter 84 prevents coarse dust from flowing out from the coarse-dust collecting chamber 71 into the filter chamber 72. The second mesh filter 84 compresses the dust accumulated in the coarse-dust collecting chamber 71 by the flow of air passing through it. The second mesh filter 84 has substantially the same mesh as the first mesh filter 77. When the fine dust flows into the coarse-dust collecting chamber 71 without being separated with the first separator 68, the fine dust passes through the second mesh filter 84 so as to flow into the filter chamber 72 or is captured with the coarse dust that is compressed like a filter inside the coarse-dust collecting chamber 71.

The at least one filter 69 filters and separates dust, particularly the fine dust having passed through the first separator 68, from the dust-containing air to be sucked in by the negative pressure generated with the primary electric blower 15. The at least one filter 69 includes a pair of filters 86 and 87 facing each other and a secondary filter frame 88 that maintains the shape of the pair of filters 86 and 87 so as to support the filters 86 and 87.

Downstream faces of the respective filters 86 and 87 face each other. Each of the filters 86 and 87 filters and separates the dust from the dust-containing air to be drawn into the primary dust container 13. The mesh of each of the filters 86 and 87 is finer than the first mesh filter 77 of the first separator 68 and the second mesh filter 84 of the coarse-dust collecting chamber 71. The filters 86 and 87 are, for example, non-woven fabrics. The dust to be captured with the filters 86 and 87 contains the dust that can pass through the first mesh filter 77 and the second mesh filter 84.

One of the filters 86 and 87 (filter 86) is directly exposed to the air flowing into the filter chamber 72, and the other of the filters 86 and 87 (filter 87) is exposed to the air that has run around one of the filters 86 and 87 (filter 86). That is, the filter 86 faces the relay air-passage 81 connecting the first separator 68 to the at least one filter 69, and faces the coarse-dust collecting chamber outlets 82 connecting the coarse-dust collecting chamber 71 to the filter chamber 72. The filter 87 is hidden with the filter 86 and disposed at the position where the filter 87 cannot be seen from the relay air-passage 81 and the coarse-dust collecting chamber outlets 82.

The pair of filters 86 and 87 are pleated filters having folds (ridge lines 86*a* and 87*a*) which are substantially the same as each other in size (spacing) and in depth.

The filter 86 facing the relay air-passage 81 and the coarse-dust collecting chamber outlets 82 may have a wider and shallower fold as compared with the filter 87. Since the filter 86 faces the relay air-passage 81 and the coarse-dust collecting chamber outlets 82, the fine dust (i.e., the dust passing through the first separator 68 and the dust flowing out of the coarse-dust collecting chamber 71) first blows on the filter 86. Then, the filter 86 captures the fine dust and causes clogging gradually. As the filter 86 is clogged, the fine dust blowing from the relay air-passage 81 and the coarse-dust collecting chamber outlets 82 to the filter 86 is circulated to the filter 87. Subsequently, clogging of the filter 87 also starts. That is, the filter 86 is more likely to be clogged than the filter 87. In other words, dust is more readily attached to the filter 86 as compared with the filter 87. Thus, the dust can be readily removed from the filter 86, to which dust is more likely to be attached, by making the fold of the filter 86 wider and shallower than the filter 87.

The filters 86 and 87 may have a film of polytetrafluoroethylene (PTFE, so-called Teflon (registered trademark)) on the upstream face so that the attached dust can be readily removed. Additionally, only the filter 86, which is more readily clogged than the filter 87, may have a polytetrafluoroethylene film on the upstream face.

The filters 86 and 87 have ridge lines (folds) 86*a* and 87*a* extending in the up-and-down direction (i.e., vertical direction) in the storage configuration of the electric vacuum cleaner apparatus 1. In other words, the ridge lines 86*a* and 87*a* of the filters 86 and 87 extend in the front-rear direction of the cleaner body 7. Each of the filters 86 and 87 is open at the end face intersecting the fold.

The open end face of each filters 86 and 87 may be a zigzag shape having mountains and valleys along the end face shape of each filters 86 and 87 or may be a surface in which a plate-shaped frame having ventilating holes (not shown) are interposed between adjacent mountain folds.

The secondary filter frame 88 supports the pair of filters 86 and 87 such that the pair of filters 86 and 87 face each other and are spaced apart. The space partitioned with the secondary filter frame 88 and the pair of filters 86 and 87 corresponds to the air passage on the downstream of the at least one filter 69. The inside of this filter 69 communicates with the at least one communication passage 66. The secondary filter frame 88 has secondary filter outlets 89 that are located on both sides of the filter 86 and connected to the at least one communication passage 66. The secondary filter outlets 89 cause the air having passed through the filters 86 and 87 to flow out to the at least one communication passage 66.

The filter chamber 72 is adjacent to the coarse-dust collecting chamber 71. The filter chamber 72 functions as a fine-dust collecting chamber that accumulates the fine dust to be captured on the at least one filter 69 by filtration separation. The fine dust passing through the first mesh filter 77 and the second mesh filter 84 is captured with the pair of finer mesh filters 86 and 87, and then is accumulated in the filter chamber 72. That is, the dust collecting chamber 73 (i.e., the coarse-dust collecting chamber 71 and the filter chamber 72) is disposed on the upstream of the filters 86 and 87.

The filter chamber 72 is part of the passage of the air to be sucked into the primary electric blower 15. The filter chamber 72 communicates with the relay air-passage 81. The filter chamber 72 also communicates with the coarse-dust collecting chamber 71.

The at least one communication passage 66 includes air passages 66*a* and 66*b* for leading the air flowing out of the separation part 64 and the dust collection part 65 to the primary electric blower 15. In other words, the at least one communication passage 66 branches into a plurality of passages so as to reach the primary electric blower 15. For example, the at least one communication passage 66 is divided into two air passages 66*a* and 66*b*. A plurality of, for example, two air passages 66*a* and 66*b* sandwich the suction port 78*a* for introducing air to the separation part 64. The cross-sectional area S of the air passage 66*a* is substantially equal to the cross-sectional area S of the air passage 66*b*. The two air passages 66*a* and 66*b* have a plane-symmetrical shape with respect to the plane including the rotation centerline of the fan of the primary electric blower 15. In other words, the air passages 66*a* and 66*b* are spaced apart from each other and are disposed so as to be closer to the respective edges of the at least one filter 69, the first mesh filter 77, and the second mesh filter 84 than the respective centers of the at least one filter 69, the first mesh filter 77, and the second mesh filter 84. The two air passages 66*a* and 66*b* gather and merge at the end of the communication passage 66 connected to the primary electric blower 15. In other words, the two air passages 66*a* and 66*b* are connected to the primary electric blower 15 through a collective air passage 66*c* of the at least one communication passage 66. The at least one communication passage 66 may be branched into three or more. In other words, the at least one communication passage 66 is a plurality of downstream air passages that lead the air passing through the first mesh filter 77, the second mesh filter 84, and the at least one filter 69 to the primary electric blower 15.

Among the dust-containing air flowing from the nozzle 75 to the first separator 68, the coarse dust of relatively large mass flows straight from the nozzle 75 to the coarse-dust discharge port 79 by inertia force and then is sent to the coarse-dust collecting chamber 71. The dust (coarse dust) flowing from the coarse-dust discharge port 79 into the coarse-dust collecting chamber 71 is accumulated in the coarse-dust collecting chamber 71. The air and dust of relatively small mass included in the dust-containing air flowing from the nozzle 75 to the first separator 68 expand radially from the nozzle 75, pass through the first mesh filter 77 provided on the lateral face of the primary filter frame 76, and flow into the filter chamber 72 through the relay air-passage 81. Along with the dust (coarse dust) flowing from the coarse-dust discharge port 79 into the coarse-dust collecting chamber 71, part of the air also flows into the coarse-dust collecting chamber 71. The air having flowed into the coarse-dust collecting chamber 71 passes through the second mesh filter 84 and flows into the filter chamber 72. The fine dust contained in the air flowing into the filter chamber 72 after passing through the first mesh filter 77 or the second mesh filter 84 is filtered and separated with the filter 69 so as to be captured on the surfaces of the pair of filters 86 and 87. The clean air passing through the filters 86 and 87 is drawn into the primary electric blower 15 through the communication passage 66. Subsequently, the clean air is temporarily divided into the plurality of air passages 66*a* and 66*b*, and then the clean air is gathered again and sucked into the primary electric blower 15.

The container body 78 partitions the dust collecting chamber 73, i.e., the coarse-dust collecting chamber 71 and the filter chamber 72. The communication passage 66 and the first separator 68 of the separation part 64 are disposed between the filter 69 and the primary electric blower 15 to be side by side with each other. In other words, the separation part 64, the communication passage 66, and the primary electric blower 15 are arranged in this order.

The pair of wheels 12 are disposed such that the primary electric blower 15, the separation part 64 (i.e., the first separator 68 and the filter 69), the dust collection part 65 (i.e., the coarse-dust collecting chamber 71 and the filter chamber 72), and the communication passage 66 is interposed between both wheels 12.

The first separator 68 is disposed at the central portion in the width direction of the body housing 11, the filter 69 is biased to one side (for example, the right side) of the body housing 11, and the primary electric blower 15 is biased to the other side (for example, the left side) of the body housing 11.

The primary dust container 13 includes: the container body 78 that partitions the dust collecting chamber 73 for accumulating the dust to be sucked into the electric vacuum cleaner 3 and is provided with a waste outlet 91 for discharging the dust accumulated in the dust collecting chamber 73; and a waste-outlet lid 92 that opens and closes the waste outlet 91.

The primary dust container 13 includes: a suction port 93 that introduces air directly from the outside of the air passage including the primary dust container 13 by the negative pressure to be generated with the secondary electric blower 50 of the station 2; and a suction-port lid 94 that opens and closes the suction port 93.

The primary dust container 13 further includes: a dust-removal mechanism 95 that removes the dust attached to the filter 69 (i.e., dust attached to the filters 86 and 87); and a power transmission mechanism 96 that interacts the dust-removal operation of the dust-removal mechanism 95 with the opening operation of the waste-outlet lid 92.

The primary dust container 13 may be provided with a dust compression mechanism 97 that compresses the dust accumulated in the primary dust container 13.

The container body 78 accommodates the separation part 64, i.e., the first separator 68 and the at least one filter 69. The container body 78 partitions the dust collecting chamber 73, i.e., the coarse-dust collecting chamber 71 and the filter chamber 72. Additionally, the container body 78 partitions a machine chamber 98 that accommodates the power transmission mechanism 96. The container body 78 is cylindrical as a whole. The container body 78 is attached to the region A1 such that the centerline of its cylindrical body is directed in the width direction of the body housing 11.

The waste outlet 91 and the suction port 93 are provided on the lateral face of the container body 78. The suction-port lid 94 and the waste-outlet lid 92 are opened and closed together. The waste outlet 91 is closed with the waste-outlet lid 92 except when the dust is transferred from the cleaner body 7 to the station 2. In other words, the waste-outlet lid 92 is opened only when the dust is transferred from the cleaner body 7 to the station 2, and the waste-outlet lid 92 closes the waste outlet 91 at other times. The suction port 93 is closed with the suction-port lid 94 except when the dust is transferred from the cleaner body 7 to the station 2. In other words, the suction-port lid 94 is opened only when the dust is transferred from the cleaner body 7 to the station 2, and the suction-port lid 94 closes the suction port 93 at other times.

The waste outlet 91 discharges the dust accumulated in the primary dust container 13 together with the air introduced from the suction port 93. The waste outlet 91 is disposed at the rear end of the body housing 11. The waste outlet 91 is disposed at the position where the station 2 and the cleaner body 7 are in contact with each other. That is, the waste outlet 91 is disposed on the back face of the body housing 11. The back face of the body housing 11 is located at the lower end of the body housing 11 in the storage configuration (FIG. 2) of the electric vacuum cleaner apparatus 1. The waste outlet 91 is disposed below the filter 69 in the storage configuration of the electric vacuum cleaner apparatus 1. In addition, the waste outlet 91 is opened downward of the filter 69 in the storage configuration of the electric vacuum cleaner apparatus 1.

A body-housing waste-outlet 99 larger than the waste outlet 91 is provided at the rear end of the body housing 11. The body-housing waste-outlet 99 allows the dust transfer tube 43 of the station 2 to pass through it in the storage configuration of the electric vacuum cleaner apparatus 1, and connects the inlet of the dust transfer tube 43 to the waste outlet 91.

The waste outlet 91 includes: a coarse-dust waste-outlet 101 that communicates with the coarse-dust collecting chamber 71; and a fine-dust waste-outlet 102 that communicates with the filter chamber 72. The coarse-dust waste-outlet 101 and the fine-dust waste-outlet 102 are aligned in the width direction of the body housing 11, i.e., in the direction of the centerline of the container body 78. The coarse-dust collecting chamber 71 and the filter chamber 72 share the partition wall 83 and are adjacent to each other.

The waste-outlet lid 92 and the suction-port lid 94 are part of the lateral face of the container body 78. The suction-port lid 94 is provided so as to be reciprocatable in the circumferential direction of the cylindrical container body 78. The waste-outlet lid 92 is supported by the container body 78 with a hinge mechanism (not shown). The waste-outlet lid 92 is an outward opening type that opens toward the outside of the primary dust container 13. The waste-outlet lid 92 opens and closes the coarse-dust waste-outlet 101 and the fine-dust waste-outlet 102 together. When the waste-outlet lid 92 is opened, both the coarse-dust waste-outlet 101 and the fine-dust waste-outlet 102 are connected to the dust transfer tube 43 together.

In addition, a packing 103 is appropriately provided in the waste outlet 91. The packing 103 is an integral molding. The packing 103 is sandwiched between the waste-outlet lid 92 and the container body 78, and seals both of the coarse-dust waste-outlet 101 and the fine-dust waste-outlet 102 together.

The suction port 93 is an inlet for introducing air into the filter chamber 72 from the outside of the cleaner body 7 or from the outside of the air passage that is inside the body housing 11 and is spatially connected to the primary electric blower 15. The suction port 93 is a suction inlet that generates an air flow when the dust is transferred from the cleaner body 7 to the station 2.

As viewed in the circumferential direction of the container body 78, the suction port 93 is disposed at the position farthest from the waste outlet 91, i.e., the position 180° away from the waste outlet 91. In detail, when the centerline of the container body 78 is used as a reference, the position of the suction port 93 is in line symmetry with the position of the waste outlet 91. That is, the suction port 93 is disposed above the filter 69 in the storage configuration (FIG. 1) of the electric vacuum cleaner apparatus 1. In other words, the filters 86 and 87 are disposed between the suction port 93 and the waste outlet 91.

In addition, the suction port 93 is disposed in the air passage on the upstream of the filters 86 and 87 (i.e., upstream of the flow to be generated with the primary electric blower 15).

The air introduced from the suction port 93 causes both of the fine dust filtered with the filters 86 and 87 and the coarse dust accumulated in the primary dust container 13 to flow out from the waste outlet 91 together. When the negative pressure acts on the filter chamber 72 from the dust transfer tube 43 through the fine-dust waste-outlet 102, the suction port 93 blows air on the filters 86 and 87. The air blown on the filters 86 and 87 blows off the dust captured on the respective surfaces of the filters 86 and 87 so as to lead the dust to the fine-dust waste-outlet 102 and discharges the fine dust (i.e., causes the fine dust to flow out) from the fine-dust waste-outlet 102. The filters 86 and 87 have the ridge lines 86*a* and 87*a* extending in the vertical direction at the time of dust removal, i.e., in the storage configuration of the electric vacuum cleaner apparatus 1, and the end face intersecting the fold is opened. Thus, the air blown on the filters 86 and 87 can readily flow along the fold, and the removed fine dust can be made to flow out smoothly from the end of the fold.

At this time, the negative pressure acts also on the coarse-dust collecting chamber 71 from the dust transfer tube 43 through the coarse-dust waste-outlet 101. Since the coarse-dust collecting chamber 71 directly communicates with the filter chamber 72 and indirectly communicates with the filter chamber 72 through the first separator 68, part of the air flowing in from the suction port 93 also flows into the coarse-dust collecting chamber 71. The air having flowed into the coarse-dust collecting chamber 71 causes the coarse dust accumulated in the coarse-dust collecting chamber 71 to flow out of (i.e., be discharged from) the coarse-dust waste-outlet 101.

The fine dust to be discharged from the primary dust container 13 through the fine-dust waste-outlet 102 and the coarse dust to be discharged from the primary dust container 13 through the coarse-dust waste-outlet 101 are transferred to the secondary dust container 49 through the dust transfer tube 43 of the station 2.

Although the suction port 93 according to the present embodiment is provided in the container body 78 of the primary dust container 13 and is disposed in the air passage on the upstream of the filters 86 and 87, the suction port 93 may be provided in the air passage on the downstream of the filters 86 and 87 (i.e., downstream of the flow to be generated with the primary electric blower 15) shown as the suction port 93 and the suction-port lid 94 indicated by the dashed-and double dotted lines in FIG. 6. In this case, the suction port 93 communicates with the air passage, for example, communicates with the communication passage 66, from the filters 86 and 87 to the primary electric blower 15.

The rechargeable battery 17 surrounds the coarse-dust collecting chamber 71. That is, the unit cells 17*a* included in the rechargeable battery 17 are arranged along the inner face of the rear half of the cylindrical body housing 11 and surround the periphery of the coarse-dust collecting chamber 71.

The dust compression mechanism 97 is provided in the coarse-dust collecting chamber 71. The dust compression mechanism 97 compresses the coarse dust by, for example, sandwiching the coarse dust with any wall surface of the coarse-dust collecting chamber 71, and thereby reduces the volume of the coarse dust.

Next, the dust-removal mechanism 95 of the electric vacuum cleaner 3 according to the present embodiment will be described.

Figure 8:
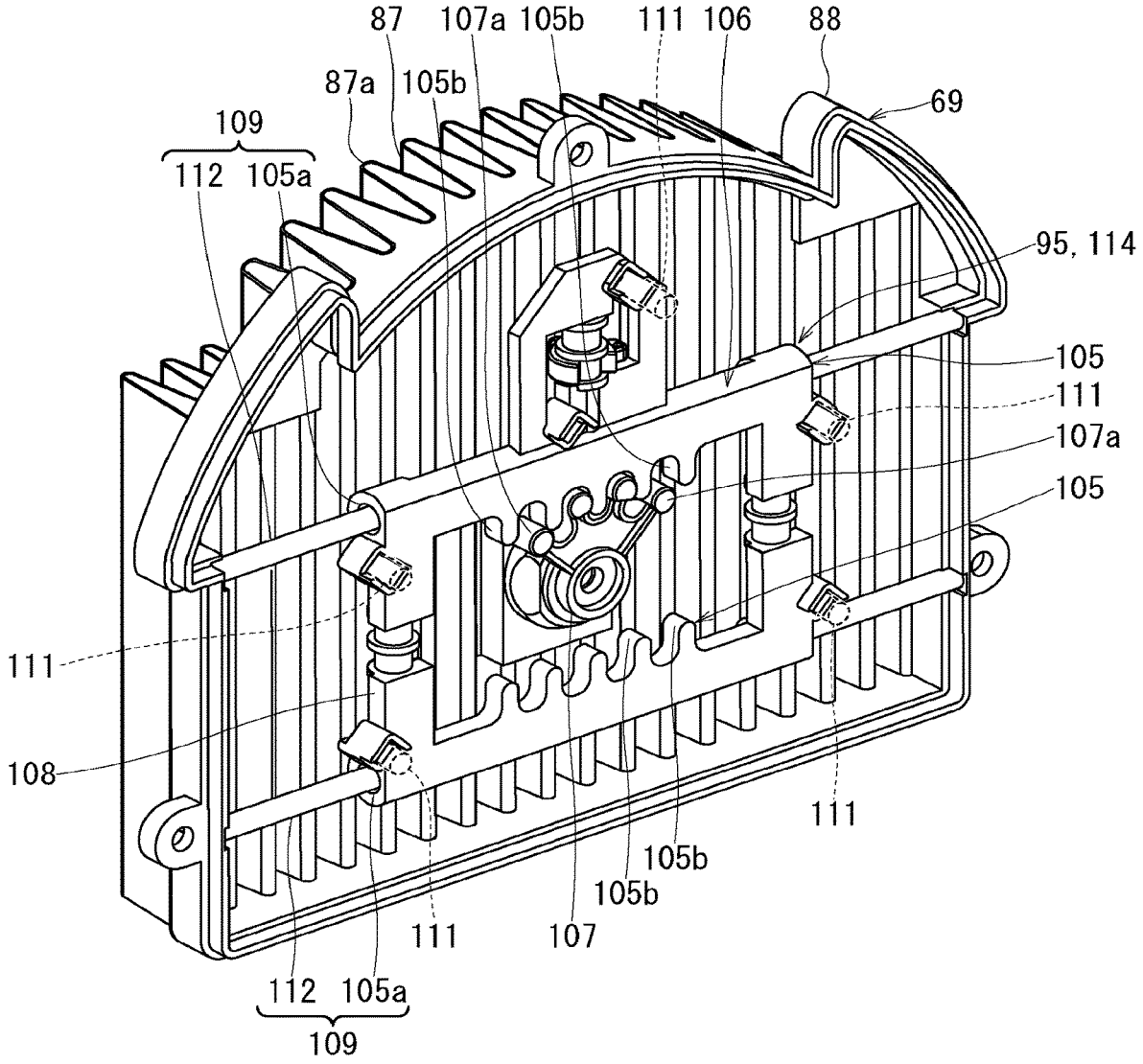
FIG. 8 is a perspective view of a dust-removal mechanism of the electric vacuum cleaner according to the embodiment of the present invention.

FIG. 8 is a perspective view of the dust-removal mechanism of the electric vacuum cleaner according to the embodiment of the present invention.

As shown in FIG. 8, the dust-removal mechanism 95 of the electric vacuum cleaner 3 according to the present embodiment is disposed between the pair of filters 86 and 87. In other words, the dust-removal mechanism 95 is disposed in the internal space of the filter 69. The dust-removal mechanism 95 removes the dust from the pair of filters 86 and 87 together.

The dust-removal mechanism 95 includes: a driven mechanism 106 including connected racks 105; and a gear 107 that sequentially meshes with the racks 105 so as to move the driven mechanism 106 along a predetermined track while rotating in one direction.

In addition to the racks 105, the driven mechanism 106 is provided with: a frame 108 that integrally connects the racks 105, a mechanism (for example, slider 109) that defines the moving direction of the racks 105; and dust removers 111 that contact the respective filters 86 and 87.

The racks 105 in the present embodiment are a pair of racks 105 arranged in parallel. The driven mechanism 106 reciprocates by alternately meshing the gear 107 with the pair of racks 105.

The frame 108 connects the respective ends of the pair of racks 105. The pair of racks 105 and the frame 108 draw a rectangle as a whole.

The slider 109 includes: holes 105*a* of the racks 105; and rod-shaped rails 112 that are inserted into the corresponding holes 105*a* and fixed to the secondary filter frame 88 of the filter 69. The slider 109 may be configured as a component that includes: elongated holes (not shown) provided in the frame 108 or the racks 105; and pin members (not shown) such as screws or rivets to be inserted into the elongated holes and fixed to the secondary filter frame 88, for example.

The gear 107 is disposed at the central portion of the filter 69. In other words, the gear 107 is sandwiched between the pair of filters 86 and 87 and disposed at the central portion of the projection plane of the filters 86 and 87.

The teeth 107*a* of the gear 107 are partially provided. In other words, the gear 107 is partially devoid of the teeth 107*a*. The teeth 107*a* of the gear 107 sequentially mesh with the racks 105 in the process of one rotation of the gear 107. The number of teeth 107*a* of the gear 107 is limited to a range in which two or more racks 105 do not simultaneously mesh with the gear 107.

More specifically, the number of teeth 105*b* of each rack 105 is one more than the number of the teeth 107*a* of the gear 107. That is, the number of grooves between the adjacent teeth 105*b* of each rack 105 is the same as the number of the teeth 107*a* of the gear 107. For example, the gear 107 has four teeth 107*a* and each rack 105 has five teeth 105*b*. The distance from the bottom of the groove of one of the pair of racks 105 to the bottom of the groove of the other of the pair of racks 105 is slightly larger than the outermost diameter of the gear 107. This difference (gap) facilitates engagement and disengagement between the teeth 107*a* of the gear 107 and the teeth 105*b* of the racks 105.

While the gear 107 partially devoid of the teeth 107*a* is being rotated half, the teeth 107*a* mesh with one of the racks 105 to move the driven mechanism 106 in the forward path. When the rotation of the gear 107 progresses (advances about 180°), the teeth 107*a* come out of the one rack 105 and mesh with the other rack 105 so as to move the driven mechanism 106 in the backward path. The gear 107 may be configured such that there is a period in which the teeth 107*a* are not temporarily engaged with any of the racks 105 between the forward path and the backward path of the driven mechanism 106.

The dust-removal mechanism 95 having three or more racks 105 may include: a gear 107 provided with teeth around its entire circumference; and a mechanism for defining the moving direction of the racks 105 other than the slider 109. The dust-removal mechanism 95 having three or more racks 105 may cause the gear 107 to make one or more rotations when causing the driven mechanism 106 to move along its track for one cycle.

Next, the power transmission mechanism 96 of the electric vacuum cleaner 3 according to the present embodiment will be described.

FIG. 9 to FIG. 12 are diagrams illustrating the power transmission mechanism of the electric vacuum cleaner according to the embodiment of the present invention.

Figure 9:
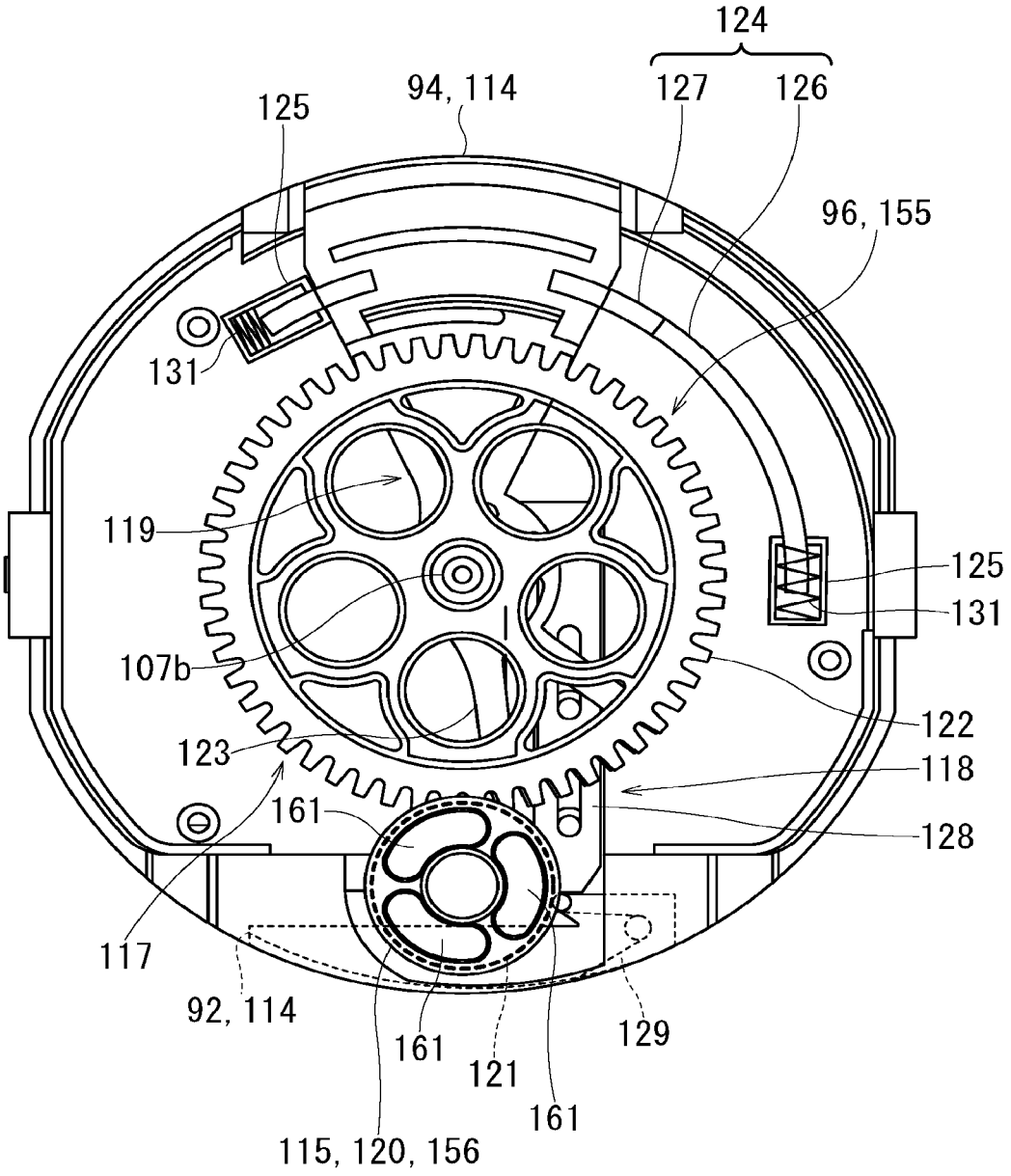
FIG. 9 is a diagram illustrating a power transmission mechanism of the electric vacuum cleaner according to the embodiment of the present invention.
Figure 10:
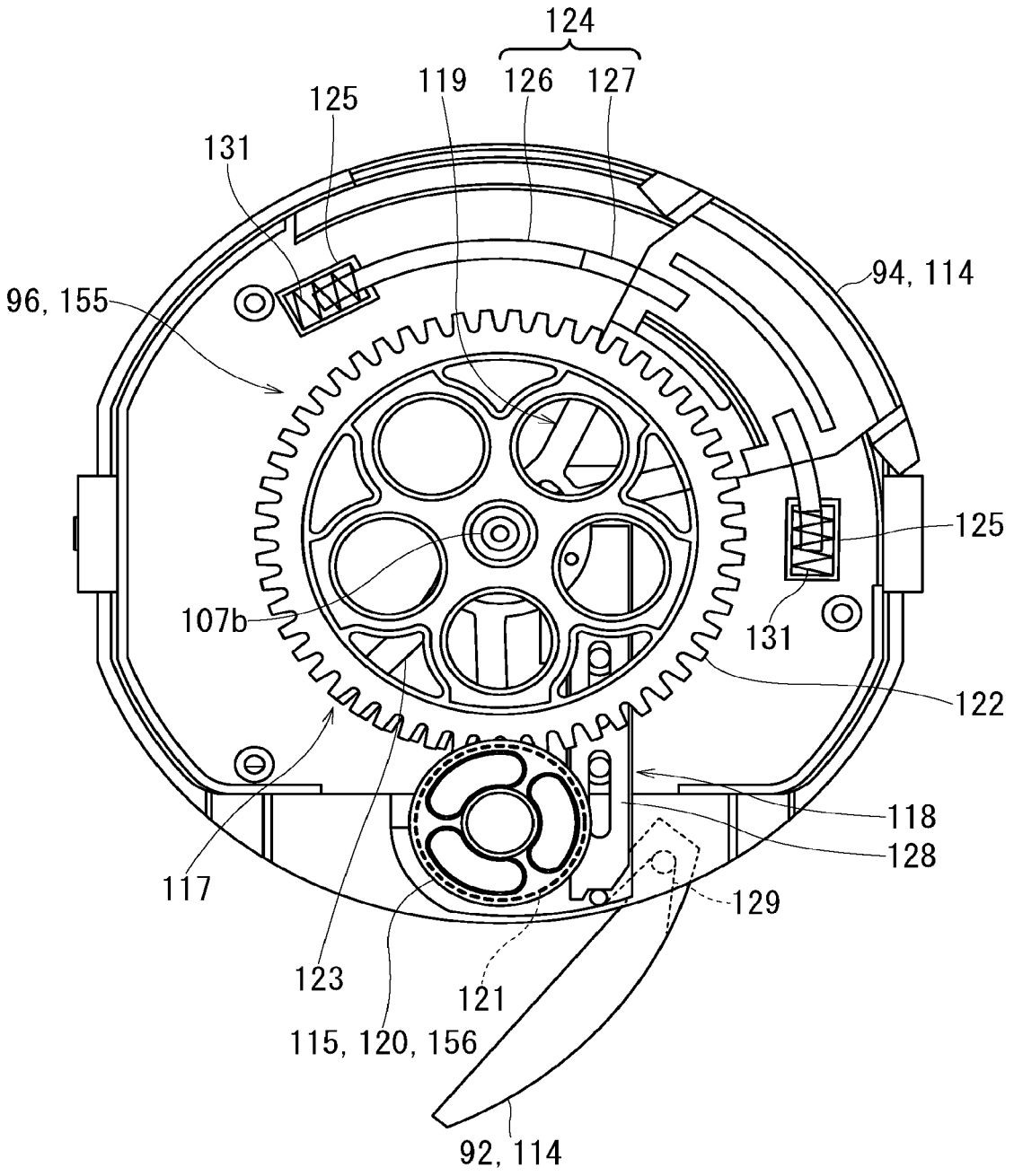
FIG. 10 is another diagram illustrating the power transmission mechanism of the electric vacuum cleaner according to the embodiment of the present invention.
Figure 11:
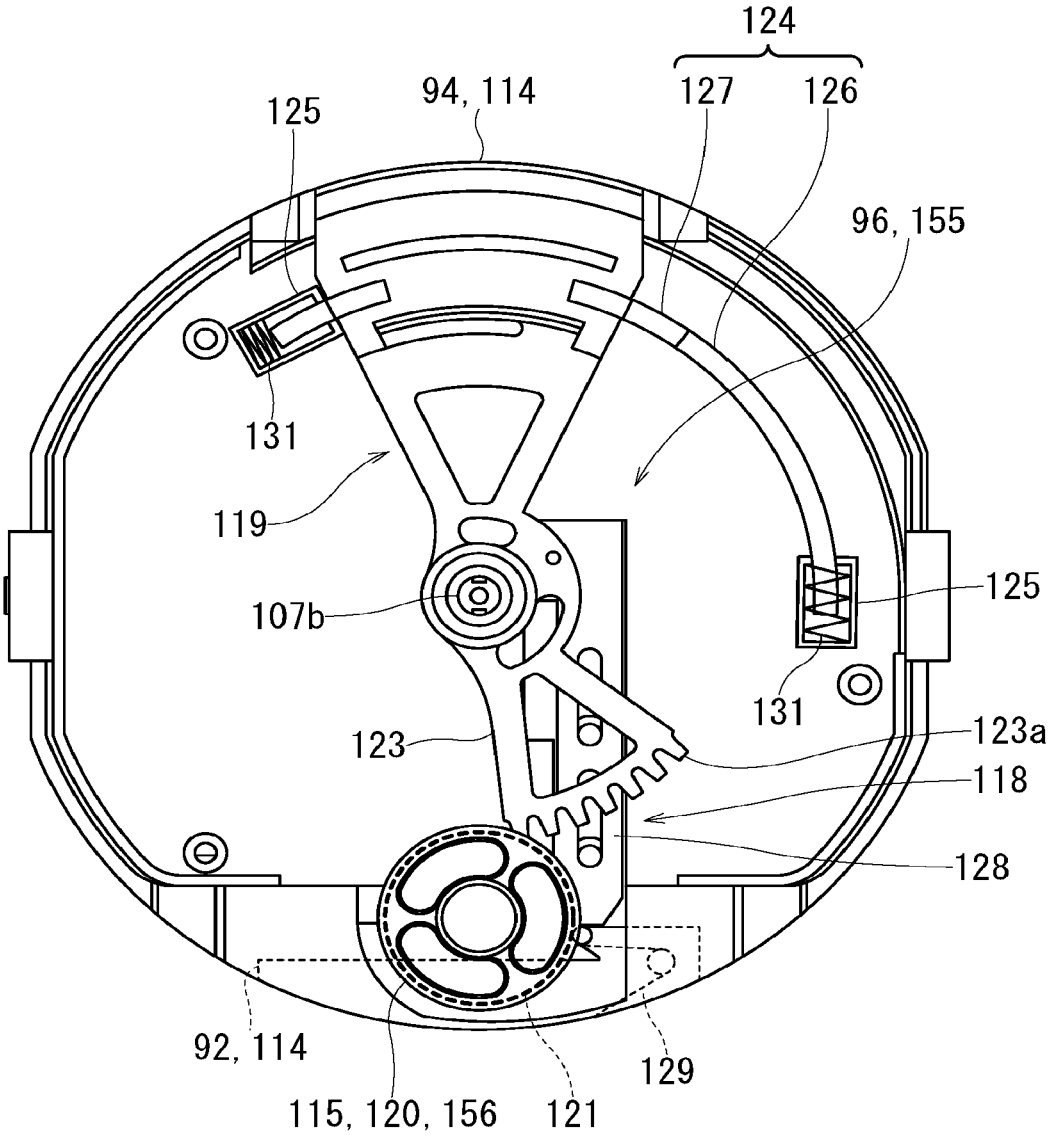
FIG. 11 is still another diagram illustrating the power transmission mechanism of the electric vacuum cleaner according to the embodiment of the present invention.
Figure 12:
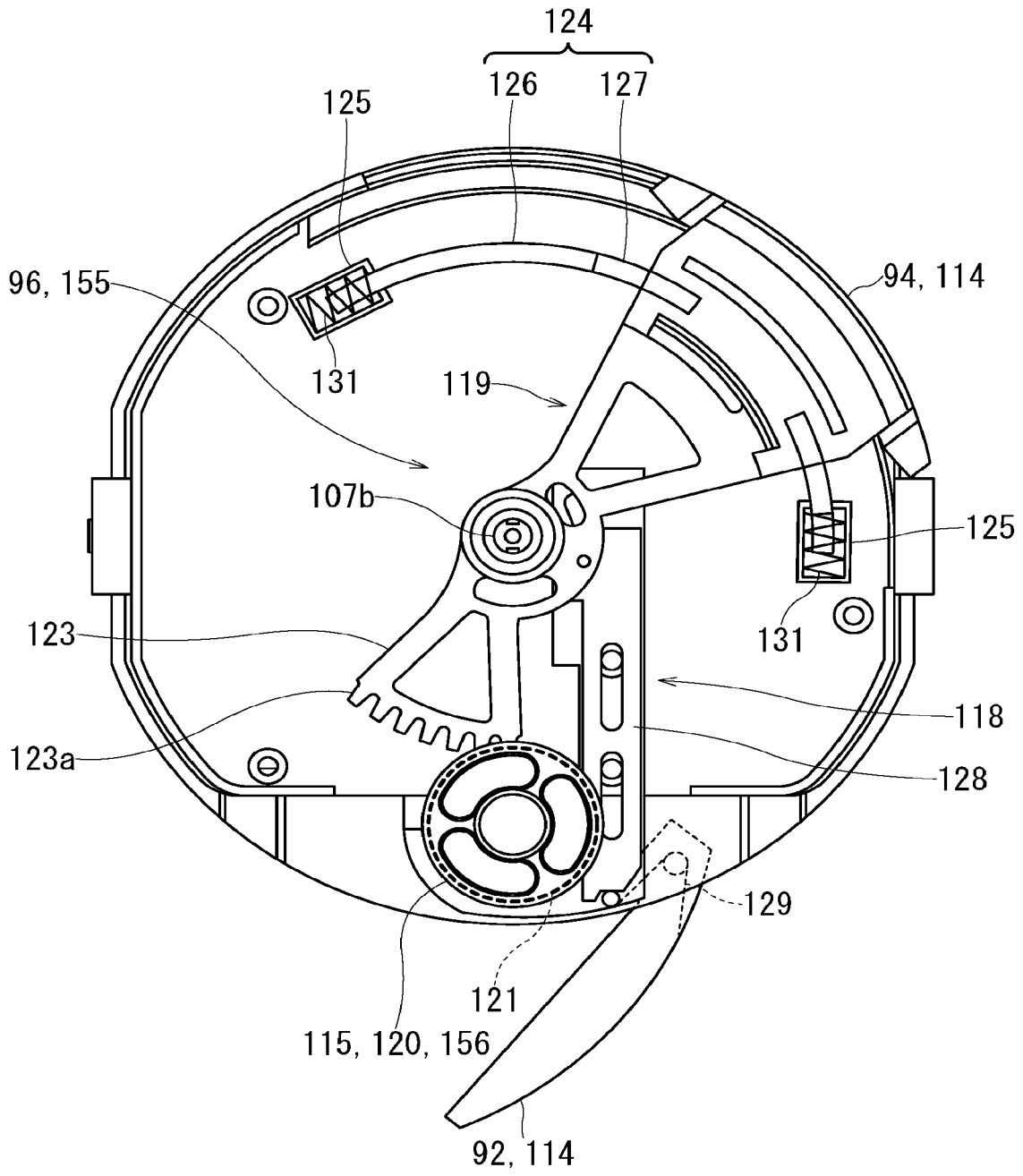
FIG. 12 is still another diagram illustrating the power transmission mechanism of the electric vacuum cleaner according to the embodiment of the present invention.

FIG. 9 and FIG. 11 show the state in which the waste-outlet lid 92 and the suction-port lid 94 are closed with the power transmission mechanism 96. FIG. 10 and FIG. 12 show the state in which the waste-outlet lid 92 and the suction-port lid 94 are opened with the power transmission mechanism 96. FIG. 11 and FIG. 12 show the power transmission mechanism 96 with the second gear 122 omitted.

As shown in FIG. 9 to FIG. 12 in addition to FIG. 3 and FIG. 5, the power transmission mechanism 96 of the electric vacuum cleaner 3 according to the present embodiment receives the driving force for the dust-removal mechanism 95, the waste-outlet lid 92, and the suction-port lid 94 from the station 2, and distributes and transmits the driving force to each of the dust-removal mechanism 95, the waste-outlet lid 92, and suction-port lid 94. The dust-removal mechanism 95, the waste-outlet lid 92, and the suction-port lid 94 that obtain the driving force from the station 2 via the power transmission mechanism 96 are collectively referred to as a driven mechanism 114. The driven mechanism 114 switches between one state in which the electric vacuum cleaner 3 can be used and another state in which dust can be transferred from the primary dust container 13 of the electric vacuum cleaner 3 to the secondary dust container 49 of the station 2 by the driving force from the station 2.

The power transmission mechanism 96 includes: a driven part 115; a first transmission mechanism 117 for transmitting the driving force from the driven part 115 to the dust-removal mechanism 95; a second transmission mechanism 118 for transmitting the driving force from the driven part 115 to the waste-outlet lid 92; and a third transmission mechanism 119 for transmitting the driving force from the driven part 115 to the suction-port lid 94.

The power transmission mechanism 96 distributes the driving force received from the station 2 to the dust compression mechanism 97.

The driven part 115 is part of a shaft coupling 120 that transmits rotational driving force. The driven part 115 can be coupled to a driving part 116 of the station 2.

The first transmission mechanism 117 continuingly transmits the driving force inputted to the driven part 115 to the gear 107 of the dust-removal mechanism 95. The first transmission mechanism 117 simply transmits the rotational driving force inputted to the driven part 115 so as to rotate the gear 107. In other words, the first transmission mechanism 117 rotates the gear 107 in the reverse direction when the driven part 115 rotates in the normal direction, and the first transmission mechanism 117 rotates the gear 107 in the normal direction when the driven part 115 rotates in the reverse direction.

The first transmission mechanism 117 includes: a first gear 121 rotationally integral with the driven part 115; and a second gear 122 engaged with the first gear 121 and having a large diameter. The second gear 122 is rotatably supported with a shaft 107*b* that penetrates the secondary filter frame 88 of the filter 69 and rotates integrally with the gear 107 of the dust-removal mechanism 95. That is, the second gear 122 rotates integrally with the gear 107 of the dust-removal mechanism 95. Since the second gear 122 is larger than the first gear 121, a motor (a drive source 149 of the station 2 described below) can drive the dust-removal mechanism 95, which operates while flipping or deforming the filters 86 and 87, with a smaller output.

The second transmission mechanism 118 opens and closes the waste-outlet lid 92 by the driving force inputted to the driven part 115. The third transmission mechanism 119 opens and closes the suction-port lid 94 by the driving force to be inputted to the driven part 115. Both of the suction-port lid 94 and the waste-outlet lid 92 are opened or closed together. In other words, when the second transmission mechanism 118 opens the waste-outlet lid 92, the third transmission mechanism 119 also opens the suction-port lid 94. In addition, when the second transmission mechanism 118 closes the waste-outlet lid 92, the third transmission mechanism 119 also closes the suction-port lid 94.

The third transmission mechanism 119 includes: the first gear 121 that is shared with the first transmission mechanism 117; a lever 123 that is provided with teeth 123*a* disposed in an arc and engaged with the first gear 121; a guide 124 that guides the swinging of the lever 123; and a pair of stoppers 125 that defines the swinging range of the lever 123.

The lever 123 has a center of oscillation that coincides with the rotation center of the second gear 122. That is, the lever 123 is supported together with the second gear 122 by the shaft that rotatably supports the second gear 122. The lever 123 is directly connected to the suction-port lid 94.

The guide 124 includes: a groove 126 provided in the container body 78; and a guide plate 127 disposed in the groove 126. The groove 126 extends in an arc according to the swinging track of the lever 123. The guide plate 127 is integrated into the lever 123.

The stoppers 125 regulate (limit) the swinging range of the lever 123 in accordance with the fully closed position and the fully opened position of the waste-outlet lid 92 and the suction-port lid 94.

The second transmission mechanism 118 includes: the first gear 121 that is shared among the first transmission mechanism 117 and the third transmission mechanism 119; the lever 123, the guide 124, and the stoppers 125 that are shared between the third transmission mechanism 119; a slider 128 that converts the swinging motion of the lever 123 into a reciprocating motion and transmits it to the waste-outlet lid 92; and a waste-lid closing spring 129 that generates spring force for fully closing the waste-outlet lid 92. The slider 128 overcomes the spring force of the waste-lid closing spring 129 so as to open the waste-outlet lid 92. In addition, the slider 128 closes the waste-outlet lid 92 by the spring force of the waste-lid closing spring 129.

The power transmission mechanism 96 transmits the driving force from the station 2 to the dust-removal mechanism 95 for an appropriate period. After the waste-outlet lid 92 and the suction-port lid 94 are fully opened or fully closed, the power transmission mechanism 96 cuts off (i.e., interrupt) the power transmission from the station 2 to the waste-outlet lid 92 and the suction-port lid 94 even in an appropriate period during which the dust-removal mechanism 95 is in operation.

That is, the second transmission mechanism 118 cuts off the transmission of the driving force from the driven part 115 to the waste-outlet lid 92 when the waste-outlet lid 92 is fully opened or fully closed. Additionally, the third transmission mechanism 119 cuts off the transmission of the driving force from the driven part 115 to the suction-port lid 94 when the suction-port lid 94 is fully opened or fully closed.

Specifically, the second transmission mechanism 118 and the third transmission mechanism 119 release the engagement between the teeth 123*a* of the lever 123 and the first gear 121 when the waste-outlet lid 92 and the suction-port lid 94 are fully opened or fully closed. That is, the arrangement range of the teeth 123*a* arranged in an arc is limited in such a manner that the teeth 123*a* are disengaged from the first gear 121 when the waste-outlet lid 92 and the suction-port lid 94 are fully opened or fully closed.

When the waste-outlet lid 92 is fully closed or fully opened, the teeth 123*a* of the lever 123 cannot resist the waste-outlet lid 92 that is prevented from moving, and the teeth 123*a* is disengaged from the first gear 121 so as to the transmission of the driving force (torque). When the suction-port lid 94 is fully closed or fully opened, the teeth 123*a* of the lever 123 is disengaged from the first gear 121 so as to interrupt the transmission of the driving force (torque).

The power transmission mechanism 96 includes a drive source, for example, a return spring 131 for promoting smooth engagement between the teeth 123*a* of the lever 123 and the first gear 121 when the engagement between both is restored. When the waste-outlet lid 92 and the suction-port lid 94 are fully opened or fully closed, the return spring 131 is compressed to store energy. Subsequently, when opening or closing of the waste-outlet lid 92 and the suction-port lid 94 are started, the return spring 131 pushes back the lever 123 by consuming the energy so as to assist the return of the engagement between the teeth 123*a* of the lever 123 and the first gear 121.

It is preferred that the waste-outlet lid 92 and the suction-port lid 94 maintain the fully open state in an appropriate period during which the dust-removal mechanism 95 operates and removes the dust from the filters 86 and 87. If the dust-removal mechanism 95 is caused to reciprocate by switching between the normal rotation and the reverse rotation of the motor (i.e., the drive source 149 of the station 2 described below), the waste-outlet lid 92 and the suction-port lid 94 are opened and closed every time the normal rotation and the reverse rotation of the motor are switched, which is not desirable. For this reason, the dust-removal mechanism 95 according to the present embodiment is configured to be able to reciprocate the driven mechanism 106 with the gear 107 rotating in one direction as shown in FIG. 8.

A description will now be given of the wheels 12 and the body handle 14 of the cleaner body 7 according to the embodiment of the present invention.

Figure 13:
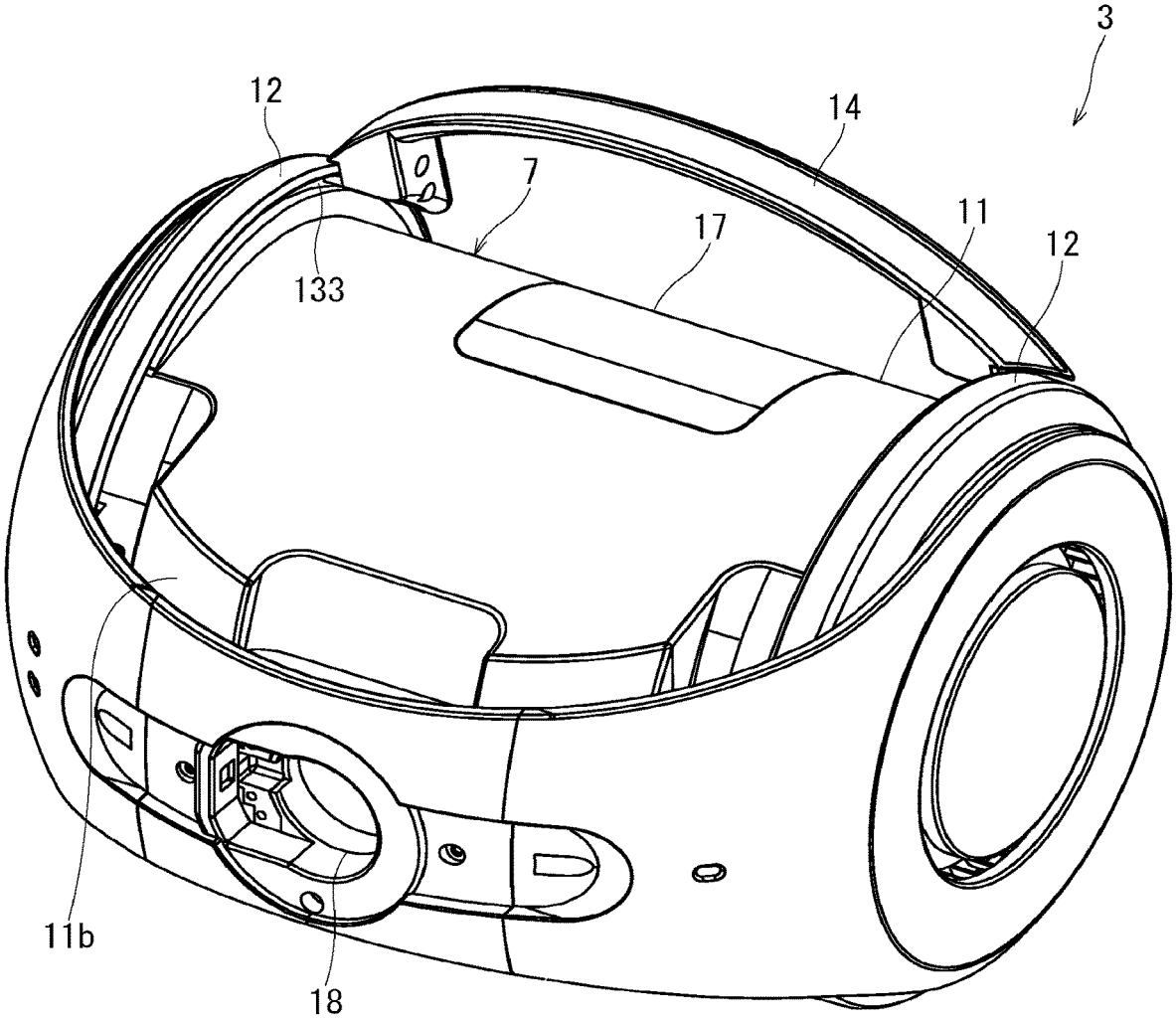
FIG. 13 is a perspective view illustrating when a body handle of the electric vacuum cleaner according to the embodiment of the present invention is pulled out.

FIG. 13 is a perspective view illustrating the state where the body handle of the electric vacuum cleaner according to the embodiment of the present invention is pulled out.

Figure 14:
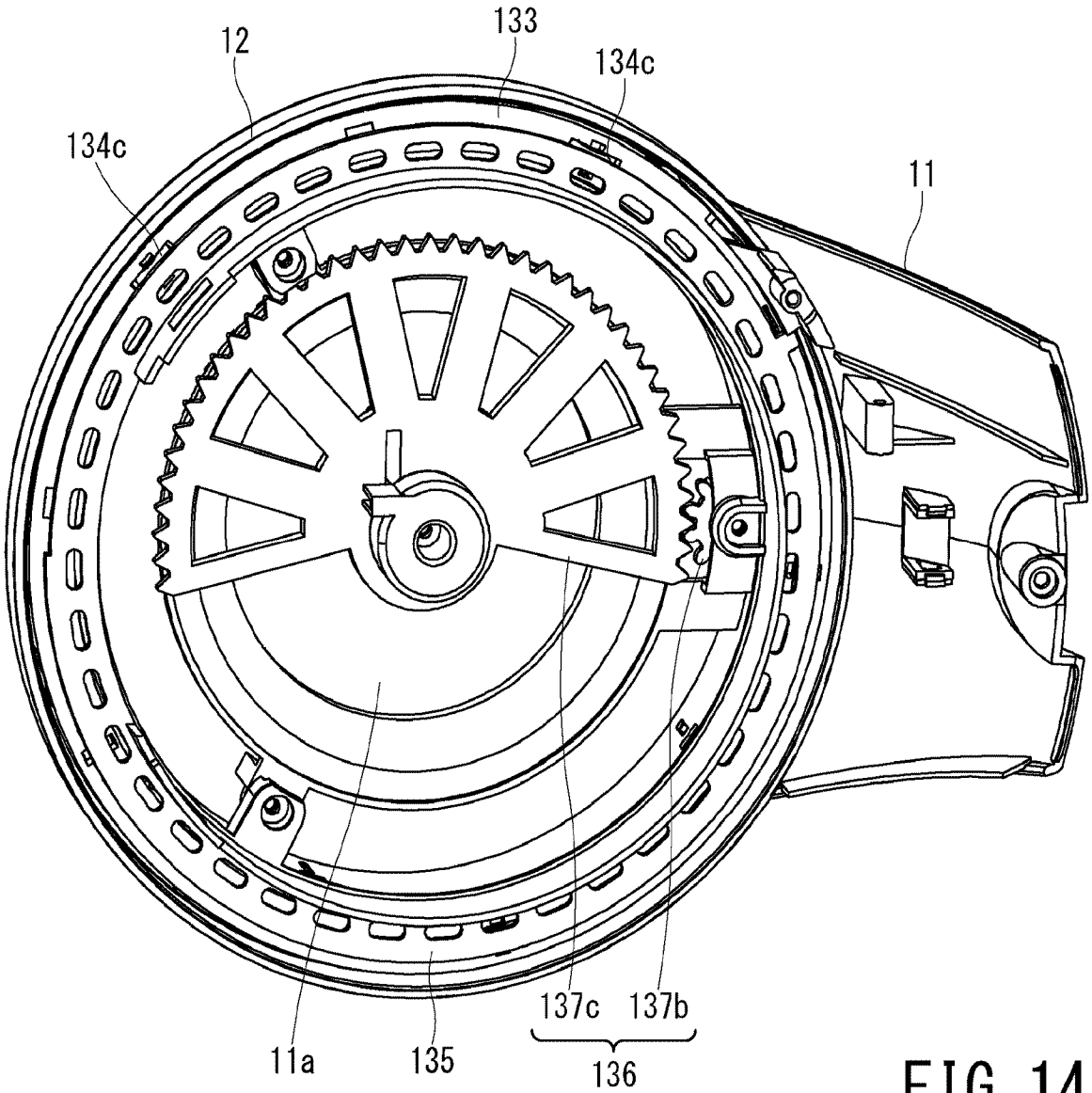
FIG. 14 is a perspective view of internal structure of a wheel and the body handle of the electric vacuum cleaner according to the embodiment of the present invention.

FIG. 14 is a perspective view of internal structure of the wheel and the body handle of the electric vacuum cleaner according to the embodiment of the present invention.

Figure 15:
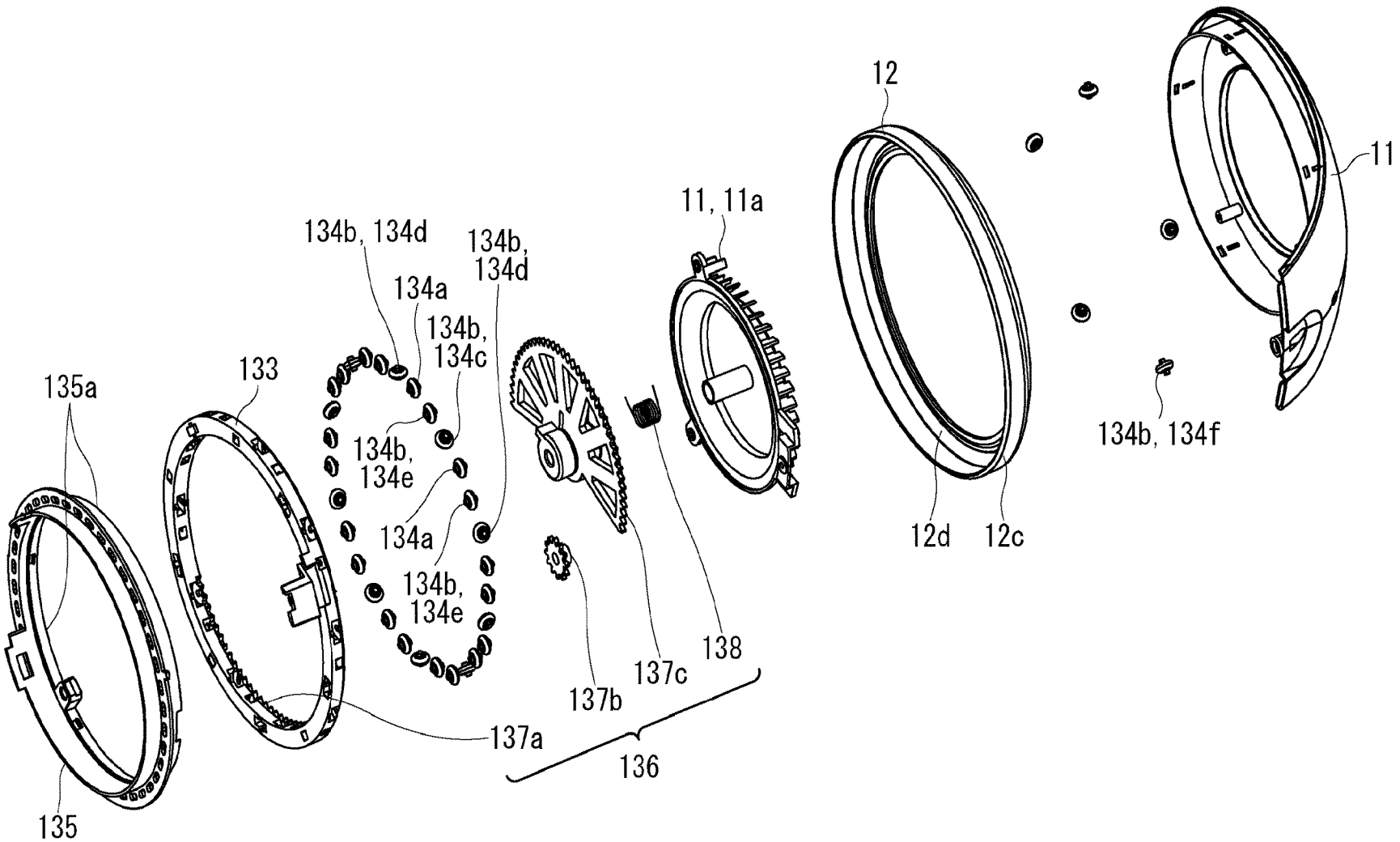
FIG. 15 is an exploded perspective view of the body handle and the wheel of the electric vacuum cleaner according to the embodiment of the present invention.

FIG. 15 is an exploded perspective view of the body handle and the wheel of the electric vacuum cleaner according to the embodiment of the present invention.

FIG. 16 to FIG. 19 are cross-sectional views of the body handle and the wheel of the electric vacuum cleaner according to the embodiment of the present invention.

As shown in FIG. 13 to FIG. 19, the electric vacuum cleaner 3 according to the present embodiment includes: the body housing 11; the wheels 12 for supporting the body housing 11; the body handle 14 provided on the body housing 11; and a pair of bases 133 integral with the body handle 14.

Each wheel 12 includes: an annular grounding wall 12*c* to be grounded on the surface to be cleaned; and a side wall 12*d* that is continuous with the grounding wall 12*c* and extends toward the rotation center of the wheel 12.

The body handle 14 is bridged between the right and left wheels 12 in an arch. When the body handle 14 is not in use, the body handle 14 is housed in a handle storage recess 11*b* provided on the front edge of the top face of the body housing 11 (FIG. 2). When being used, the body handle 14 is pulled out of the handle storage recess 11*b* and moves to the rear end of the body housing 11. The shape of the body handle 14 matches the shape of the front edge of the arcuate front half of the body housing 11. The body handle 14 reaches the rear end of the cleaner body 7 when being pulled out most. When the cleaner body 7 is placed on a horizontal plane, the body handle 14 can move rearward of the cleaner body 7 substantially passing directly above the cleaner body (FIG. 13).

Each base 133 is rotatably supported with the body housing 11. Each wheel 12 is rotatably supported with the corresponding base 133. That is, each wheel 12 is rotatably supported with the body housing 11 via the corresponding base 133. The rotation range of the bases 133 are restricted. Each base 133 rotates in a range where the body handle 14 reaches from the handle storage recess 11*b* of the body housing 11 to the rear end of the body housing 11.

The rotation centerline of the wheels 12 and the rotation centerline of the bases 133 are positioned substantially on the same line. In detail, the body handle 14 is accommodated in the handle storage recess 11*b* of the body housing 11 and is pulled out of the handle storage recess 11*b* by being moved to rotate around the rotation centerline of the wheels 12.

The wheels 12 and the bases 133 are annular. In order to make the primary dust container 13 insertable into and detachable from the dust container chamber 61 of the body housing 11 in the width direction of the cleaner body 7, the wheels 12 and the bases 133 have an inner diameter such that the primary dust container 13 can pass through each of the wheels 12 and the bases 133. The wheels 12 and bases 133 which are irreverent to attachment and detachment of the primary dust container 13, i.e., the left base 133 and the left wheel 12 of the body housing 7 in the present embodiment are not required to be annular.

Figure 16:
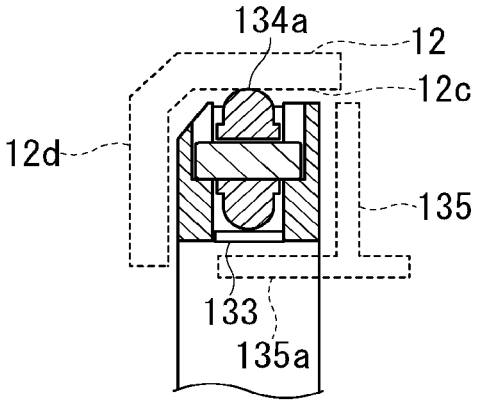
FIG. 16 is a cross-sectional view of the body handle and the wheel of the electric vacuum cleaner according to the embodiment of the present invention.
Figure 17:
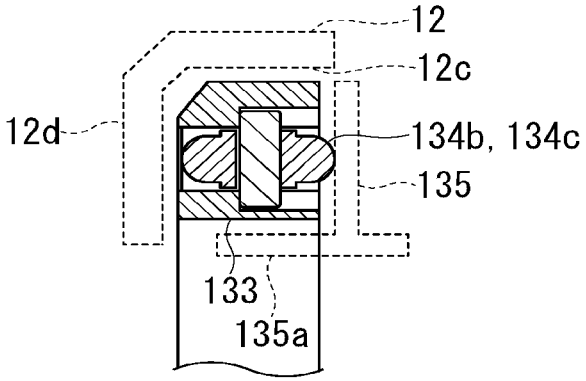
FIG. 17 is another cross-sectional view of the body handle and the wheel of the electric vacuum cleaner according to the embodiment of the present invention.

Each base 133 is provided with a plurality of first rollers 134*a* that rotatably support the corresponding wheel 12. The first rollers 134*a* are provided on the outer periphery of each base 133 (FIG. 16).

The electric vacuum cleaner 3 includes a plurality of second rollers 134*b* that are interposed between the body housing 11 and a pair of base support members 135, and rotatably support each base 133 and the corresponding wheel 12.

Figure 18:
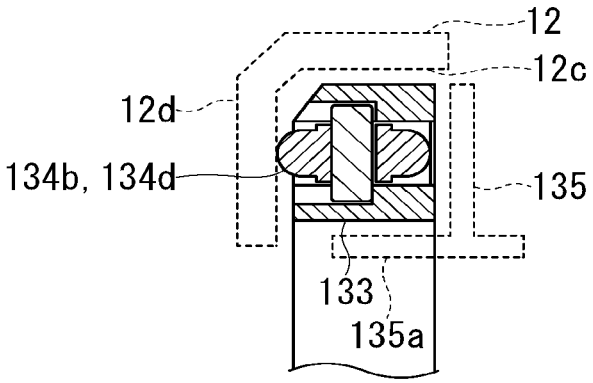
FIG. 18 is still another cross-sectional view of the body handle and the wheel of the electric vacuum cleaner according to the embodiment of the present invention.

The second rollers 134*b* include: third rollers 134*c* that are provided on one side of each base 133 and in contact with the corresponding base support member 135 (FIG. 17); and fourth rollers 134*d* that are provided on the other side of each base 133 and in contact with the side wall 12*d* of the corresponding wheel 12 (FIG. 18). The third rollers 134*c* and the fourth rollers 134*d* constrain the position of each base 133 in the rotation centerline direction. The third rollers 134*c* and the fourth rollers 134*d* are alternately arranged in the circumferential direction of each base 133.

Figure 19:
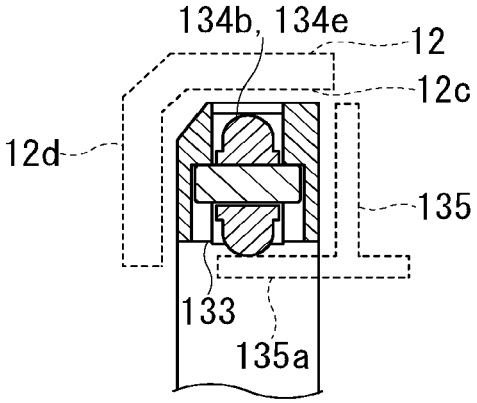
FIG. 19 is still another cross-sectional view of the body handle and the wheel of the electric vacuum cleaner according to the embodiment of the present invention.

The second rollers 134*b* further include a plurality of fifth rollers 134*e* that are provided on the inner periphery of each base 133 and in contact with the corresponding base support member 135 (FIG. 19).

The second rollers 134*b* further include a plurality of sixth rollers 134*f* that are provided on the body housing 11 and in contact with each wheel 12. The sixth rollers 134*f* and the fourth rollers 134*d* of each base 133 sandwich the side wall 12*d* of the corresponding wheel 12. The sixth rollers 134*f* prevent each wheel 12 from detaching from the corresponding base 133 in the rotation centerline direction. In other words, the fourth rollers 134*d* and the sixth rollers 134*f* constrain the position of each wheel 12 in the rotation centerline direction. The third rollers 134*c*, the fourth rollers 134*d*, and the sixth rollers 134*f* constrain the respective positions of each base 133 and the corresponding wheel 12 in the rotation centerline direction.

Each base support member 135 is annular similarly to the corresponding base 133. Each base support member 135 is fixed to the body housing 11. Each base support member 135 has a flange 135*a* that enters the inner periphery of the corresponding base 133 and is in contact with the fifth rollers 134*e*.

Each base support member 135 is in contact with the fifth rollers 134*e* (FIG. 19) and the third rollers 134*c* (FIG. 17) of the corresponding base 133, and the sixth rollers 134*f* of the body housing 11 are in contact with each wheel 12. The first rollers 134*a* (FIG. 16) of each base 133 and the fourth rollers 134*d* (FIG. 18) are in contact with the corresponding wheel 12. Each base support member 135 and the body housing 11 support the corresponding base 133, the body handle 14, and the corresponding wheel 12 all together.

Although each base support member 135 according to the present embodiment is disposed inside the body housing 11 and fixed to the body housing 11, the base support member 135 may be disposed outside the body housing 11. That is, the structure of each base 133, the body handle 14, and the rollers (first rollers, second rollers) supporting the corresponding wheel 12 may be disposed outside the body housing 11. In this case, each base support member 135 preferably serves as a lid of the roller structure.

The third rollers 134*c*, the fourth rollers 134*d*, and the fifth rollers 134*e* among the second rollers 134*b* and first rollers 134*a* are substantially equally spaced in the circumferential direction of each annular base 133. The third rollers 134*c*, the fourth rollers 134*d*, and the fifth rollers 134*e* among the second rollers 134*b* and the first rollers 134*a* are shifted from each other in position (or phase) with respect to the rotation centerline of each wheel 12 and the rotation centerline of the corresponding base 133. This shift contributes to reduction in dimensional difference between the inner diameter and the outer diameter of each base 133 and reduction in thickness dimension of each base 133 in the width direction of the cleaner body 7.

Figure 20:
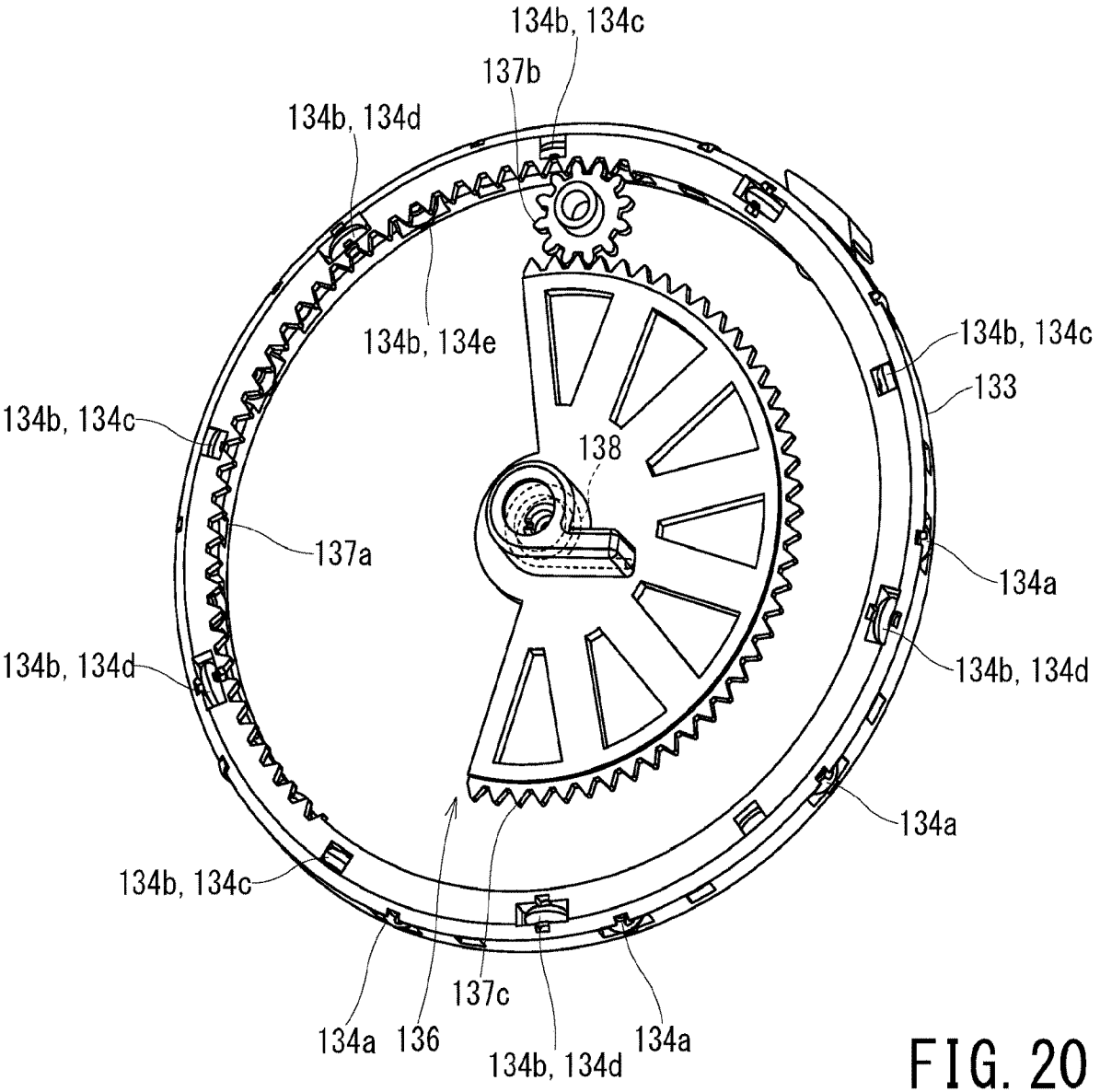
FIG. 20 is a perspective view of a handle return mechanism of the electric vacuum cleaner according to the embodiment of the present invention.

FIG. 20 is a perspective view of a handle return mechanism of the electric vacuum cleaner according to the embodiment of the present invention.

As shown in FIG. 20 in addition to FIG. 14 and FIG. 15, the electric vacuum cleaner 3 according to the present embodiment includes a handle return mechanism 136 that stores energy and consumes the stored energy to generate a force to store the body handle 14 when the body handle 14 is pulled up. The handle return mechanism 136 is disposed on the left side of the cleaner body 7 where the handle return mechanism 136 does not affect the attachment and detachment of the primary dust container 13.

The handle return mechanism 136 includes: a first gear 137*a* provided on the base 133; a second gear 137*b* rotatably supported by the body housing 11 and engaged with the first gear 137*a*; a third gear 137*c* rotatably supported by the body housing 11 and engaged with the second gear 137*b*; and a return spring 138 that stores energy by the rotation of the third gear 137*c*.

The first gear 137*a* is provided on the inner periphery of the base 133 where the first rollers 134*a* and the second rollers 134*b* are not provided. That is, the first gear 137*a* is a so-called internal gear. The first gear 137*a* is disposed so as to avoid the flange 135*a* that is in contact with the fifth rollers 134*e*. In other words, the first gear 137*a* and the fifth rollers 134*e* are provided side by side with each other on the inner circumference of the base 133.

The second gear 137*b* is smaller in diameter than the first gear 137*a* and the third gear 137*c*.

The third gear 137*c* is disposed inside the annular base 133. The rotation centerline of the third gear 137*c* is positioned substantially on the same line as the rotation centerline of the wheels 12 and the rotation centerline of the bases 133.

The return spring 138 is a so-called torsion spring. The return spring 138 stores energy by the rotation of the third gear 137*c*.

When the body handle 14 is pulled out from the handle storage recess 11*b* of the body housing 11 toward the rear end of the body housing 11, the handle return mechanism 136 rotates the first gear 137*a* that rotates integrally with the base 133, the second gear 137*b* that transmits the rotation of the first gear 137*a* to the third gear 137*c*, and the third gear 137*c* so as to store energy in the return spring 138. When the body handle 14 is not loaded, i.e., when a user does not apply force to the body handle 14, the handle return mechanism 136 consumes the energy stored with the return spring 138 to rotate the third gear 137*c* and thereby stores the body handle 14 into the handle storage recess 11*b* via the second gear 137*b* and the first gear 137*a*.

While the cleaner body 7 is being lifted, the cleaner body 7 is lowered in front by the weight of the dust collecting hose 22 and is in a forward bent position in which its back face is raised. Thus, the body handle 14 and the bases 133 move with respect to the cleaner body 7 while the user holds it and lifts the cleaner body 7. In other words, the cleaner body 7 swings with respect to the body handle 14 held by the user. Since the cleaner body 7 swings in such a manner, a user's stress that is generated by the force acting on the cleaner body 7 from the bending dust collection hose 22 by the operation on the tubular part 8 is alleviated.

Each wheel 12 and the corresponding base 133 may be individually instructed to be rotatable with the body housing 11.

When the primary dust container 13 is integrated with the body housing 11 or when the primary dust container 13 is detachable from the top or bottom of the body housing 11, the wheels 12 and the bases 133 may not be annularly shaped. In this case, the wheels 12 and the bases 133 may have a hub (not shown) at the center of rotation or may have a simple disk shape. The body housing 11 shown in FIG. 14 and FIG. 15 is the left side face of the cleaner body 7, and this left side face is not related to the attachment and detachment of the primary dust container 13. For this reason, as shown in FIG. 14 and FIG. 15, the body housing 11 is provided with an exhaust-port lid 11*a* that has a diffuser for the exhaust of the primary electric blower 15 to flow out.

Next, the station 2 according to the embodiment of the present invention will be described in detail.

Figure 21:
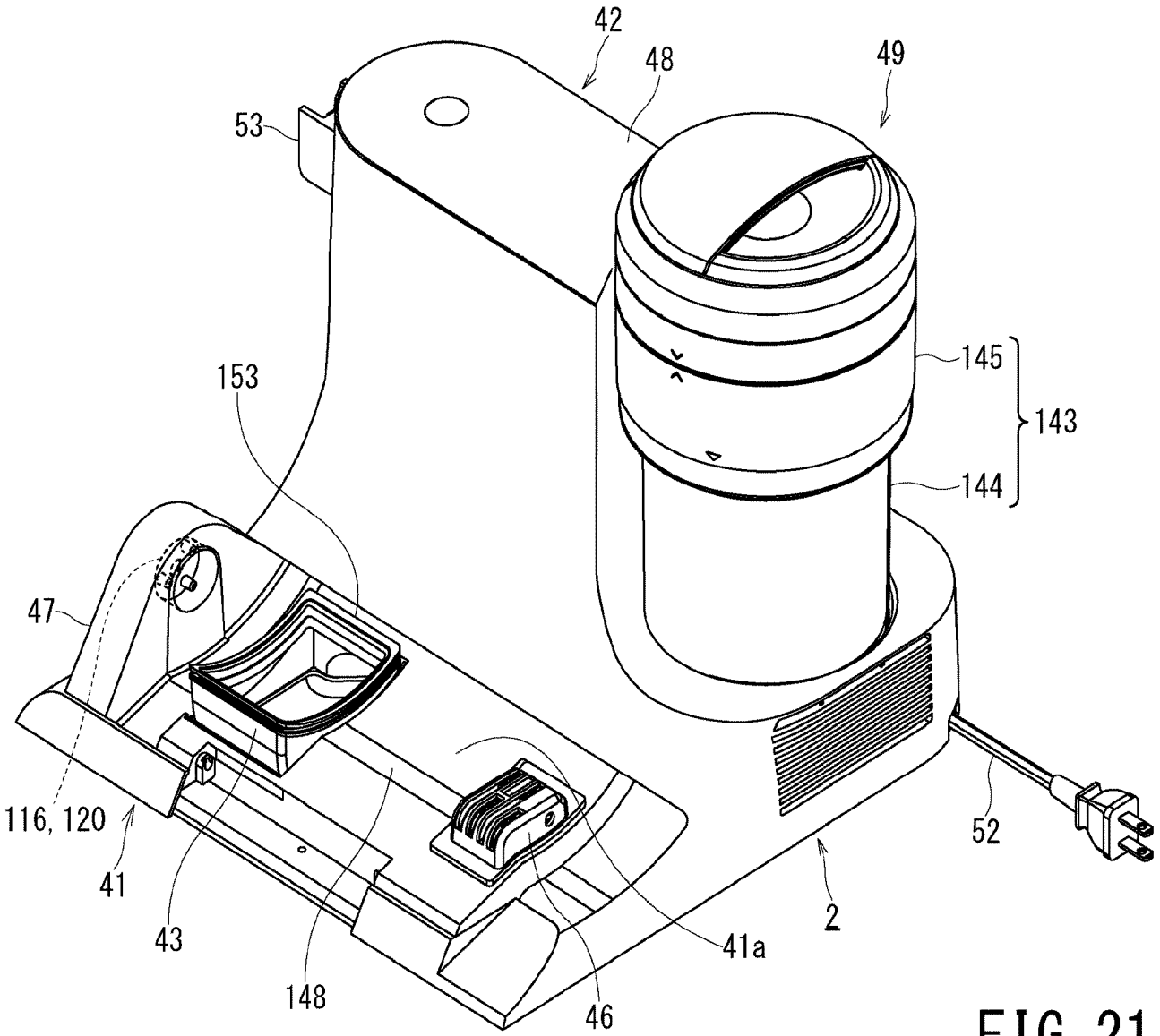
FIG. 21 is a perspective view of a station of the electric vacuum cleaner apparatus according to the embodiment of the present invention.
Figure 22:
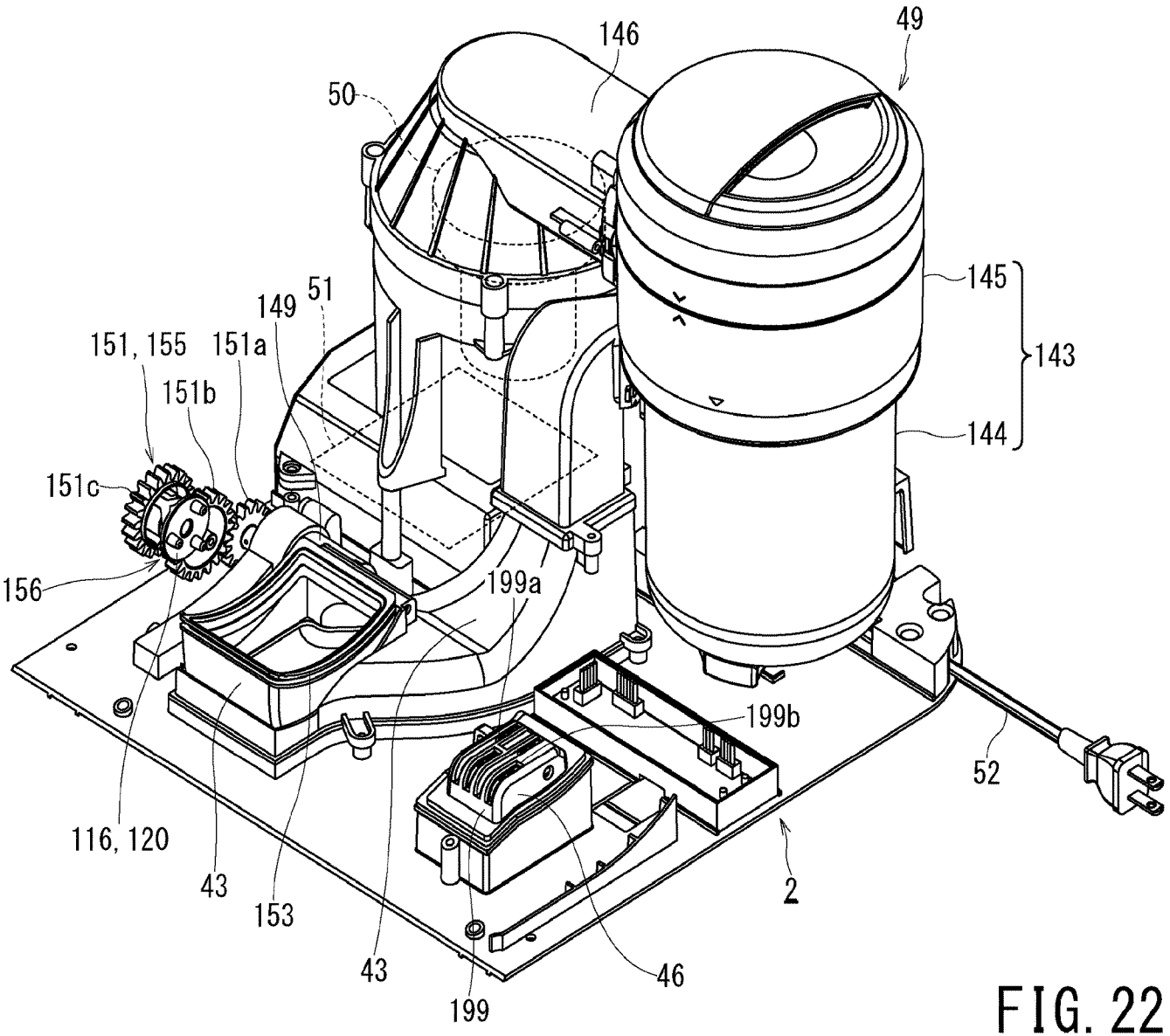
FIG. 22 is another perspective view of the station of the electric vacuum cleaner apparatus according to the embodiment of the present invention.

FIG. 21 and FIG. 22 are perspective views of the station of the electric vacuum cleaner apparatus according to the embodiment of the present invention.

FIG. 22 is the perspective view of the station 2 from which the top plate of the platform 41 and the housing 48 of the dust collection part 42 are detached.

As shown in FIG. 21 and FIG. 22, the secondary dust container 49 of the station 2 according to the present embodiment includes a centrifugal separation device 143 for centrifuging the dust, which flows in from the dust transfer tube 43, from the air. The centrifugal separation device 143 is a multistage type. The centrifugal separation device 143 includes: a first centrifugal separator 144 that centrifuges the dust, which flows in from the dust transfer tube 43, from the air; and a second centrifugal separator 145 that centrifuges the dust passing through the first centrifugal separator 144 from the air.

The first centrifugal separator 144 centrifuges coarse dust contained in the dust flowing into the secondary dust container 49. The second centrifugal separator 145 centrifuges fine dust passing through the first centrifugal separator 144. The coarse dust is dust with a large mass such as sand grain and fibrous dust including lint and cotton dust, and the fine dust is particulate or powdery dust with a small mass.

The secondary electric blower 50 is connected to the secondary dust container 49 via a downstream air duct 146. The secondary electric blower 50 acts the negative pressure to the primary dust container 13 through the downstream air duct 146, the secondary dust container 49, and the dust transfer tube 43 so as to transfer the dust accumulated in the primary dust container 13 to the secondary dust container 49 together with the air.

In addition, the station 2 includes: a coupling guide 148 provided on the platform 41; the drive source 149 for generating opening drive force and closing drive force of the waste-outlet lid 92 of the primary dust container 13 of the electric vacuum cleaner 3; and a power transmission mechanism 151 for transmitting the driving force from the drive source 149 to the electric vacuum cleaner 3.

When the cleaner body 7 is connected to the station 2, the coupling guide 148 leads the cleaner body 7 to the position where the charging terminals 46 of the station 2 is suitably connected (coupled) to the charging electrodes 19 of the cleaner body 7 and the dust transfer tube 43 is suitably connected to the waste outlet 91 of the cleaner body 7.

The storage configuration of the electric vacuum cleaner apparatus 1 is the configuration in which the cleaner body 7 is connected (coupled) to the station 2, the charging terminals 46 of the station 2 is suitably connected to the charging electrodes 19 of the cleaner body 7, and the dust transfer tube 43 is suitably connected to the waste outlet 91 of the cleaner body 7.

The coupling guide 148 is recessed so as to conform to the shape of the rear end of the body housing 11 of the cleaner body 7. That is, the coupling guide 148 fits in the cylindrical rear half of the body housing 11 and is recessed in an arc shape in a side view of the station 2. Since the cleaner body 7 is putted down from above the platform 41 and connected (coupled) to the station 2, the coupling guide 148 conforming to the shape of the rear end of the cleaner body 7 ensures the positioning of the cleaner body 7 in the storage configuration of the electric vacuum cleaner apparatus 1.

The charging terminals 46 and the inlet of the dust transfer tube 43 are disposed in the coupling guide 148. The inlet of the dust transfer tube 43 is provided with a seal member 153 that seals the connection portion between the dust transfer tube 43 and the electric vacuum cleaner 3, i.e., the connection portion between the dust transfer tube 43 and the primary dust container 13.

The drive source 149 is, for example, an electric motor. The drive source 149 is electrically connected to the station controller 51. The drive source 149 is controlled with the station controller 51 in a manner similar to the secondary electric blower 50.

The drive source 149 generates the opening drive force and the closing drive force of the suction-port lid 94 of the electric vacuum cleaner 3. The drive source 149 generates the driving force of the dust-removal mechanism 95 of the electric vacuum cleaner 3. That is, the drive source 149 generates the driving force of the waste-outlet lid 92, the suction-port lid 94, and the dust-removal mechanism 95. In other words, the drive source 149 generates the driving force of the driven mechanism 114. The drive source 149 is provided between the inlet of the dust transfer tube 43 and the dust collection part 42. The drive source 149 generates the driving force of the dust compression mechanism 97 of the electric vacuum cleaner 3.

The power transmission mechanism 151 is an appropriate mechanism for transmitting the power of the drive source 149 from the drive source 149, i.e., from the output shaft of the electric motor to the centerline of the driven part 115 of the cleaner body 7 in the storage configuration of the electric vacuum cleaner apparatus 1. The power transmission mechanism 151 according to the present embodiment includes: a plurality of, for example, three gears 151*a*, 151*b*, and 151*c* that are meshed sequentially; and a gear box (not shown) that rotatably supports and accommodates these gears 151*a*, 151*b*, and 151*c*. The power transmission mechanism 151 may be a mechanism combining pulleys and a belt or be a mechanism combining sprockets and a chain.

Next, a description will be given of a power transmission passage for transmitting the driving force of the drive source 149 from the station 2 to the cleaner body 7.

Figure 23:
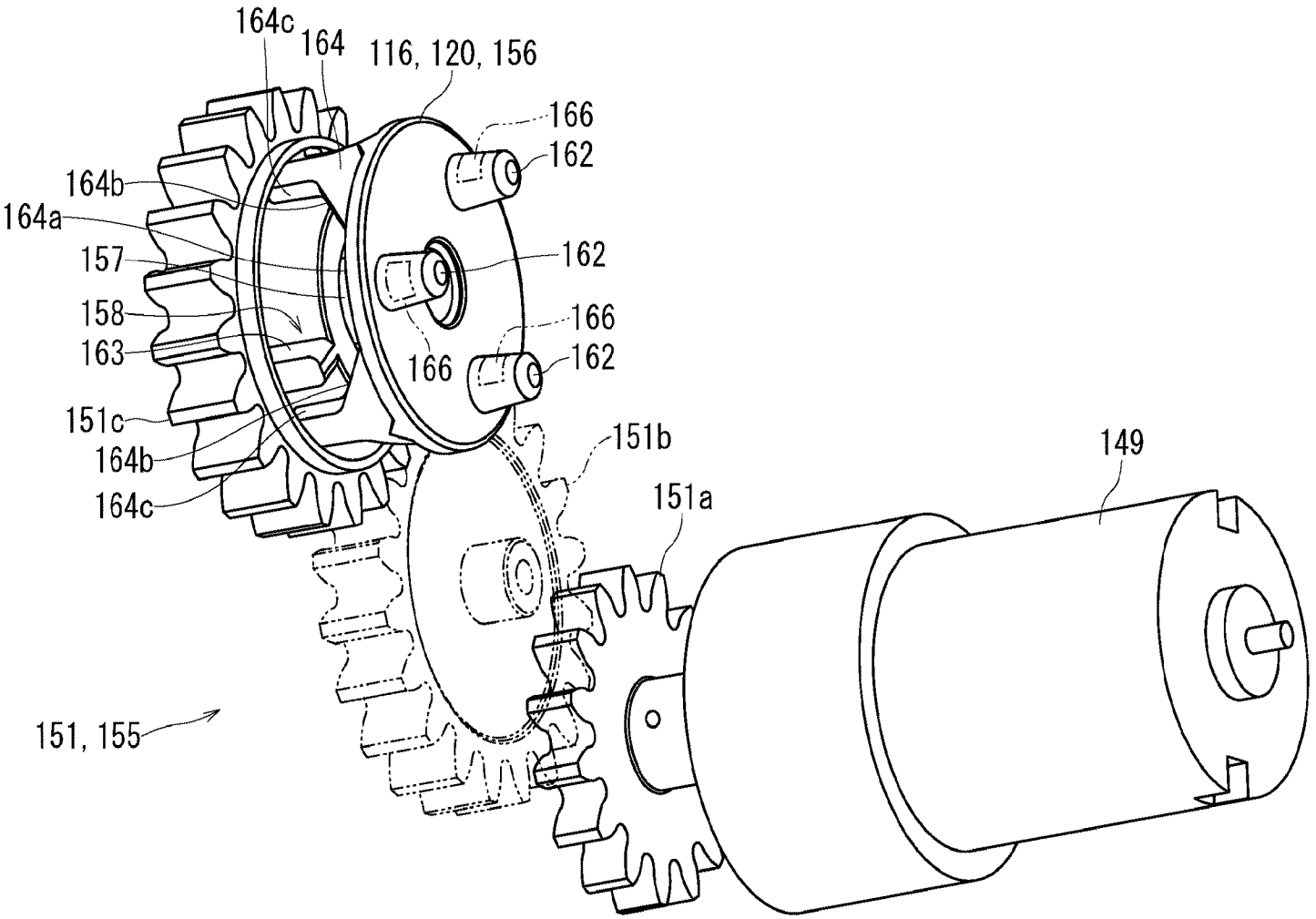
FIG. 23 is a perspective view of a power transmission passage of the electric vacuum cleaner apparatus according to the embodiment of the present invention.

FIG. 23 is a perspective view of the power transmission passage of the electric vacuum cleaner apparatus according to the embodiment of the present invention.

Only the station 2 side of the power transmission passage 155, that is the power transmission mechanism 151, is shown in FIG. 23.

As shown in FIG. 23 in addition to FIG. 9 and FIG. 22, the electric vacuum cleaner apparatus 1 according to the present embodiment includes: the power transmission passage 155 that transmits the driving force from the drive source 149 of the station 2 to the waste-outlet lid 92 of the cleaner body 7; and a coupler 156 that connects (couples) and disconnects (decouples) the power transmission passage 155 between the station 2 and the electric vacuum cleaner 3.

The power transmission passage 155 includes: the power transmission mechanism 96 on the side of the electric vacuum cleaner 3; and the power transmission mechanism 151 on the side of the station 2. The coupler 156 causes the power transmission passage 155 to function by coupling the power transmission mechanism 96 on the side of the electric vacuum cleaner 3 to the power transmission mechanism 151 on the side of the station 2. The power transmission passage 155 transmits the driving force from the drive source 149 on the side of the station 2 to the driven mechanism 114 on the side of the electric vacuum cleaner 3 (i.e., to the dust-removal mechanism 95, the waste-outlet lid 92, and the suction-port lid 94).

The power transmission mechanism 151 and the coupler 156 excluding the driven part 115 of the cleaner body 7 are covered with the bulge 47 of the platform 41. Until the electric vacuum cleaner 3 is connected to the station 2, the coupler 156 is in a retracted position where contact with the electric vacuum cleaner 3 can be avoided. When the electric vacuum cleaner 3 is connected to the station 2, the coupler 156 moves to a coupling position where the driving force of the drive source 149 can be transmitted to the electric vacuum cleaner 3. The bulge 47 accommodates the driving part 116 such that the driving part 116 can appear and hide.

The coupler 156 includes: the shaft coupling 120; a drive source that generates power for disconnecting (decoupling) the shaft coupling 120 (for example, a disconnecting spring 157); and a cam mechanism 158 that connects (couples) the shaft coupling 120 by the driving force to be generated with the drive source 149. The coupler 156 connects (couples) the shaft coupling 120 by the driving force of the drive source 149, and disconnects (decouples) the shaft coupling 120 by the spring force of the disconnecting spring 157.

The shaft coupling 120 is a so-called dog clutch or a coupling. The shaft coupling 120 includes the driven part 115 provided with the power transmission mechanism 96 of the electric vacuum cleaner 3; and the driving part 116 provided with the power transmission mechanism 151 of the station 2.

The driven part 115 includes a plurality of arc-shaped grooves 161 that are circularly arranged. The driving part 116 includes a plurality of pins 162 that are circularly arranged. Each of the pins 162 has a diameter by which each pin 162 can be inserted into and removed from any arc-shaped groove 161. Each pin 162 is preferably tapered to facilitate insertion into any arc-shaped groove 161.

The driving part 116 continuingly rotates by the driving force transmitted from the power transmission mechanism 151. When the shaft coupling 120 is engaged, the driven part 115 rotates together with the driving part 116. The driving part 116 protrudes from the bulge 47 of the station 2 so as to be coupled to the driven part 115. The driving part 116 protrudes from the bulge 47 disposed on the side of the cleaner body 7 in the width direction of the cleaner body 7 so as to be coupled to the driven part 115. In other words, when the cleaner body 7 is detached from the station 2 and when the cleaner body 7 is returned to the station 2, the coupler 156 couples and decouples the shaft coupling 120 by bringing the driving part 116 into and out of the bulge 47 in the moving direction of the cleaner body 7, i.e., in the direction intersecting with the vertical direction. That is, the moving direction of the electric vacuum cleaner 3 at the time of attaching the electric vacuum cleaner 3 to the station 2 crosses the direction in which the coupler 156 moves between the retracted position and the coupling position. Accordingly, the coupler 156 can prevent, for example, dust from intruding into the station 2 from the gap between the bulge 47 and the driving part 116, so as to ensure satisfactory operation of the power transmission mechanism 151.

The driving part 116 is not limited to the embodiment that protrudes from the bulge 47 in the width direction of the cleaner body 7 and is coupled to the driven part 115. The driving part 116 may be provided on the coupling guide 148, protrude from the connection guide part 148, and be coupled to the driven part 115 at the same time as the cleaner body 7 is connected to the station 2 (as indicated by the dotted line with the reference sign 116 in FIG. 21). Further, the driving part 116 may be disposed in the dust collection part 42 and protruded in front of the station 2 so as to be coupled to the driven part 115 (as indicated by the dotted line with the reference sign 116 in FIG. 21).

The disconnecting spring 157 pulls the driving part 116 in the direction by which the shaft coupling 120 is disconnected, i.e., in the direction to be separated away from the driven part 115. In other words, the disconnecting spring 157 pulls in the driving part 116 in the direction to be buried in the bulge 47.

The cam mechanism 158 is provided on the side of the station 2. The cam mechanism 158 is a so-called face cam. The cam mechanism 158 converts the rotational motion of the power transmission mechanism 151 into the linear motion of the driving part 116, i.e., into the motion in which the driving part 116 appears from and hides into the bulge 47. As the linear motion of the driving part 116 progresses appropriately, the cam mechanism 158 causes the driving part 116 to rotate. The cam mechanism 158 includes a driving member 163 to be rotated by the power transmission mechanism 151 and a driven member 164 provided on the driving part 116. The driven member 164 includes a first cam face 164*a*, second cam faces 164*b*, and third cam faces 164*c*. The first cam face 164*a* is the closest to the shaft 162 of the driving part 116 and extends in the circumferential direction of the driving part 116, i.e., in the direction perpendicular to the rotation centerline of the driving part 116. Each second cam face 164*b* is inclined with respect to the rotation centerline of the driving part 116 and extends in the direction opposite to the shaft 162 of the driving part 116. Each third cam face 164*c* is a continuation from the top of one of the second cam faces 164*b* and extends in the direction away from the first cam face 164*a*. Each third cam face 164*c* extends substantially parallel to the rotation centerline of the driving part 116. The driving member 163 is shaped to be in line contact with the first cam face 164*a* and the second cam surfaces 164*b* and to be in surface contact with the third cam surfaces 164*c*.

When the coupler 156 is disconnected (decoupled), the coupler 156 brings the driving member 163 into contact with the first cam face 164*a* of the driven member 164 of the cam mechanism 158, or brings the driving member 163 the closest to the first cam face 164*a*. In this state, the driving part 116 gets into the bulge 47 of the station 2 the most and is hidden. When the drive source 149 starts up, the driving member 163 rotates together with the gear 151*c* of the power transmission mechanism 151. The rotating driving member 163 moves the first cam face 164*a* of the driven member 164, approaches the second cam faces 164*b*, and eventually rides on the second cam faces 164*b*. At this time, the driving part 116 is pushed out of the bulge 47 by the force of the driving member 163 that pushes the second cam faces 164*b*, and is engaged with the driven part 115. As the rotation of the driving part 116 progresses and the driving member 163 comes into surface contact with the third cam faces 164*c*, the entirety of the coupler 156 rotates in synchronization with the driving member 163.

The driving part 116 is pulled into the bulge 47 by the spring force of the disconnecting spring 157. This spring force generates appropriate frictional force between the driving member 163 and the driven member 164, and reliably causes the driving member 163 to ride on the second cam faces 164*b* of the driven member 164.

When the driven part 115 of the cleaner body 7 is viewed from the driving part 116 of the station 2, the cam mechanism 158 has the second cam face 164*b* and the third cam surface 164*c* in each of the clockwise direction (i.e., normal rotation direction of the driving part 116) and the counter-clockwise direction (i.e., reverse rotation direction of the driving part 116). In other words, the cam mechanism 158 has a pair of second cam faces 164*b* sandwiching the first cam face 164*a* between them, and also has a pair of third cam faces 164*c* sandwiching the first cam face 164*a* between them.

For example, it is assumed that the power transmission passage 155 opens the waste-outlet lid 92 and the suction-port lid 94 by rotating the driving part 116 in the normal rotation direction and closes the waste-outlet lid 92 and the suction-port lid 94 by rotating the driving part 116 in the reverse rotation direction. One of the second cam faces 164*b* and one of the third cam faces 164*c* establish the engagement of the coupler 156 along with the normal rotation of the driving part 116 so as to open the waste-outlet lid 92 and the suction-port lid 94. The other of the second cam faces 164*b* and the other of the third cam faces 164*c* establish the engagement of the coupler 156 along with the reverse rotation of the driving part 116 so as to close the waste-outlet lid 92 and the suction-port lid 94.

The coupler 156 may be provided with charging terminals 166 that supply power from the station 2 to the rechargeable battery 17 so as to charge the rechargeable battery 17. Instead of the charging terminals 46 provided on the platform 41, the charging terminals 166 charge the rechargeable battery 17. The charging terminals 166 are provided on both the driven part 115 of the cleaner body 7 and the driving part 116 of the station 2. The charging terminals 166 are electrically connected when the coupler 156 is coupled, i.e., when the driving part 116 of the station 2 is coupled to the driven part 115 of the cleaner body 7.

Figure 24:
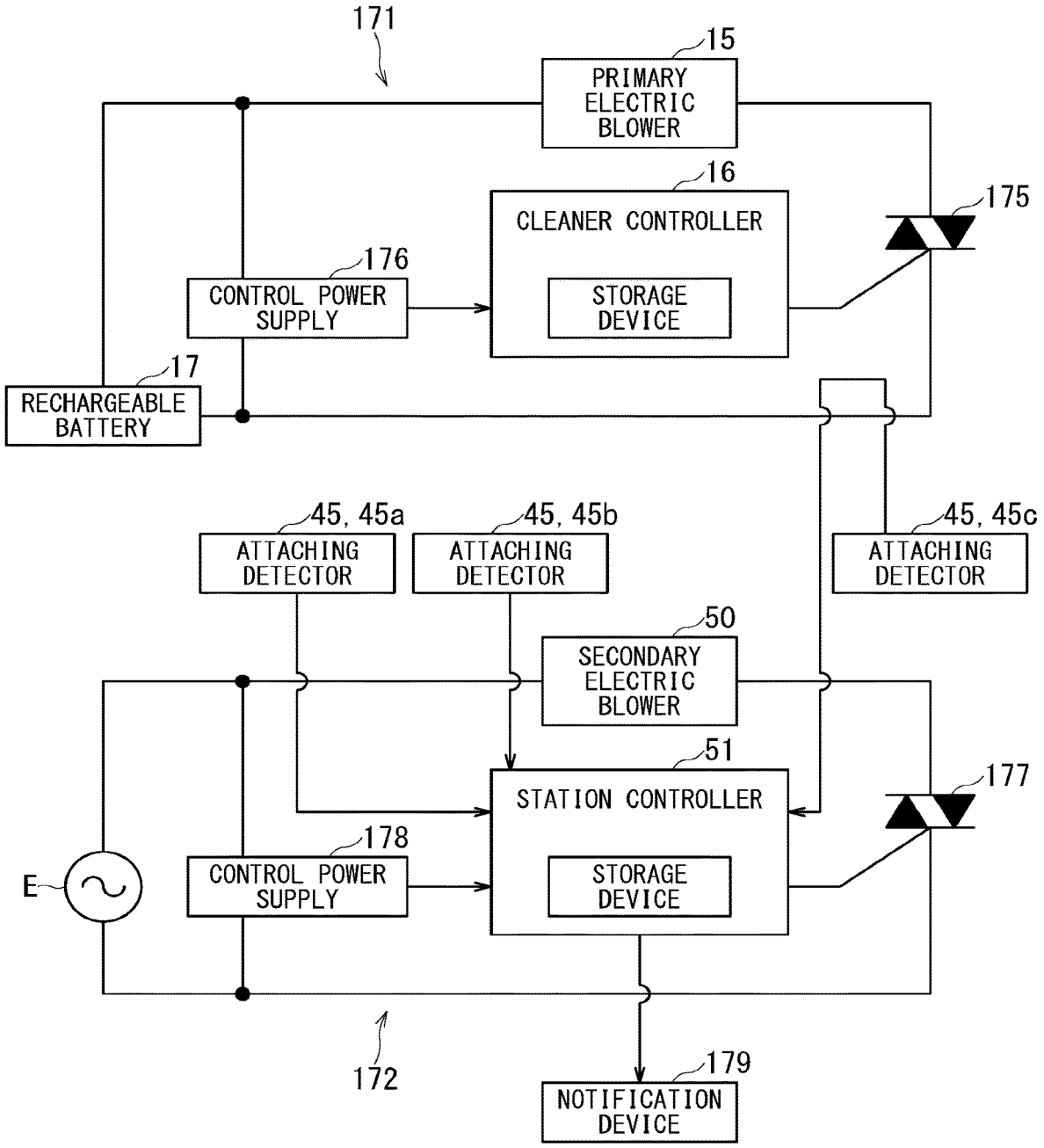
FIG. 24 is a block diagram of the electric vacuum cleaner apparatus according to the embodiment of the present invention.

FIG. 24 is a block diagram of the electric vacuum cleaner apparatus according to the embodiment of the present invention.

As shown in FIG. 24, the electric vacuum cleaner apparatus 1 according to the present embodiment includes: a control circuit 171 on the side of the electric vacuum cleaner 3; and a control circuit 172 on the side of the station 2.

The control circuit 171 on the side of the electric vacuum cleaner 3 controls the operation of the primary electric blower 15 exclusively. The control circuit 171 on side of the electric vacuum cleaner 3 is provided with: the primary electric blower 15 to be connected in series with the rechargeable battery 17; a switching element 175 that opens and closes an electric path connecting the rechargeable battery 17 to the primary electric blower 15; a control power supply 176 that converts the voltage of the rechargeable battery 17 and supplies power to the cleaner controller 16; and the cleaner controller 16 configured to control the operation of the primary electric blower 15.

The switching element 175 includes a gate that is connected to the cleaner controller 16. The switching element 175 controls the input of the primary electric blower 15 depending on change in the gate current.

The control power supply 176 is a power supply circuit that generates control power of the cleaner controller 16.

The control circuit 172 on the side of the station 2 controls the operation of the secondary electric blower 50 exclusively. The control circuit 172 on the side of the station 2 is provided with: the secondary electric blower 50 to be connected in series with a commercial AC power supply E; a switching element 177 that opens and closes an electric path connecting the secondary electric blower 50 to the commercial AC power supply E; a control power supply 178 that converts the power from the commercial AC power supply E and supplies the converted power to the station controller 51; the attaching detectors 45 configured to detect that the electric vacuum cleaner 3 is attached to the station 2; the station controller 51 configured to control the operation of the secondary electric blower 50; and a notification device 179 to be connected to the station controller 51. The control circuit 172 on the side of the station 2 further includes a charging circuit (not shown) for charging the rechargeable battery 17 of the electric vacuum cleaner 3.

The switching element 177 is an element such as a bidirectional thyristor or a reverse blocking three-terminal thyristor. The switching element 177 includes a gate that is connected to the station controller 51. The switching element 177 controls the input of the secondary electric blower 50 depending on change in the gate current.

The control power supply 178 is a power supply circuit that generates control power of the station controller 51.

The attaching detectors 45 are desirably connected to the control circuit 172 in such a manner that the attaching detectors 45 open an electric path when a detection target is in the storage state and close the electric path when the detection target is not in the storage state (i.e., when the detection target is in use).

That is, when the electric vacuum cleaner 3 is connected to the station 2 (i.e., when the electric vacuum cleaner 3 is attached to the station 2) or when the electric vacuum cleaner 3 is placed on the platform 41, the first attaching detector 45*a* opens the electric path. When the electric vacuum cleaner 3 is disconnected from the station 2 (i.e., when the electric vacuum cleaner 3 is separated from the station 2) or when the electric vacuum cleaner 3 is separated from the platform 41, the first attaching detector 45*a* closes the electrical path. The second attaching detector 45*b* opens the electric path when the tubular part 8 of the electric vacuum cleaner 3 is attached to the station 2. The second attaching detector 45*b* closes the electric path when the tubular part 8 of the electric vacuum cleaner 3 is separated from the station 2. The same applies to the case where the hose attachment 53 is provided on the cleaner body 7. In this case, the electric path to be opened or closed by the second attaching detector 45*b* is included in the control circuit 171 on the side of the electric vacuum cleaner 3.

When at least two attaching detectors 45 among the plurality of attaching detectors 45 detect that the electric vacuum cleaner 3 is attached to the station 2, the station controller 51 permits transfer of dust from the primary dust container 13 to the secondary dust container 49. After a predetermined delay time elapses from the permission of the transfer of dust (i.e., after a predetermined delay time elapses since at least two attaching detectors 45 among the plurality of attaching detectors 45 have detected a attaching of the electric vacuum cleaner 3 to the station 2), the station controller 51 starts up the secondary electric blower 50 to start the transfer of dust.

The attaching detectors 45 may include a third attaching detector 45*c* configured to detect whether the body handle 14 of the electric vacuum cleaner 3 is in the storage position. The attaching detectors 45 may include the third attaching detector 45*c* in addition to the first attaching detector 45*a* and the second attaching detector 45*b*. The attaching detectors 45 may include the third attaching detector 45*c* instead of the second attaching detector 45*b*. In the case where the attaching detectors 45 include the first to third attaching detectors 45*a*, 45*b*, and 45*c*, the station controller 51 may be configured to permit the transfer of dust from the primary dust container 13 to the secondary dust container 49 when all the three attaching detectors 45 have detected the attaching of the electric vacuum cleaner 3 to the station 2. The station controller 51 may be configured to permit the transfer of dust from the primary dust container 13 to the secondary dust container 49 when two out of the three attaching detectors 45 (i.e., the pair of the first attaching detector 45*a* and the second attaching detector 45*b*, the pair of the first attaching detector 45*a* and the third attaching detector 45*c*, or the pair of the second attaching detector 45*b* and the third attaching detector 45*c*) have detected the attaching of the electric vacuum cleaner 3 to the station 2. The station controller 51 may be configured to permit the transfer of dust from the primary dust container 13 to the secondary dust container 49 when the first attaching detector 45*a* and one of the second attaching detector 45*b* and the third attaching detector 45*c* have detected the attaching of the electric vacuum cleaner 3 to the station 2.

The body handle 14 is movable between the use position and the storage position. The storage position of the body handle 14 is the position when the body handle 14 is accommodated in the handle storage recess 11*b* of the body housing 11. The use position of the body handle 14 is the position when the body handle 14 is pulled out of the handle storage recess 11*b* of the body housing 11.

Within a predetermined time after at least one of the attaching detectors 45 detects that the electric vacuum cleaner 3 is attached to the station 2, when at least one of the other attaching detectors 45 does not detect the attaching of the electric vacuum cleaner 3 to station 2, the notification device 179 performs notification. In other words, when at least one attaching detector 45 does not detect the attaching of the electric vacuum cleaner 3 to the station 2 within the predetermined time after at least one of the other attaching detectors 45 detects the attaching of the electric vacuum cleaner 3 to the station 2, the notification device 179 notifies a user that the mounting state of the electric vacuum cleaner 3 mounted on the station 2 is incomplete. In some embodiments, the notification device 179 may be a component appealing to the vision of the user of the electric vacuum cleaner apparatus 1, such as a display configured to display information by using characters, a lighting or blinking lamp, and an LED (Light Emitting Diodes), a component appealing to the hearing of the user of the electric vacuum cleaner apparatus 1, such as a sound generator configured to emit electrically synthesized voice or buzzer sound, and a component appealing the haptic sense of the user of the electric vacuum cleaner apparatus 1, such as a vibrator.

The cleaner body 7 is connected to the station 2 and thereby the electric vacuum cleaner apparatus 1 shifts to the storage configuration. Then, the charging electrodes 19 of the cleaner body 7 are brought into contact with the charging terminals 46 of the station 2 and are electrically connected to the charging terminals 46. The inlet of the dust transfer tube 43 adheres to the outer surface of the container body 78 of the primary dust container 13 through the body-housing waste-outlet 99 of the cleaner body 7.

The station controller 51 detects that the cleaner body 7 is connected to the station 2, on the basis of the detection results of the attaching detectors 45. When at least two attaching detectors 45 among the plurality of attaching detectors 45 have detected a connecting of the cleaner body 7 to the station 2, the station controller 51 starts the drive source 149 after the elapse of the predetermined delay time. When the drive source 149 starts, the driving part 116 of the station 2 protrudes from the bulge 47 and is coupled to the driven part 115 of the cleaner body 7. That is, the coupler 156 is coupled. The station controller 51 continues driving the drive source 149 even after the coupler 156 is coupled. The power transmission passage 155, in which the coupler 156 is coupled, distributes and transmits the driving force of the drive source 149 to the waste-outlet lid 92, the suction-port lid 94, and the dust-removal mechanism 95.

The driving force transmitted from the power transmission passage 155 fully opens the waste-outlet lid 92 and the suction-port lid 94. That is, when the electric vacuum cleaner 3 is stored in the station 2, the secondary dust container 49 is fluidly connected to the primary dust container 13 through the waste outlet 91 and the dust transfer tube 43.

The dust-removal mechanism 95 removes fine dust attached to the filters 86 and 87 by the driving force transmitted through the power transmission passage 155. The station controller 51 temporarily stops the drive source 149 after continuously operating the drive source 149 for an appropriate period of time for causing the dust-removal mechanism 95 to remove the dust attached to the filters 86 and 87, for example, for 10 seconds.

Next, the secondary electric blower 50 generates negative pressure after the drive source 149 fully opens the waste-outlet lid 92 and the suction-port lid 94. The station controller 51 starts up the secondary electric blower 50. The started secondary electric blower 50 sucks in air from the secondary dust container 49 so as to generate the negative pressure. That is, the secondary electric blower 50 acts the negative pressure to the secondary dust container 49 after the drive source 149 opens the waste-outlet lid 92. The secondary electric blower 50 acts the negative pressure to the secondary dust container 49 after the drive source 149 opens the suction-port lid 94. The secondary electric blower 50 acts the negative pressure to the secondary dust container 49 after the drive source 149 drives the dust-removal mechanism 95.

The negative pressure acting on the secondary dust container 49 acts on the primary dust container 13 through the dust transfer tube 43 and the waste outlet 91. Then, the primary dust container 13 sucks in air from the suction port 93. And then, air is also drawn from the connection port 18. The air sucked into the primary dust container 13 causes the coarse dust in the coarse-dust collecting chamber 71 to flow out of the coarse-dust waste-outlet 101 to the dust transfer tube 43, and causes the fine dust in the filter chamber 72 to flow out of the fine-dust waste-outlet 102 to the dust transfer tube 43. The dust (in which the coarse dust and the fine dust are mixed) flowing into the dust transfer tube 43 is sucked into the secondary dust container 49 through the dust transfer tube 43.

The first centrifugal separator 144 of the secondary dust container 49 separates and accumulates the coarse dust from the dust that has flowed in from the dust transfer tube 43. The second centrifugal separator 145 separates and accumulates the fine dust passing through the first centrifugal separator 144.

The station controller 51 operates the secondary electric blower 50 for an appropriate duration (for example, 10 seconds) so as to transfer substantially all the dust accumulated in the primary dust container 13 to the secondary dust container 49, and then stops the secondary electric blower 50. The station controller 51 reverses the temporarily stopped drive source 149 when the secondary electric blower 50 stops and the inside of the secondary dust container 49 returns to a positive pressure (i.e., atmospheric pressure). When the drive source 149 starts to reverse, the driving part 116 of the station 2 is separated from the driven part 115 of the cleaner body 7 and is once pulled into the bulge 47. That is, the coupling of the coupler 156 is temporarily decoupled. The station controller 51 continues the reversal of the drive source 149. When the reversal of the drive source 149 continues, the driving part 116 of the station 2 protrudes again from the bulge 47 and is coupled to the driven part 115 of the cleaner body 7. That is, the coupler 156 is coupled. The station controller 51 continues the operation of the drive source 149. The power transmission passage 155, in which the coupler 156 is coupled, distributes and transmits the driving force of the drive source 149 to the waste-outlet lid 92, the suction-port lid 94, and the dust-removal mechanism 95.

The driving force transmitted from the power transmission passage 155 fully closes the waste-outlet lid 92 and the suction-port lid 94. Although the dust removal mechanism 95 is also operated at this time by the driving force transmitted from the power transmission passage 155, the fine dust attached to the filters 86 and 87 has already been removed and thus the dust removal mechanism 95 does not substantially contribute to dust-removal. The station controller 51 continuously reverses the drive source 149 for an appropriate period (for example, 3 seconds) in which the waste-outlet lid 92 and the suction-port lid 94 are fully closed.

Then, the station controller 51 temporarily stops the drive source 149 after the waste-outlet lid 92 and the suction-port lid 94 are fully closed. Afterward, the station controller 51 rotates the drive source 149 in the normal direction again. When the drive source 149 starts to rotate in the normal direction, the driving part 116 of the station 2 is separated from the driven part 115 of the cleaner body 7 and is once pulled into the bulge 47. That is, the coupler 156 is decoupled again. The station controller 51 stops the drive source 149 after the driving part 116 of the station 2 is pulled into the bulge 47. In other words, the coupler 156 moves to the retracted position when the driven mechanism 114 (i.e., the dust-removal mechanism 95, the waste-outlet lid 92, and the suction-port lid 94) is operated.

Next, a description will be given of the handle 56 of the electric vacuum cleaner 3, the platform 41 of the station 2, and the speed reducer 44 according to the present embodiment.

Figure 25:
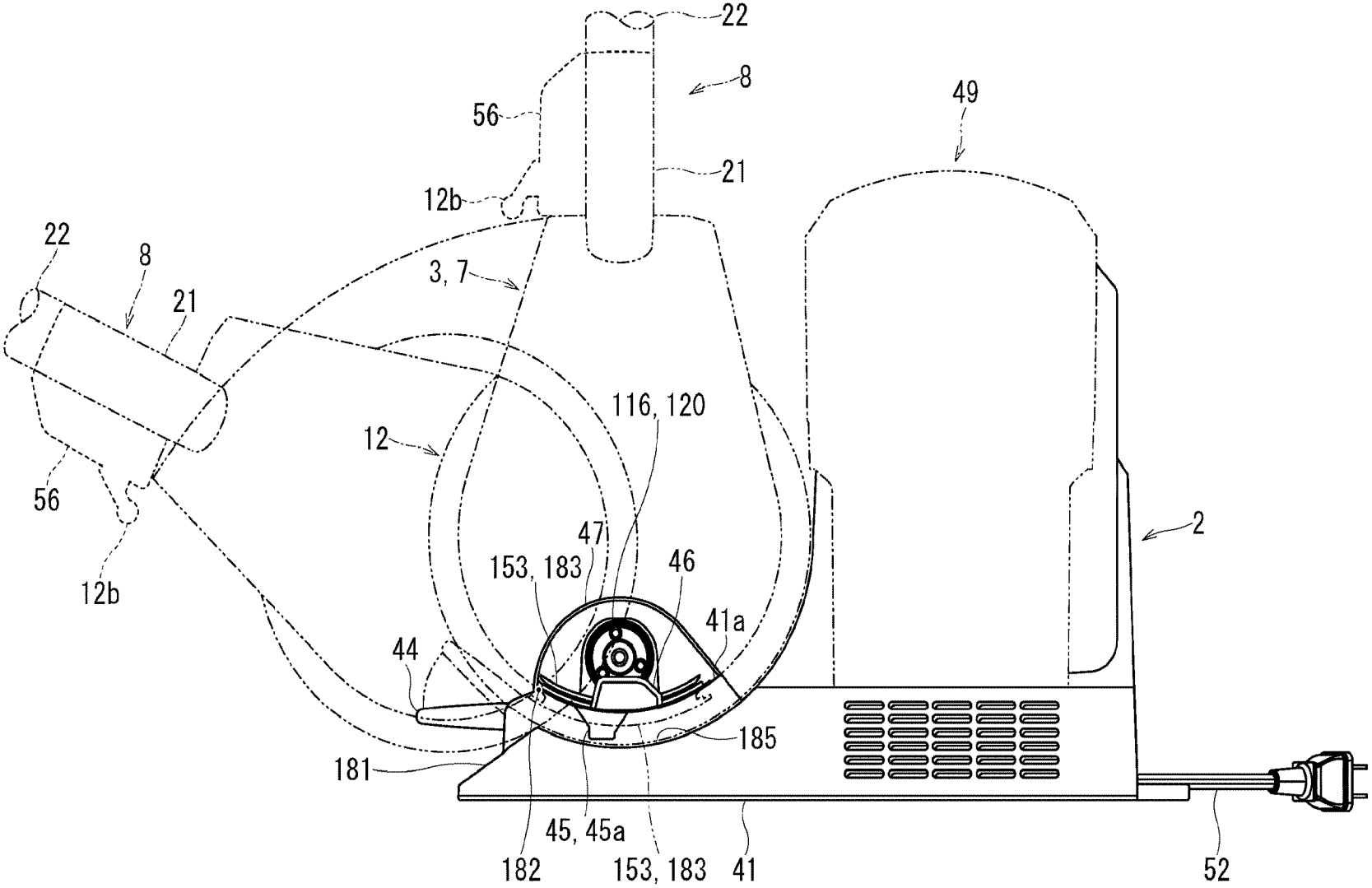
FIG. 25 is a side view of the electric vacuum cleaner apparatus according to the embodiment of the present invention.

FIG. 25 is a side view of the electric vacuum cleaner apparatus according to the embodiment of the present invention.

Figure 26:
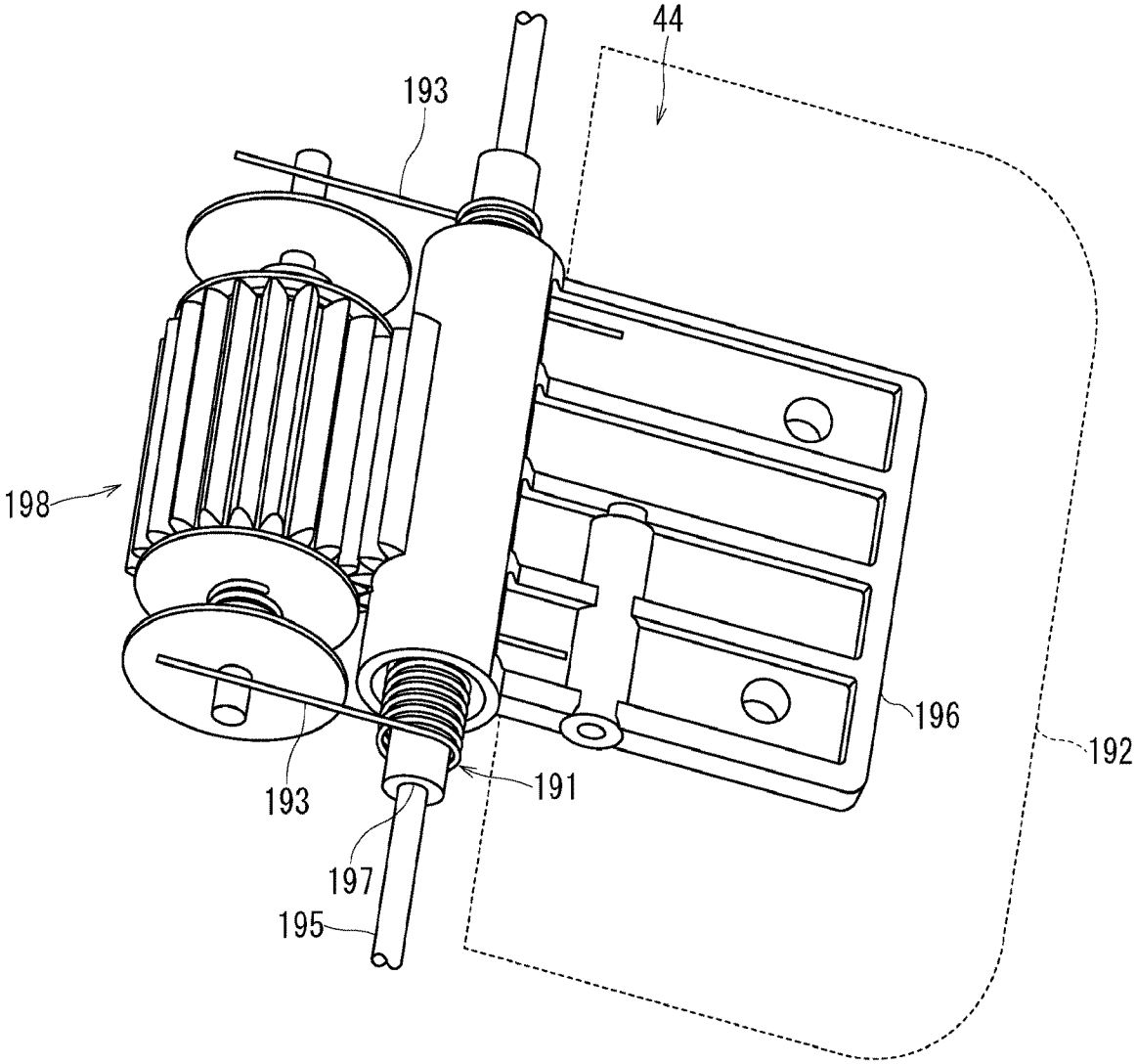
FIG. 26 is a perspective view of a speed reducer of the electric vacuum cleaner apparatus according to the embodiment of the present invention.

FIG. 26 is a perspective view of the speed reducer of the electric vacuum cleaner apparatus according to the embodiment of the present invention.

Figure 27:
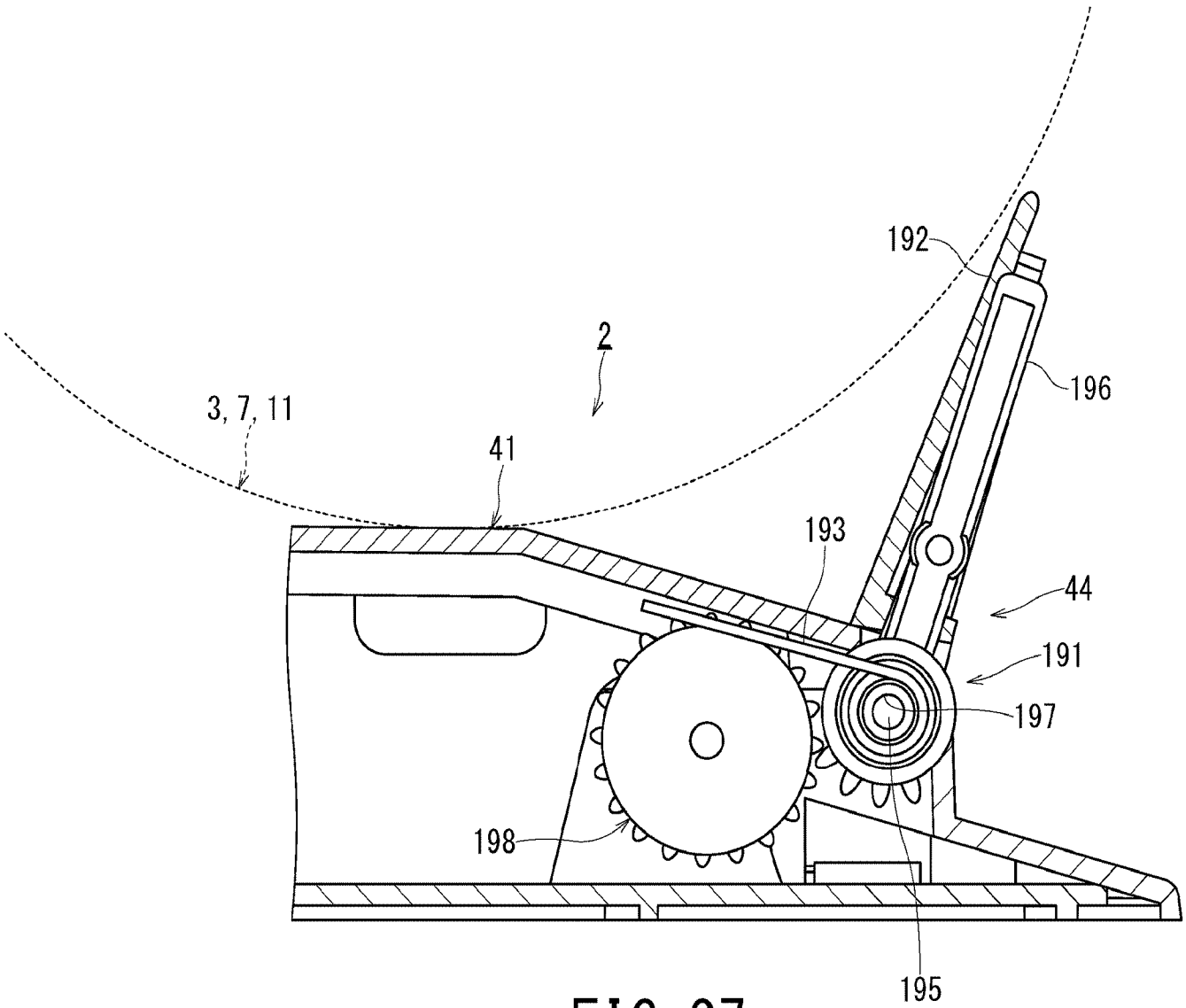
FIG. 27 is a cross-sectional view of the speed reducer of the electric vacuum cleaner apparatus according to the embodiment of the present invention.
Figure 28:
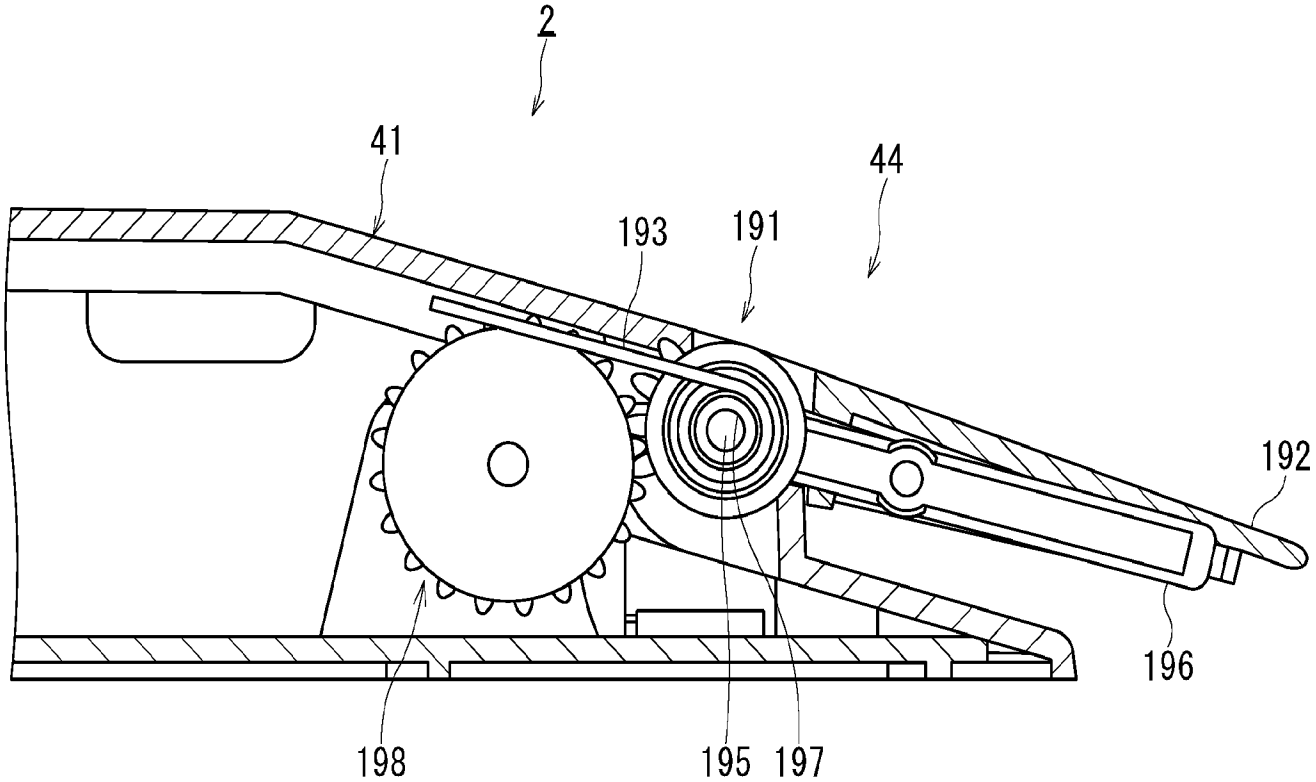
FIG. 28 is another cross-sectional view of the speed reducer of the electric vacuum cleaner apparatus according to the embodiment of the present invention.

FIG. 27 and FIG. 28 are cross-sectional views of the speed reducer of the electric vacuum cleaner apparatus according to the embodiment of the present invention.

FIG. 27 shows the speed reducer 44 that has swung upward to approach the cleaner body 7 and is in the state of waiting. FIG. 28 shows the speed reducer 44 that has moved so as to allow the cleaner body 7 to travel when the cleaner body 7 is separated from the station 2.

As shown in FIG. 25 to FIG. 28 in addition to FIG. 1 and FIG. 2, the handle 56 of the electric vacuum cleaner apparatus 1 according to the present embodiment extends vertically in the storage position in which the electric vacuum cleaner 3 is placed on the station 2. In the storage state in which the electric vacuum cleaner 3 is placed on the station 2, the handle 56 is provided on the opposite side of the dust collection part 42. In other words, the handle 56 is disposed on the front side of the station 2 in the storage state in which the electric vacuum cleaner 3 is placed on the station 2.

The cleaner body 7 of the electric vacuum cleaner apparatus 1 in the use position is lifted to shift the cleaner body 7 to the storage position, then the cleaner body 7 in the storage position is putted down from above the station 2 onto the platform 41, so as to shift to the storage configuration. In this case, when the cleaner body 7 is lifted by holding the handle 56, the position of the electric vacuum cleaner 3 readily shifts (is raised) to the storage position, in which the front of the cleaner body 7 faces upward and the back of the cleaner body 7 faces downward, by the geometry between the handle 56, the center of gravity of the cleaner body 7, and the wheels 12. That is, when the handle 56 is pulled up, the cleaner body 7 rises around the rotation centerline of the wheels 12 while keeping the wheels 12 grounded. A user can lift the cleaner body 7 with the simple action of holding the hand on the handle 56 and pulling it up, and can lift the cleaner body 7 by holding the handle 56 as it is. Thus, in the case of placing the cleaner body 7 on the platform 41 of the station 2, the burden on the user can be reduced and thus it is user-friendly.

The platform 41 includes a placing face 41*a* and a pair of grounding guide faces 181 that contact the wheels 12 in the process of the cleaner body 7 falling from the storage position to the use position. The platform 41 further includes an overturning fulcrum 182 that supports the cleaner body 7 when the cleaner body 7 falls from the storage position to the use position.

The electric vacuum cleaner apparatus 1 includes a slip resistance 183 that is provided on the overturning fulcrum 182 or the cleaner body 7 so as to prevent the slip between the cleaner body 7 and the overturning fulcrum 182 when the cleaner body 7 falls from the storage position to the use position.

The placing face 41*a* has a shape of the back face of the cleaner body 7, i.e., an arc shape that follows the arc shape of the cleaner body 7. The placing face 41*a* is recessed in an arc shape with respect to the horizontal plane.

Each grounding guide face 181 is a slope that is inclined downward to the front of the station 2 such that the cleaner body 7 falling from the storage position to the use position can readily advance to the front of the station 2. Each grounding guide face 181 is a continuation from an arc-shaped wheel disposition recess 185 for accommodating the corresponding wheels 12 of the cleaner body 7 to be stored in the station 2. Thus, each wheel 12 smoothly contacts the grounding guide face 181 in the process in which the cleaner body 7 falls from the storage position to the use position, and supports the cleaner body 7.

The overturning fulcrum 182 is provided above the bottommost of the placing face 41*a*. Thus, when the cleaner body 7 in the storage position is laid down, the cleaner body 7 falls like a lever around the overturning fulcrum 182 and smoothly shifts to the use position.

When the cleaner body 7 falls from the storage position to the use position, the contact point between the overturning fulcrum 182 and the cleaner body 7 preferably does not slip. When the contact point between the overturning fulcrum 182 and the cleaner body 7 slips, it becomes difficult to determine the position, the falling track, or the falling trajectory when the cleaner body 7 falls. Thus, it is preferred that the contact point between the overturning fulcrum 182 and the cleaner body 7 does not slip greatly while a slight slip can be acceptable. Hence, the seal member 153 provided at the inlet of the dust transfer tube 43 also functions as the overturning fulcrum 182. A portion of the seal member 153 that seals the side portion 43*b*, which is on the front of the dust transfer tube 43, functions as the overturning fulcrum 182. The seal member 153 is preferably a synthetic rubber such as natural rubber and silicone rubber in order to seal the connection portion between the dust transfer tube 43 and the primary dust container 13. Since the seal member 153 is not slippery with respect to the cleaner body 7 and is in contact with the cleaner body 7 in the storage state, the seal member 153 is suitable as the overturning fulcrum 182 and also functions as the slip resistance 183.

In addition, the overturning fulcrum 182 may be a member other than the seal member 153. In detail, the overturning fulcrum 182 may be a rib-shaped protrusion provided on the platform 41. Additionally, the slip resistance 183 may be a member other than the seal member 153. It is sufficient that the slip resistance is sandwiched between the cleaner body 7 and the overturning fulcrum 182, and the slip resistance may be provided on the side of the cleaner body 7 or on the side of the station 2.

The speed reducer 44 is provided at the tip of the platform 41 of the station 2. The speed reducer 44 reduces the moving speed of the cleaner body 7 in the process in which the cleaner body 7 falls (i.e., changes the position) from the storage position to the use position. The speed reducer 44 includes: a hinge 191; a support plate 192 swingably supported by the hinge 191; and an elastic member 193 that stores energy when the cleaner body 7 moves so as to be able to advance, and consumes the stored energy for returning the speed reducer 44 to a standby position.

The hinge 191 includes: a shaft 195 supported by the platform 41 of the station 2; and a plate 196 to which the support plate 192 is fixed. The plate 196 has a hole 197 in which the shaft 195 is disposed. The plate 196 swings around the shaft 195. That is, the speed reducer 44 moves so as to fall with the hinge 191 between the standby position where it approaches the cleaner body 7 and a ready-to-move position where the cleaner body 7 can advance. The shaft 195 extends in the width direction of the cleaner body 7 in the storage state. In other words, the shaft 195 is disposed substantially in parallel with the rotation centerline of the wheels 12 of the cleaner body 7 mounted on the platform 41. Thus, when the speed reducer 44 falls, the cleaner body 7 shifts to the use position.

The support plate 192 supports the cleaner body 7 by being in contact with the body housing 11 that moves (falls) from the storage state to the use state. The support plate 192 extends in the width direction of the body housing 11 so as to stably support the moving cleaner body 7. The support plate 192 preferably has a protective material such as piloerection on its surface to be in contact with the cleaner body 7.

When the cleaner body 7 moves so as to be able to advance (i.e., when the cleaner body 7 falls from the storage position to the use position), the support plate 192 forms a downward slope from the coupling guide 148 to the surface to be cleaned such that the cleaner body 7 can be readily detached from the platform 41.

The speed reducer 44 may reduce the moving speed with a so-called brake mechanism 198. The speed reducer 44 may be provided with an oil damper (not shown) for containing the hydraulic oil.

When a user pulls any part of the tubular part 8 of the electric vacuum cleaner 3 (preferably, the hand operation tube 23 or the grip 25), the elastic member 193 succumbs to the user's operation force and the overturning moment of the cleaner body 7 so as to move (or lay down) the speed reducer 44. This movement causes the elastic member 193 to store energy for returning the speed reducer 44.

The elastic member 193 is, for example, a torsion spring. The elastic member 193 does not interfere with the cleaner body 7 mounted on the platform 41 in the storage position to fall down due to application of external force, and enables the speed reducer 44 to return to the standby position after the cleaner body 7 is separated from the station 2.

The charging terminals 46 of the station 2 can be connected to the cleaner body 7 in the storage state, and the connection between the charging terminals 46 and the cleaner body 7 is released when the cleaner body 7 is laid down to the use position. For this reason, as shown in FIG. 22, the terminal cover 199 of the charging terminals 46 include slits 199*a* directed upward of the station 2 and slits 199*b* directed in the direction of detaching the electric vacuum cleaner 3 from the station 2 (i.e., the front direction of the station 2). The charging terminals 46 are connected to the corresponding charging electrodes 19 of the cleaner body 7 to be inserted into the slits 199*a* and 199*b*.

The electric vacuum cleaner 3 can be used by lifting the cleaner body 7 in the storage position from the platform 41 to above the station 2 and putting it to the use position on the surface to be cleaned (floor surface). However, it is less convenient to lift and move the cleaner body 7 at the time of using the electric vacuum cleaner 3.

For this reason, the electric vacuum cleaner apparatus 1 according to the present embodiment can start using the electric vacuum cleaner 3 by tilting down the cleaner body 7 in the storage position. For example, when a user pulls the dust collection hose 22 toward the front of the station 2 by holding any part of the tubular part 8 of the electric vacuum cleaner 3 (preferably, the hand operation tube 23 or the grip 25), the cleaner body 7 falls from the storage position to the use position. The overturning fulcrum 182 functions as a fulcrum when the cleaner body 7 shifts from the storage position to the use position. In other words, when a sufficiently large force to overcome the overturning fulcrum 182 is applied to the cleaner body 7 by a user's operation, the cleaner body 7 shifts from the storage position to the use position while turning around the overturning fulcrum 182 as a fulcrum. At this time, the speed reducer 44 reduces a shock to the cleaner body 7 by reducing a falling speed of the cleaner body 7. In addition, when the auxiliary wheel 12*b* of the electric vacuum cleaner 3 is grounded, the suspension mechanism 57 (FIG. 4) provided between the auxiliary wheel 12*b* and the handle 56 cushions the shock of grounding to be added to the cleaner body 7.

When the user further pulls the tubular part 8, the cleaner body 7 is separated from the station 2. That is, the user can quickly and smoothly start cleaning with the electric vacuum cleaner 3 only by pulling the tubular part 8.

The electric vacuum cleaner 3 of the electric vacuum cleaner apparatus 1 falls toward the front of the station 2 when the tubular part 8 is pulled toward the front of the station 2, and the electric vacuum cleaner 3 detaches from the station 2 when the tubular part 8 is further pulled toward the front of the station 2. Thus, in the electric vacuum cleaner apparatus 1, the position shift of the cleaner body 7 (from the storage position to the use position) and the start of cleaning can be performed together only by pulling the tubular part 8 toward the front of the station 2.

The speed reducer 44 can be applied not only to the station 2 having the charging function and the dust collecting function but also to a simple storage stand that does not have the charging function or the dust collecting function.

The electric vacuum cleaner apparatus 1 according to the present embodiment permits transfer of dust from the primary dust container 13 to the secondary dust container 49 when at least two of the attaching detectors 45 have detected the attaching of the electric vacuum cleaner 3 to the station 2. Consequently, the electric vacuum cleaner apparatus 1 can reliably confirm that the electric vacuum cleaner 3 is stored in the station 2. In other words, the electric vacuum cleaner apparatus 1 confirms that the electric vacuum cleaner 3 is mounted at the correct position of the station 2, and after this confirmation, it can transfer the dust from the primary dust container 13 of the electric vacuum cleaner 3 to the secondary dust container 49 of the station 2. This reliably reduces the risk of dust leaking around the electric vacuum cleaner apparatus 1 when the dust is discharged from the primary dust container 13 to the secondary dust container 49. When the electric vacuum cleaner apparatus 1 has three or more attaching detectors 45, and at least two of the attaching detectors 45 are used for confirming that the electric vacuum cleaner 3 is stored in the station 2, the reliability of the confirmation is improved. Further, when the electric vacuum cleaner apparatus 1 uses all the attaching detectors 45 for confirming that the electric vacuum cleaner 3 is stored in the station 2, the reliability of confirmation can be further improved.

Additionally, the electric vacuum cleaner apparatus 1 according to the present embodiment includes the first attaching detector 45*a* for detecting that the cleaner body 7 is connected to the station 2 among the plurality of attaching detectors 45. Consequently, the electric vacuum cleaner apparatus 1 can more reliably confirm that the electric vacuum cleaner 3 is stored in the station 2.

Further, the electric vacuum cleaner apparatus 1 according to the present embodiment includes the second attaching detector 45*b* for detecting that the tubular part 8 is attached to the cleaner body 7 or the station 2 among the plurality of attaching detectors 45. Consequently, the electric vacuum cleaner apparatus 1 can more reliably confirm that the electric vacuum cleaner 3 is stored in the station 2.

Moreover, the electric vacuum cleaner apparatus 1 according to the present embodiment includes the second attaching detector 45*b* for detecting that the tubular part 8 is attached to the tubular part attachment 53. Consequently, the electric vacuum cleaner apparatus 1 can more reliably confirm that the electric vacuum cleaner 3 is stored in the station 2.

For example, it is conceivable that the user notices an area having been poorly cleaned and tries to resume cleaning in the middle of storing the cleaner body 7 in the station 2. In this case, if the transfer of dust from the primary dust container 13 of the electric vacuum cleaner 3 to the secondary dust container 49 of the station 2 is started at the timing when either the storage of the cleaner body 7 or the attachment of the tubular part 8 is detected, there is a possibility that the connection between the cleaner body 7 and the station 2 is released during the transfer of dust and dust is scattered.

For this reason, in the electric vacuum cleaner apparatus 1 according to the present embodiment, the conditions for permitting the transfer of dust include two detections as follows: the cleaner body 7 is connected to the station 2; and the tubular part 8 is attached to the hose attachment 53. Consequently, the electric vacuum cleaner apparatus 1 permits the transfer of dust after waiting for the storage state of the electric vacuum cleaner 3 to be completed, and prevents the dust from scattering.

Furthermore, the electric vacuum cleaner apparatus 1 according to the present embodiment includes the third attaching detector 45*c* for detecting that the body handle 14 is in the storage position in the plurality of attaching detectors 45. Consequently, the electric vacuum cleaner apparatus 1 can confirm that the electric vacuum cleaner 3 is stored in the station 2 from various viewpoints. The electric vacuum cleaner apparatus 1 detects that the body handle 14 is in the storage position, adds this detection result to the determination condition as to whether the electric vacuum cleaner 3 is stored in the station 2, and thus the reliability of the determination is further increased.

Additionally, the electric vacuum cleaner apparatus 1 according to the present embodiment includes the notification device 179 configured to perform notification when at least one of the attaching detectors 45 does not detect the attaching of the electric vacuum cleaner 3 to the station 2 within the predetermined time after another attaching detector 45 detects the attachment of the electric vacuum cleaner 3 to the station 2. Consequently, when the electric vacuum cleaner apparatus 1 cannot determine as to whether the electric vacuum cleaner 3 is stored in the station 2 in the predetermined state, the electric vacuum cleaner apparatus 1 can inform the user of that and prompt the user to correct the storage state of the electric vacuum cleaner 3.

Moreover, the electric vacuum cleaner apparatus 1 according to the present embodiment starts the transfer of dust after a predetermined delay time has elapsed from the permission to transfer the dust. Consequently, the electric vacuum cleaner apparatus 1 avoids starting the secondary electric blower 50 immediately after the electric vacuum cleaner 3 is attached to the station 2 that may surprise the user.

Therefore, according to the present embodiment as described above, the electric vacuum cleaner apparatus 1 can reliably confirm that the electric vacuum cleaner 3 is attached to the correct position of the charging station 2, and thus the dust to be discharged from the primary dust container 13 to the secondary dust container 49 does not leak around.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

1 electric vacuum cleaner apparatus
2 station
3 electric vacuum cleaner
7 cleaner body
8 hose
11 body housing
11*a* exhaust-port lid
11*b* handle storage recess
12 wheel
12*a* auxiliary wheel
12*b* auxiliary wheel
12*c* grounding wall
12*d* side wall
13 primary dust container
14 body handle
15 primary electric blower
16 cleaner controller
17 rechargeable battery
17*a* unit cell
18 connection port
19 charging electrode
21 connecting tube
22 dust collecting hose
23 hand operation tube
25 grip
26 input unit
26*a* stop switch
26*b* start switch
26*c* brush switch
27 extension tube
27*a* holding projection
28 cleaning head
31 suction port
32 rotatable brush
33 electric motor
41 platform
41*a* placing face
42 dust collection part
43 dust transfer tube
43*b* side portion on the front side
44 speed reducer

45 attaching detector
45*a* first attaching detector
45*b* second attaching detector
45*c* third attaching detector
46 charging terminal
47 bulge
48 housing
49 secondary dust container
50 secondary electric blower
51 station controller
52 power cord
53 hose attachment
56 handle
56*a* inclined portion
57 suspension mechanism
61 dust container chamber
61*a* dust-container insertion and extraction port
62 electric blower chamber
64 separation part
65 dust collection part
66 communication passage
66*a* air passage
66*b* air passage
66*c* collective air passage
68 first separator
69 filter
71 coarse-dust collecting chamber
72 filter chamber
73 dust collecting chamber
75 nozzle
76 first filter frame
77 first mesh filter
78 container body
78*a* suction port
79 coarse-dust discharge port
81 relay air-passage
82 coarse-dust collecting chamber outlet
83 partition wall
84 second mesh filter
86 filter
87 filter
86*a*, 87*b* ridge line
88 secondary filter frame
89 secondary filter outlet
91 waste outlet
92 waste-outlet lid
93 suction port
94 suction-port lid
95 dust-removal mechanism
96 power transmission mechanism
97 dust compression mechanism
98 machine chamber
99 body-housing waste-outlet
101 coarse-dust waste-outlet
102 fine-dust waste-outlet
103 packing
105 rack
105*a* hole
105*b* teeth
106 driven mechanism
107 gear
107*a* teeth
107*b* shaft
108 frame
109 slider
111 dust remover
112 rail
114 driven mechanism
115 driven part
116 driving part
117 first transmission mechanism
118 second transmission mechanism
119 third Transmission mechanism
120 shaft coupling
121 first gear
122 second gear
123 lever
123*a* teeth
124 guide
125 stopper
126 groove
127 guide plate
128 slider
129 waste-lid closing spring
131 return spring
133 base
134*a* first roller
134*b* second roller
134*c* third roller
135*d* fourth roller
134*e* fifth roller
134*f* sixth roller
135 base support member
135*a* flange
136 handle return mechanism
137*a* first gear
137*b* second gear
137*c* third gear
138 return spring
142 dust collecting unit
143 centrifugal separation device
144 first centrifugal separator
145 second centrifugal separator
146 downstream air duct
148 coupling guide
149 drive source
151 power transmission mechanism
151*a*, 151*b*, 151*c* gears
153 seal member
155 power transmission passage
156 coupler
157 disconnecting spring
158 cam mechanism
161 arc-shaped groove
162 pin
163 driving member
164 driven member
164*a* first cam face
164*b* second cam face
164*c* third cam face
166 charging terminal
171 control circuit on electric vacuum cleaner side
172 control circuit on station side
175 switching element
176 control power supply
177 switching element
178 control power supply
179 notification device
181 grounding guide face
182 overturning fulcrum
183 slip resistance
185 wheel disposition recess
191 hinge
192 support plate

193 elastic member
195 shaft
196 plate
197 hole
198 brake mechanism
199 terminal cover
199*a*, 199*b* slit

The invention claimed is:

1. An electric vacuum cleaner apparatus, comprising:
a station;
an electric vacuum cleaner attachable to the station; and
a plurality of attaching detectors configured to detect that the electric vacuum cleaner is attached to the station,
wherein the electric vacuum cleaner comprises:
a cleaner body;
an air passage including a suction port, the air passage being connected to the cleaner body and configured to introduce dust sucked in from the suction port to the cleaner body; and
a primary dust container attached to the cleaner body, and configured to accumulate the dust introduced into the cleaner body,
wherein the station comprises:
a secondary dust container configured to accumulate the dust to be discharged from the primary dust container,
wherein the plurality of attaching detectors include a first attaching detector configured to detect that the air passage is in a state at a time of storage where the air passage is attached to the station, and
wherein the electric vacuum cleaner apparatus permits transfer of the dust from the primary dust container to the secondary dust container when at least two of the plurality of attaching detectors have detected an attaching of the electric vacuum cleaner to the station.

2. The electric vacuum cleaner apparatus according to claim 1, wherein the plurality of attaching detectors include a second attaching detector configured to detect that the cleaner body is connected to the station.

3. The electric vacuum cleaner apparatus according to claim 2,
wherein the station includes an attachment to which the air passage can be attached, and
wherein the first attaching detector is configured to detect that the air passage is attached to the attachment.

4. The electric vacuum cleaner apparatus according to claim 3, further comprising a handle that is provided on the cleaner body and can move between a use position and a storage position,
wherein the plurality of attaching detectors include a third attaching detector configured to detect that the handle is in the storage position.

5. The electric vacuum cleaner apparatus according to claim 2, further comprising a handle that is provided on the cleaner body and can move between a use position and a storage position,
wherein the plurality of attaching detectors include a third attaching detector configured to detect that the handle is in the storage position.

6. The electric vacuum cleaner apparatus according to claim 1,
wherein the station includes an attachment to which the air passage can be attached, and
wherein the first attaching detector is configured to detect that the air passage is attached to the attachment.

7. The electric vacuum cleaner apparatus according to claim 6, further comprising a handle that is provided on the cleaner body and can move between a use position and a storage position,
wherein the plurality of attaching detectors include a third attaching detector configured to detect that the handle is in the storage position.

8. The electric vacuum cleaner apparatus according to claim 1, further comprising a handle that is provided on the cleaner body and can move between a use position and a storage position,
wherein the plurality of attaching detectors include a third attaching detector configured to detect that the handle is in the storage position.

9. The electric vacuum cleaner apparatus according to claim 1, further comprising a notification device configured to perform notification when at least one of the attaching detectors does not detect the attaching of the electric vacuum cleaner to the station within a predetermined time after at least one of other attaching detectors detects the attaching of the electric vacuum cleaner to the station.

10. The electric vacuum cleaner apparatus according to claim 1, wherein the electric vacuum cleaner apparatus starts transfer of the dust after a predetermined delay time elapses from permission to transfer the dust.

11. The electric vacuum cleaner apparatus according to claim 1, wherein
the air passage further includes a collecting hose, and
the air passage is configured to introduce the dust sucked in form the suction port to the cleaner body through the collecting hose.

12. The electric vacuum cleaner apparatus according to claim 1, wherein the electric vacuum cleaner apparatus permits the transfer of the dust when at least two including the first attaching detector out of the plurality of attaching detectors have detected the attaching of the electric vacuum cleaner to the station.

* * * * *